US006139295A

United States Patent [19]

Utter et al.

[11] Patent Number: 6,139,295

[45] Date of Patent: Oct. 31, 2000

[54] BEARING LUBRICATION SYSTEM FOR A SCROLL COMPRESSOR

[75] Inventors: Robert E. Utter; David K. Haller, both of Adrian, Mich.

[73] Assignee: Tecumseh Products Company, Tecumseh, Mich.

[21] Appl. No.: 09/335,412

[22] Filed: Jun. 17, 1999

Related U.S. Application Data

[60] Provisional application No. 60/090,136, Jun. 22, 1998.

[51] Int. Cl.[7] ..... F01C 1/02

[52] U.S. Cl. ..... 418/55.6; 418/55.5; 418/57; 418/94

[58] Field of Search ..... 418/55.6, 55.5, 418/57, 94

[56] References Cited

U.S. PATENT DOCUMENTS

| | | | |
|---|---|---|---|
| Re. 33,473 | 12/1990 | Hazaki et al. . | |
| 4,502,852 | 3/1985 | Hazaki . | |
| 4,551,082 | 11/1985 | Hazaki et al. . | |
| 4,575,320 | 3/1986 | Kobayashi et al. . | |
| 4,792,296 | 12/1988 | Kobayashi et al. . | |
| 4,875,838 | 10/1989 | Richardson, Jr. | 418/94 |
| 4,875,840 | 10/1989 | Johnson et al. | 418/94 |
| 5,013,225 | 5/1991 | Richardson, Jr. . | |
| 5,037,278 | 8/1991 | Fujio et al. . | |
| 5,104,302 | 4/1992 | Richardson, Jr. | 418/55.6 |

(List continued on next page.)

FOREIGN PATENT DOCUMENTS

| | | | |
|---|---|---|---|
| 58-160582 | 9/1983 | Japan | 418/55.6 |
| 58-172487 | 10/1983 | Japan | 418/94 |
| 58-214690 | 12/1983 | Japan | 418/94 |
| 58-214691 | 12/1983 | Japan . | |
| 59-113290 | 6/1984 | Japan . | |
| 59-224494 | 12/1984 | Japan | 418/94 |
| 60-135691 | 7/1985 | Japan | 418/94 |
| 4-203377 | 7/1992 | Japan . | |

*Primary Examiner*—Thomas Denion
*Assistant Examiner*—Theresa Trieu
*Attorney, Agent, or Firm*—Baker & Daniels

[57] ABSTRACT

A scroll compressor having a suction chamber into which fluid is received substantially at suction pressure and a discharge chamber from which the fluid is discharged substantially at discharge pressure, including mutually engaged fixed and orbiting scroll members, in fluid communication with the suction and discharge chambers, an intermediate pressure chamber defined in part by one of fixed and orbiting scroll members, an oil reservoir, an electric motor, and a shaft operably coupling the motor and the orbiting scroll member. The shaft is provided with a longitudinal passageway extending longitudinally therethrough, the longitudinal passageway in fluid communication with the oil reservoir and provided with oil therefrom. The shaft is provided with a first passage in fluid communication with the longitudinal passageway and which extends substantially laterally outward from the longitudinal passageway to a radially outer surface of the shaft. A roller is disposed about the shaft radially outer surface, the orbiting scroll member linked to the shaft through the roller. The roller is provided with inner and outer circumferential surfaces and a second passage extending therebetween, the first and second passages in fluid communication, whereby oil from the oil reservoir is provided to the roller outer circumferential surface through the longitudinal passageway and the first and second passages. A bearing is disposed between the roller outer circumferential surface and the orbiting scroll member. An oil receiving space is provided adjacent the bearing, the oil receiving space defined in part by a surface provided on the orbiting scroll member which is opposite its substantially planar surface, an axially facing surface of the roller, and an end surface of the shaft. The intermediate pressure chamber and the oil receiving space are substantially out of fluid communication. Oil is provided from the second passage to the oil receiving space through the bearing. A third passage extends between the oil receiving space and an intermediate pressure space between the fixed and orbiting involute wrap elements, and oil is provided to the intermediate pressure space from the oil receiving space through the third passage.

18 Claims, 31 Drawing Sheets

U.S. PATENT DOCUMENTS 5,110,268 5/1992 Sakurai et al. .
5,131,828 7/1992 Richardson, Jr. et al. ..... 418/55.6
5,197,868 3/1993 Caillat et al. .
5,249,941 10/1993 Shibamoto .
5,370,513 12/1994 Fain .
5,395,224 3/1995 Caillat et al. .
5,533,875 7/1996 Crum et al. .
5,542,830 8/1996 Yuzaki .
5,593,297 1/1997 Nakajima et al. .
5,616,016 4/1997 Hill et al. .
5,645,408 7/1997 Fujio et al. .
5,660,539 8/1997 Matsunaga et al. .
5,716,202 2/1998 Koyama et al. .
5,720,602 2/1998 Hill et al. .
5,745,992 5/1998 Caillat et al. .
5,759,021 6/1998 Yamaguchi et al. .
5,772,411 6/1998 Crum et al. .
5,772,416 6/1998 Caillat et al. .
5,810,573 9/1998 Mitsunaga et al. .

BEARING LUBRICATION SYSTEM FOR A SCROLL COMPRESSOR

CROSS-REFERENCE TO RELATED APPLICATION

This application is related to and claims the benefit under 35 U.S.C. §119(e) of United States Provisional Patent Application Serial No. 60/090,136, filed Jun. 22, 1998.

BACKGROUND OF THE INVENTION

The invention generally relates to hermetic scroll compressors and more particularly to bearing lubrication systems in scroll compressors.

U.S. Pat. No. 5,306,126 (Richardson), issued to the assignee of the present invention, is incorporated herein by reference and provides a detailed description of the operation of a typical scroll compressor.

Typically, hermetic compressors of the scroll type including a scroll mechanism which receives refrigerant at a suction pressure, compresses the received refrigerant, and discharges the compressed refrigerant at an elevated discharge pressure. Such scroll compressors are typically used in refrigeration, air conditioning and other such systems. The typical scroll mechanism includes an orbiting scroll member and a fixed scroll member, but may in an alternative form comprise co-rotating scroll members. Wraps are provided on each of the scroll members and face and intermesh with each other in an orbiting fashion so as to form pockets of compression during compressor operation.

Scroll compressors take various forms, such as high-side type compressors, wherein the internal volume of the compressor housing, and the lubrication oil sump or reservoir therein, is primarily at discharge pressure. The crankshaft includes an axial oil conveyance passageway which extends into the sump and is in fluid communication with various lubrication points in the compressor mechanism. The axial oil conveyance passageway may extend into the sump through the crankshaft itself, or through a crankshaft extension which comprises an end of the crankshaft. Where the lubrication oil sump is at discharge pressure, oil may be forced upwards, through the oil conveyance passageway to the compression mechanism, at least partially by the influence of the discharge refrigerant gas pressure exerted on the surface of the oil in the sump. This, of course, requires some pressure differential between the oil in the sump and the oil delivered to the lubrication points. Oil pumps of various types, such as centrifugal or positive displacement, are also used to help force oil upwards from the sump, through the axial oil conveyance passageway in the crankshaft, to the lubrication points of the compressor mechanism.

It is usually desirable to provide a means of returning oil, once it has lubricated the compressor mechanism, immediately to the oil sump of the compressor assembly, rather than to allow the oil to be discharged with the compressed refrigerant from the compressor assembly, circulated with the refrigerant through the refrigerant system, and returned to the compressor from the refrigerant system with the suction pressure gases. Oil so circulated coats the interior surfaces of heat exchangers, decreasing their efficiency, and may become logged for a substantial time in refrigeration system components before being returned to the compressor's oil sump. It is, however, desirable to provide some amount of oil to the interleaved scroll wraps to lubricate and help seal them. Oil provided to the space between the interleaved scroll wraps is usually carried from the compressor assembly with the compressed gas. A passage through which a small amount of oil is provided to the interleaved scroll wraps, but while preventing substantial amounts of oil from being discharged with compressed gas from the compressor assembly, is desirable. It is also desirable to return oil, after it has lubricated the various lubrication points of the compressor mechanism, to the oil sump for immediate reuse.

Further, there are certain circumstances, such as immediately upon compressor startup, when the pressure of refrigerant between the interleaved scroll wraps is at a pressure higher than discharge pressure. Refrigerant gas may vent from between the interleaved scroll wraps through portions of the lubrication system which are ordinarily under discharge pressure. Because oil may be carried away from lubricated surfaces by refrigerant, it is desirable to provide a flowpath for refrigerant venting from the space between the interleaved scroll wraps, through the above-mentioned passage, to the discharge pressure chamber of the compressor assembly, which does not cause the refrigerant to flow through bearings, which may flush the oil therefrom.

SUMMARY OF THE INVENTION

In a scroll compressor according to one embodiment of the present invention, oil is provided from an oil passageway within the crankshaft, which is plugged at its terminal end, through communicating cross-drilled holes in the crankpin and roller. Oil delivered through these cross-drilled holes lubricates the roller bearing and, in part, flows upward through the bearing to an oil gallery defined by the adjacent upper surfaces of the crankpin and the roller, and the downwardly facing surface of the orbiting scroll hub in which the roller and crankpin are disposed. Oil from the gallery or cavity is delivered through a hole or passage in the scroll endplate to an intermediate pressure portion between the scrolls. The other portion of oil delivered through the cross-drilled holes flows downward through the roller bearing to annular galleries and is then delivered through a hole back to the discharge pressure area of the compressor, which includes the sump. Another cross-drilled hole in the journalled portion of the crankshaft delivers oil from the shaft oil passageway to the main crankcase bearing.

Additionally, a vent passage is formed by the outer cylindrical surface of the crankpin and the surface of the roller bore in which the crankpin is received. This vent allows intermediate pressure refrigerant which may be forced through the scroll endplate hole into the oil gallery atop the crankpin and roller during certain operating conditions, to flow therethrough to a region where it can be returned to the discharge gas pressure chamber of the compressor, preventing the venting refrigerant from flushing the oil from the scroll drive bearing or impeding oil flow thereto from the oil passageway within the crankshaft.

The present invention provides a scroll compressor having a suction chamber into which fluid is received substantially at suction pressure and a discharge chamber from which the fluid is discharged substantially at discharge pressure, including mutually engaged fixed and orbiting scroll members, in fluid communication with the suction and discharge chambers, an intermediate pressure chamber defined in part by one of fixed and orbiting scroll members, an oil reservoir, an electric motor, and a shaft operably coupling the motor and the orbiting scroll member. The shaft is provided with a longitudinal passageway extending longitudinally therethrough, the longitudinal passageway in fluid communication with the oil reservoir and provided with oil therefrom. The shaft is provided with a first passage in fluid communication with the longitudinal passageway and which extends substantially laterally outward from the longitudinal passageway to a radially outer surface of the shaft. A roller is disposed about the shaft radially outer surface, the orbiting scroll member linked to the shaft through the roller. The roller is provided with inner and outer circumferential surfaces and a second passage extending therebetween, the first and second passages in fluid communication, whereby oil from the oil reservoir is provided to the roller outer circumferential surface through the longitudinal passageway and the first and second passages. A bearing is disposed between the roller outer circumferential surface and the orbiting scroll member. An oil receiving space is provided adjacent the bearing, the oil receiving space defined in part by a surface provided on the orbiting scroll member which is opposite its substantially planar surface, an axially facing surface of the roller, and an end surface of the shaft. The intermediate pressure chamber and the oil receiving space are substantially out of fluid communication. Oil is provided from the second passage to the oil receiving space through the bearing. A third passage extends between the oil receiving space and an intermediate pressure space between the fixed and orbiting involute wrap elements, and oil is provided to the intermediate pressure space from the oil receiving space through the third passage.

The present invention also provides a scroll compressor having a suction chamber into which fluid is received substantially at suction pressure and a discharge chamber from which the fluid is discharged substantially at discharge pressure, including mutually engaged fixed and orbiting scroll members in fluid communication with the suction and discharge chambers, an electric motor, a shaft having a radially outer surface and operably coupling the motor and the orbiting scroll member, and a roller disposed about the shaft radial surface, the orbiting scroll member linked to the shaft through the roller. The roller is provided with inner and outer circumferential surfaces, and a bearing is disposed between the outer circumferential roller surface and the orbiting scroll member. A space is provided adjacent the bearing and is defined in part by a surface provided on the orbiting scroll member which is opposite its substantially planar surface, a first axially facing surface of the roller, and an end surface of the shaft. A passage extends between the space and an intermediate pressure space between the engaged fixed and orbiting involute wrap elements. A longitudinal clearance is provided between the roller inner circumferential surface and the shaft radially outer surface. A vent is formed between the intermediate pressure space and the discharge pressure chamber through the passage, the space and the clearance, whereby fluid at a pressure greater than discharge pressure in the intermediate pressure space is provided a flowpath which does not flow through the bearing.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
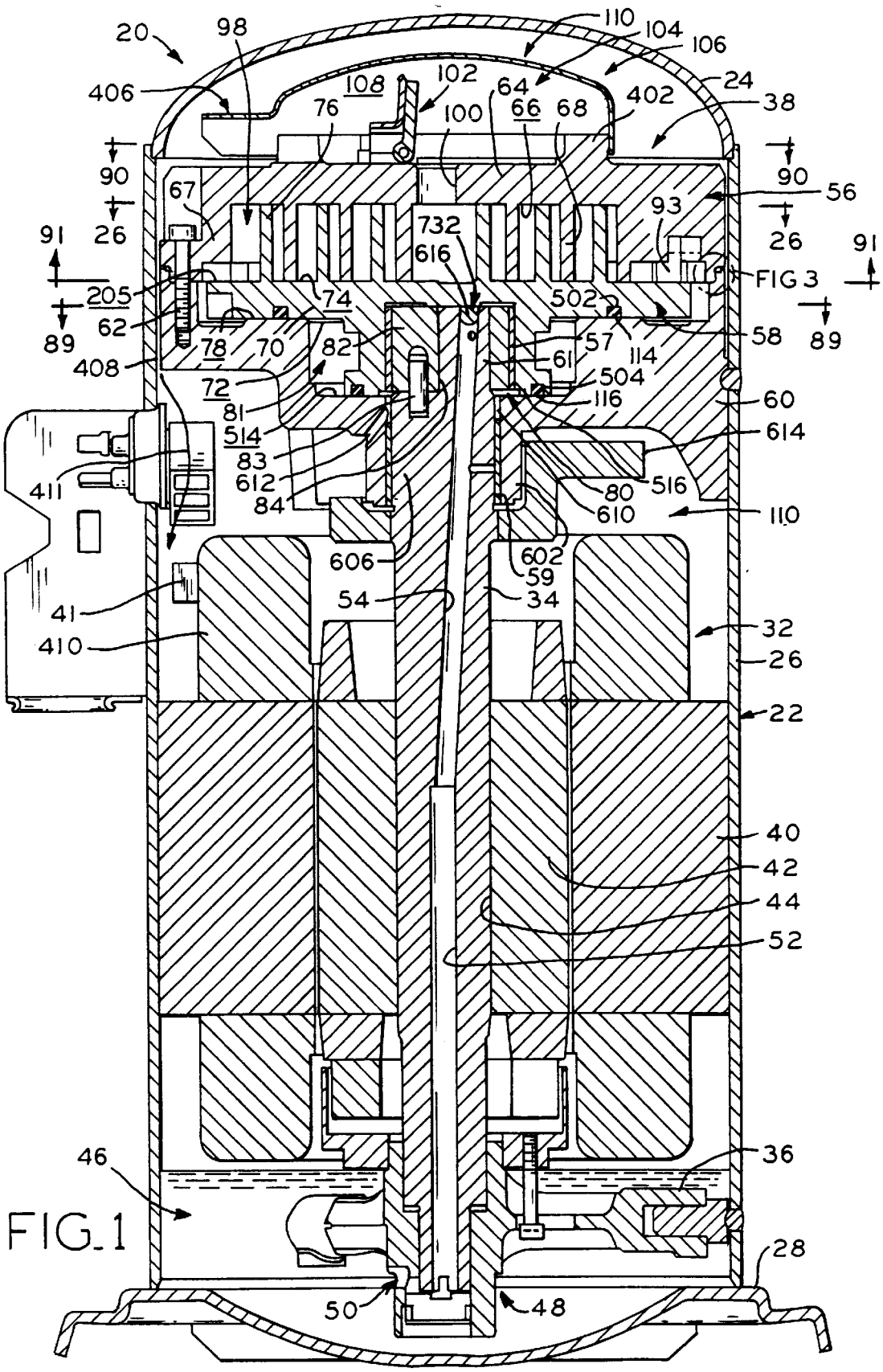
FIG. 1 is a scroll sectional view of the scroll compressor of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DETAILED DESCRIPTION OF THE INVENTION

In an exemplary embodiment of the invention as shown in the drawings, scroll compressor 20 is shown in one vertical shaft embodiment. This embodiment is only provided as an example to which the invention is not limited.

Referring now to FIG. 1, scroll compressor 20 is shown having housing 22 consisting of upper portion 24, central portion 26 and lower portion 28. In an alternative form central portion 26 and lower portion 28 may be combined as a unitary lower housing member. Housing portions 24, 26, and 28 are hermetically sealed and secured together by such processes as welding or brazing. Lower housing member 28 also serves as a mounting flange for mounting compressor 20 in a vertical upright position. The present invention is also applicable in horizontal compressor arrangements. Within housing 22 is electric motor 32, crankshaft 34, which is supported by lower bearing 36, and scroll mechanism 38. Motor 32 includes stator 40 and rotor 42 which has aperture 44 into which is received crankshaft 34. Oil collected in oil sump or reservoir 46 provides a source of oil and is drawn into positive displacement oil pump 48 at inlet 50 and is discharged from oil pump 48 into lower oil passageway 52. Lubricating oil travels along passageways 52 and 54, whereby it is delivered to bearings 57, 59 and between the intermeshed scroll wraps as described further below.

Scroll compressor mechanism 38 generally comprises fixed scroll member 56, orbiting scroll member 58, and main bearing frame member 60. Fixed scroll member 56 is fixably secured to main bearing frame member 60 by a plurality of mounting bolts or members 62. Fixed scroll member 56 comprises generally flat end plate 64, having substantially planar face surface 66, sidewall 67 and an involute fixed wrap element 68 which extends axially downward from surface 66. Orbiting scroll member 58 comprises generally flat end plate 70, having substantially planar back surface 72 and substantially planar top face surface 74, and involute orbiting wrap element 76, which extends axially upward from top surface 74. With compressor 20 in a de-energized mode, back surface 72 of orbiting scroll plate 70 engages main bearing member 60 at thrust bearing surface 78.

Figure 56:
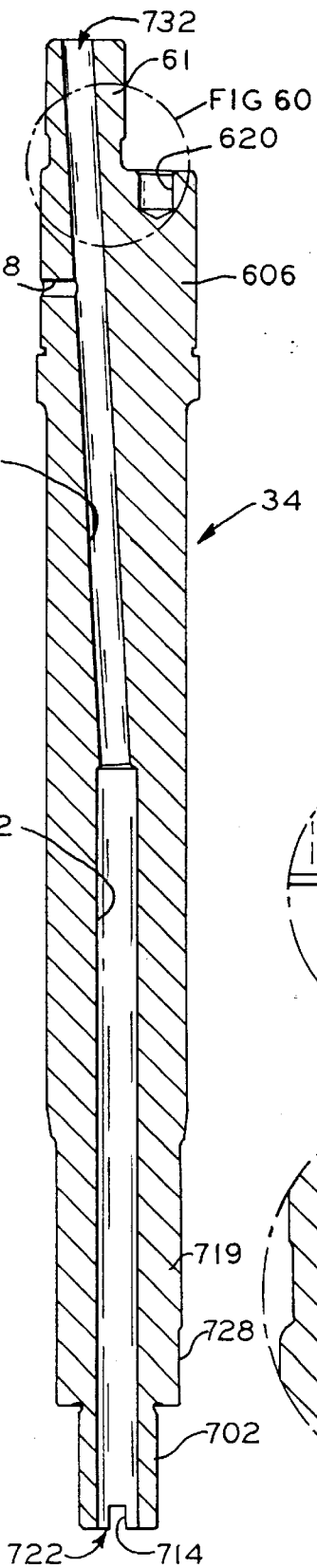
FIG. 56 is a sectional side view of the crankshaft of FIG. 55 along line 56—56.
Figure 61A:
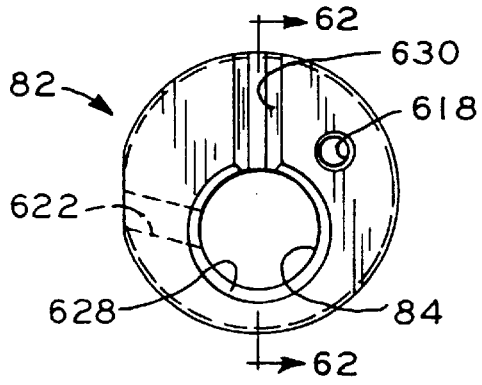
FIG. 61A is a bottom view of the eccentric roller of the scroll compressor of FIG. 1.
Figure 61B:
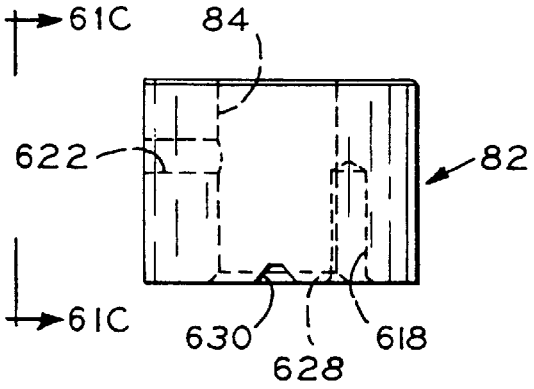
FIG. 61B is a side view of the eccentric roller of FIG. 61A.
Figure 61C:
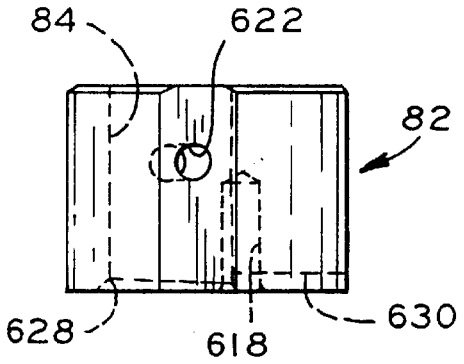
FIG. 61C is a side view of the eccentric roller of FIG. 61B from line 61C—61C.
Figure 62:
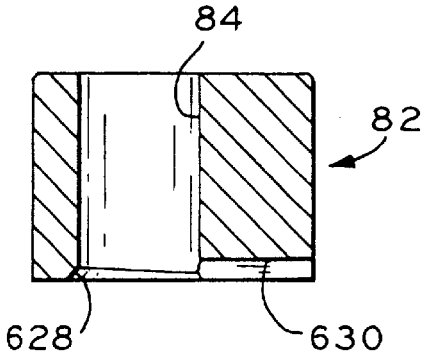
FIG. 62 is a sectional side view of the eccentric roller of FIG. 61A along line 62—62.

Scroll mechanism 38 is assembled with fixed scroll member 56 and orbiting scroll member 58 intermeshed so that fixed wrap 68 and orbiting wrap 76 operatively interfit with each other. To insure proper compressor operation, face surfaces 66 and 74 and wraps 68 and 76 are manufactured so that when fixed scroll member 56 and orbiting scroll member 58 are forced axially toward one another, the tips of wraps 68 and 76 sealingly engage with respective opposite face surfaces 74 and 66. During compressor operation, back surface 72 of orbiting scroll member 58 becomes axially spaced from thrust surface 78 in accordance with strict machining tolerances and the amount of permitted axial movement of orbiting scroll member 58 toward fixed scroll member 56. Situated on the top of crankshaft 34 about offset crankpin 61 is cylindrical roller 82, which comprises swinglink mechanism 80. Referring to FIG. 61A, roller 82 is provided with offset axial bore 84 which receives crankpin 61 and offset axial bore 618 which receives limiting pin 83, which is interference-fitted into and extends from hole 620 provided in the upper axial surface of crankshaft journal portion 606 (FIG. 56). Roller 82 is allowed to pivot slightly about crankpin 61, its motion relative thereto limited by limiting pin 83, which fits loosely in roller bore 618 (FIG. 61C). When crankshaft 34 is caused to rotate by motor 32, cylindrical roller 82 and Oldham ring 93 cause orbiting scroll member 58 to orbit with respect to fixed scroll member 56. In this manner swinglink mechanism 80 functions as a radial compliance mechanism to promote sealing engagement between the flanks of fixed wrap 68 and orbiting wrap 76.

Figure 2:
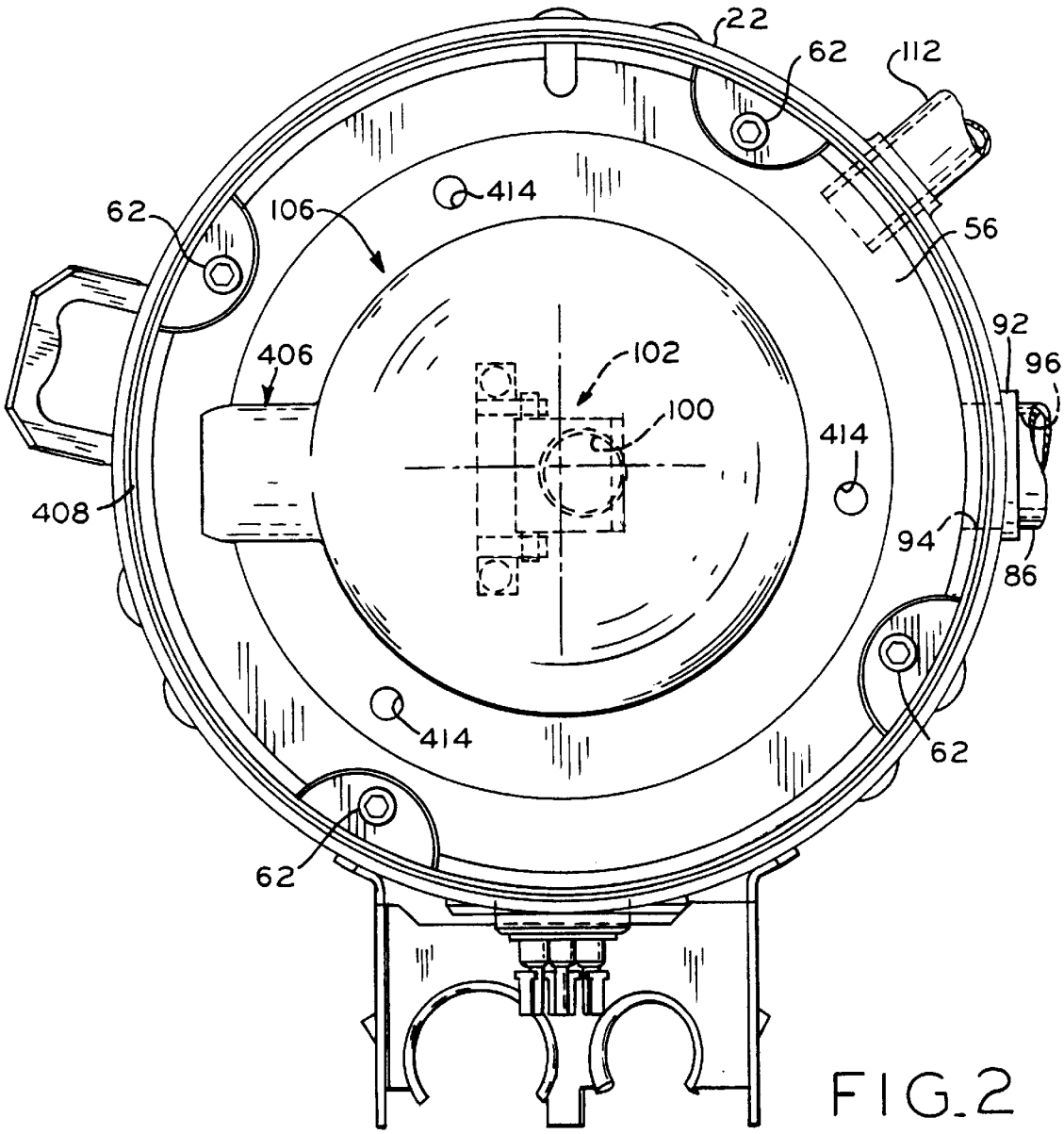
FIG. 2 is a top view looking inside the housing of the scroll compressor of FIG. 1.
Figure 4:
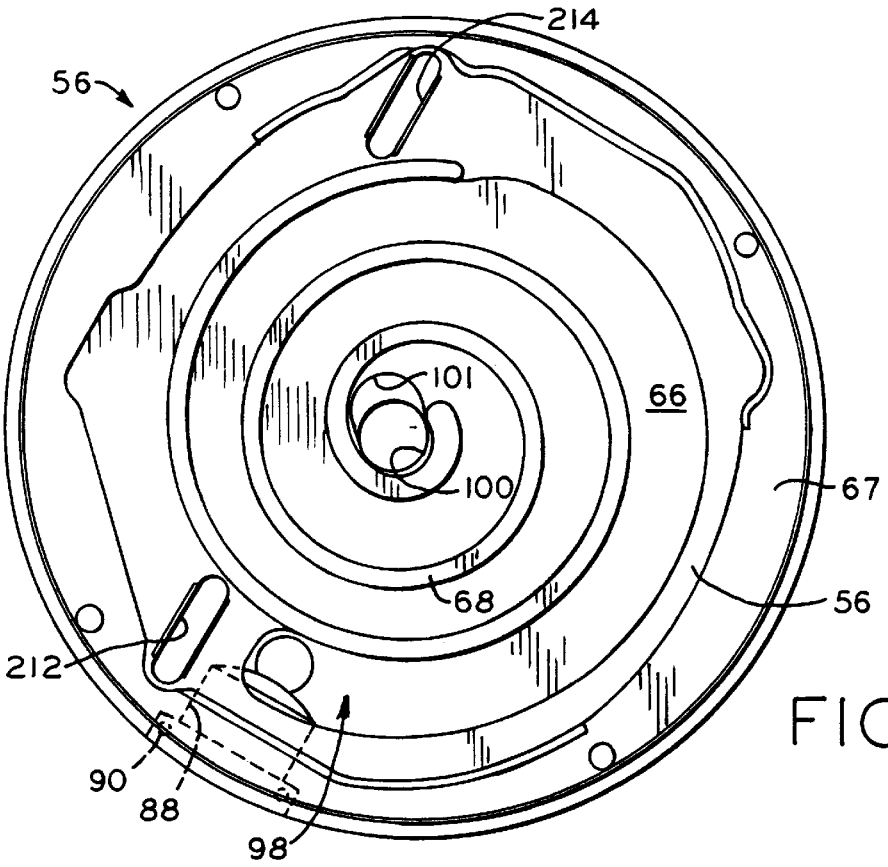
FIG. 4 is a bottom view of the fixed scroll member of the scroll compressor of FIG. 1.
Figure 8:
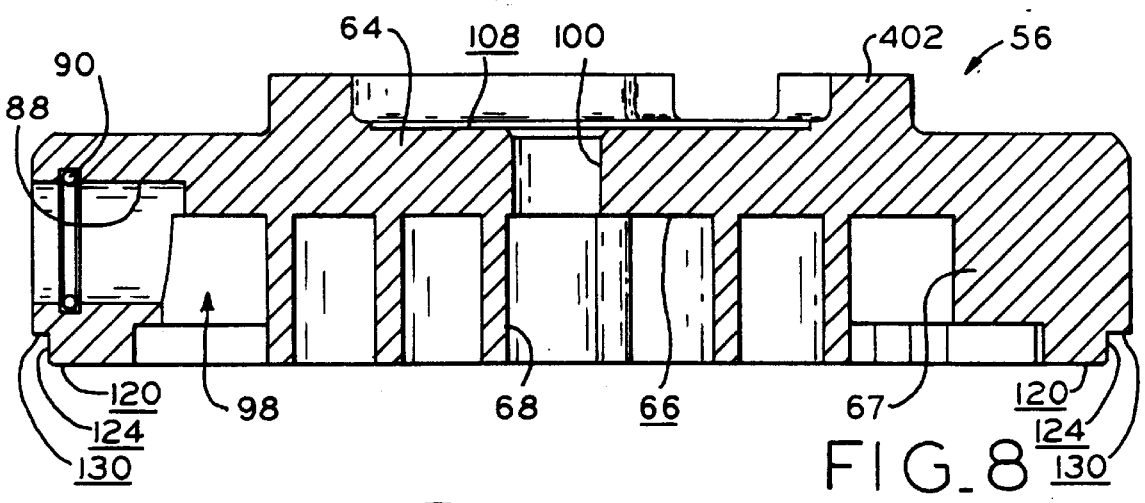
FIG. 8 is a sectional side view of the fixed scroll member taken along line 8—8 of FIG. 5.

With compressor 20 in operation, refrigerant fluid at suction pressure is introduced through suction tube 86 (FIG. 2), which is sealingly received into counterbore 88 (FIGS. 4, 8) in fixed scroll member 56. The sealing of suction tube 86 with counterbore 88 is aided by the use of O-ring 90 (FIG. 8). Suction port 88 provided in fixed scroll member 56 receives suction tube 86 and annular O-ring 90 in a groove for proper sealing of suction tube 86 with fixed scroll 56. Suction tube 86 is secured to compressor 20 by suction tube adapter 92 which is brazed or soldered to suction tube 86 and opening 94 of housing 22 (FIG. 2). Suction tube 86 includes suction pressure refrigerant passage 96 through which refrigerant fluid is communicated from a refrigeration system (not shown), or other such system, to suction pressure chamber 98 which is defined by fixed scroll member 56 and frame member 60.

Suction pressure refrigerant travels along suction passage 96 and enters suction chamber 98 for compression by scroll mechanism 38. As orbiting scroll member 58 is caused to orbit with respect to fixed scroll member 56, refrigerant fluid within suction chamber 98 is captured and compressed within closed pockets defined by fixed wrap 68 and orbiting wrap 76. As orbiting scroll member 58 continues to orbit, pockets of refrigerant are progressed radially inwardly towards discharge port 100. As the refrigerant pockets are progressed along scroll wraps 68 and 76 towards discharge port 100 their volumes are progressively decreased, thereby causing an increase in refrigerant pressure. This increase in pressure internal the scroll set results in an axial force which acts outwardly to separate the scroll members. If this axial separating force becomes excessive, it may cause the tips of the scroll wraps to become spatially removed from the adjacent scroll plates, resulting in leakage of compressed refrigerant from the pockets and loss of efficiency. At least one axial biasing force, discussed hereinbelow, is applied against the back of the orbiting scroll member to overcome the axial separating force within the scroll set to maintain the pockets of compression. However, should the axial biasing force become excessive, further inefficiencies will result. Accordingly, all forces which act upon the scroll set must be considered and taken into account when designing an effective compressor design which effects a sufficient, yet not excessive, axial biasing force.

Figure 9:
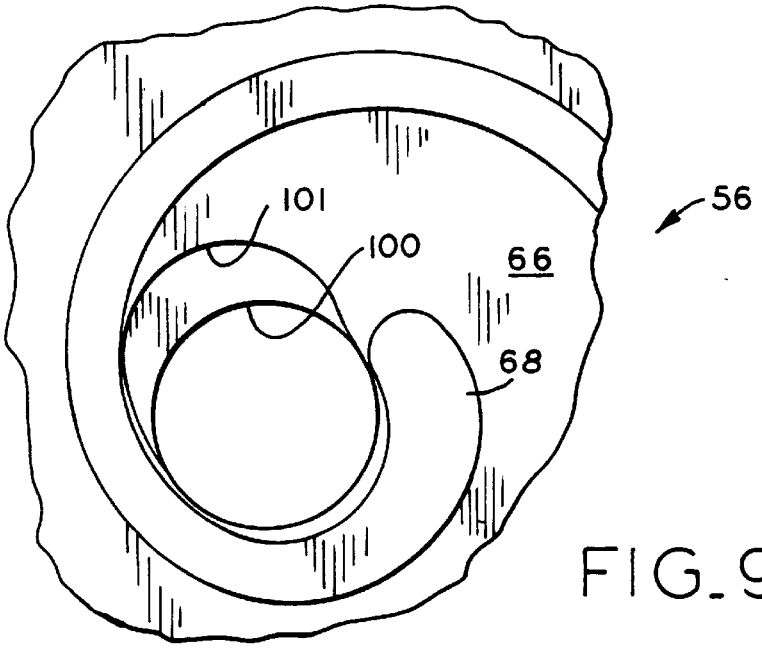
FIG. 9 is an enlarged fragmentary bottom view of the innermost position of the involute scroll wrap of the fixed scroll member of FIG. 4.
Figure 11:
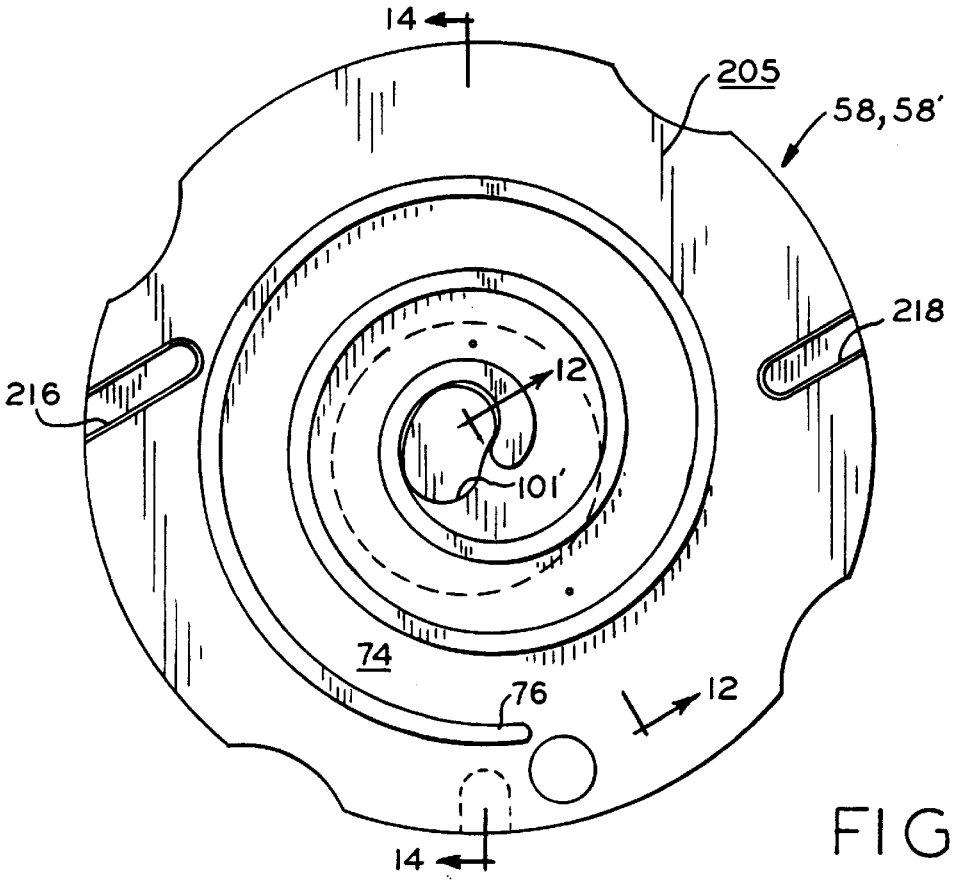
FIG. 11 is a top view of the orbiting scroll member of FIG. 10.

Upon completion of the compression cycle within the scroll set, refrigerant fluid at discharge pressure is discharged upwardly through discharge port 100, which extends through face plate 64 of fixed scroll 56, and discharge check valve assembly 102. To more readily exhaust the high pressure refrigerant from between the scroll wraps, surface 66 of fixed scroll member 56 may be provided with kidney shaped recess 101 as shown in FIG. 9, within which discharge port 100 is located. Alternatively, and for the same purpose, surface 74 of orbiting scroll member 58' may be provided with kidney shaped recess 101' as shown in FIG. 11. The refrigerant is expelled from between the scroll wraps through discharge port 100 into discharge plenum chamber 104, which is defined by the interior surface of discharge gas flow diverting mechanism 106 and top surface 108 of fixed scroll member 56. The compressed refrigerant is introduced into housing chamber 110 where it exits through discharge tube 112 (FIG. 2) into the refrigeration or air-conditioning system into which compressor 20 is incorporated.

To illustrate the relationship between the various fluids at varying pressures which occur inside compressor 20 during normal operation, we shall examine the example of the compressor in a typical refrigeration system. When refrigerant flows through a conventional refrigeration system during the normal refrigeration cycle, the fluid drawn into the compressor at suction pressure undergoes changes as the load associated with the system varies. As the load increases, the suction pressure of the entering fluid increases, and as the load decreases, the suction pressure decreases. Because the fluid which enters the scroll set, and eventually the pockets of compression formed therein, is at suction pressure, as the suction pressure varies, so varies the pressure of the fluid within the pockets of compression. Accordingly, the intermediate pressure of the refrigerant within the pockets of compression correspondingly increases and decreases with the suction pressure. The change in suction pressure results in a corresponding change in the axial separating forces within the scroll set. As the suction pressure decreases the axial separating force within the scroll set decreases and the requisite level of axial biasing force needed to maintain scroll set integrity decreases. Clearly this is a dynamic situation in which the operating envelope of the compressor may vary with the suction pressure. Because the axial compliance force is derived from the pockets of compression and therefore tracks the fluctuations in the suction pressure, an effective operating envelope for compressor 20 is maintained. The actual magnitude of the axial compliance force is in part determined by the location of aperture 85 (FIG. 12) and the volume of chamber 81.

Annular chamber 81 is defined by back surface 72 of orbiting scroll 58 and the upper surface of bearing 60. Annular chamber 81 forms an intermediate pressure cavity that is in communication, via aperture 85, with fluid contained in pockets of compression formed in the scroll set. The fluid in the pockets of compression is at a pressure intermediate discharge and suction pressures. Although, oil and/or the natural sealing properties of contact surfaces may provide sufficient sealing, in the embodiment shown, continuous seals 114 and 116, which may each be annular as shown, isolate intermediate pressure cavity 81 from radially adjacent volumes, which are respectively at suction and discharge pressure. Seal 114 is substantially longer in circumference than seal 116.

Figure 12:
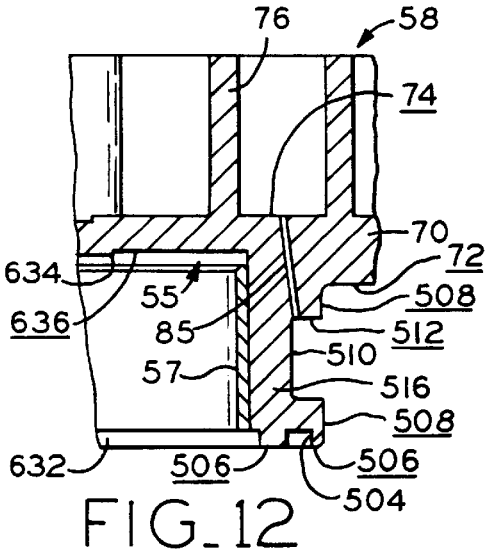
FIG. 12 is a fragmentary sectional side view of the orbiting scroll member of FIG. 10 showing the inner hub portion with an axial oil passage.
Figure 13:
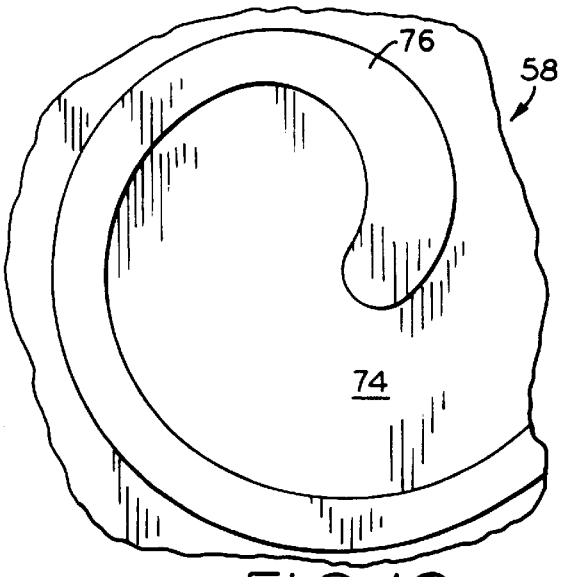
FIG. 13 is an enlarged fragmentary top view of the innermost portion of the scroll wrap of the orbiting scroll member of FIG. 10.

As shown in FIG. 12, aperture, passage or conduit 85 is provided in plate portion 70 of orbiting scroll member 58 and provides fluid communication between the pockets of compression and intermediate pressure cavity 81. Although this particular arrangement is described herein, it is by way of example only and not limitation.

Figure 3:
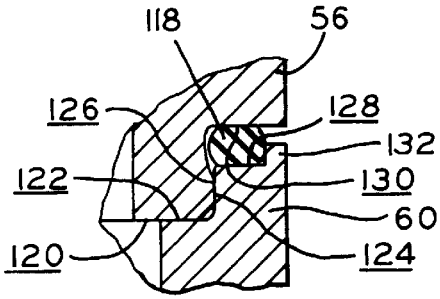
FIG. 3 is an enlarged, fragmentary sectional view of a first embodiment of a sealing structure between the fixed scroll member and the frame member of the compressor of FIG. 1.

O-ring seal 118 is provided between the fixed scroll member 56 and frame 60 which separates the discharge and suction sides of the compressor. Referring to FIG. 3, it is shown that fixed scroll member 56 and frame 60 are provided with abutting axial surfaces 120, 122, respectively. Outboard of the abutting engagement of surfaces 120, 122, radial surfaces 124, 126 of fixed scroll 56 and frame 60, respectively, are in sliding engagement. Frame 60 is provided with an axial annular surface 128 and fixed scroll 56 is provided with a stepped axial surface 130 which faces surface 128 of the frame. Frame 60 is also provided with an outer annular lip 132 which extends upwardly from surface 128 but does not extend so far as to abut surface 130 of the fixed scroll. Surfaces 126, 128, 130 and the inner surface of lip 132 define a four-sided chamber in which a conventional O-ring seal 118 is disposed. O-ring 118 is made of conventional sealing material such as, for example, EPDM rubber or the like. O-ring 118 is contacted by surfaces 128 and 130 and is squeezed therebetween, i.e., the seal provided by the above-described configuration of fixed scroll and frame surfaces and seal 118 is an axial seal. In the assembly of the fixed scroll 56 to the frame, O-ring 118 is disposed on surface 128 of the frame, held in place by lip 132, and the fixed scroll is assembled thereto. As surfaces 120, 122 are abutted, seal 118 is squeezed into its sealing configuration between surfaces 128 and 130 and, hence, the suction and discharge portions of the compressor are sealably separated.

Figure 18:
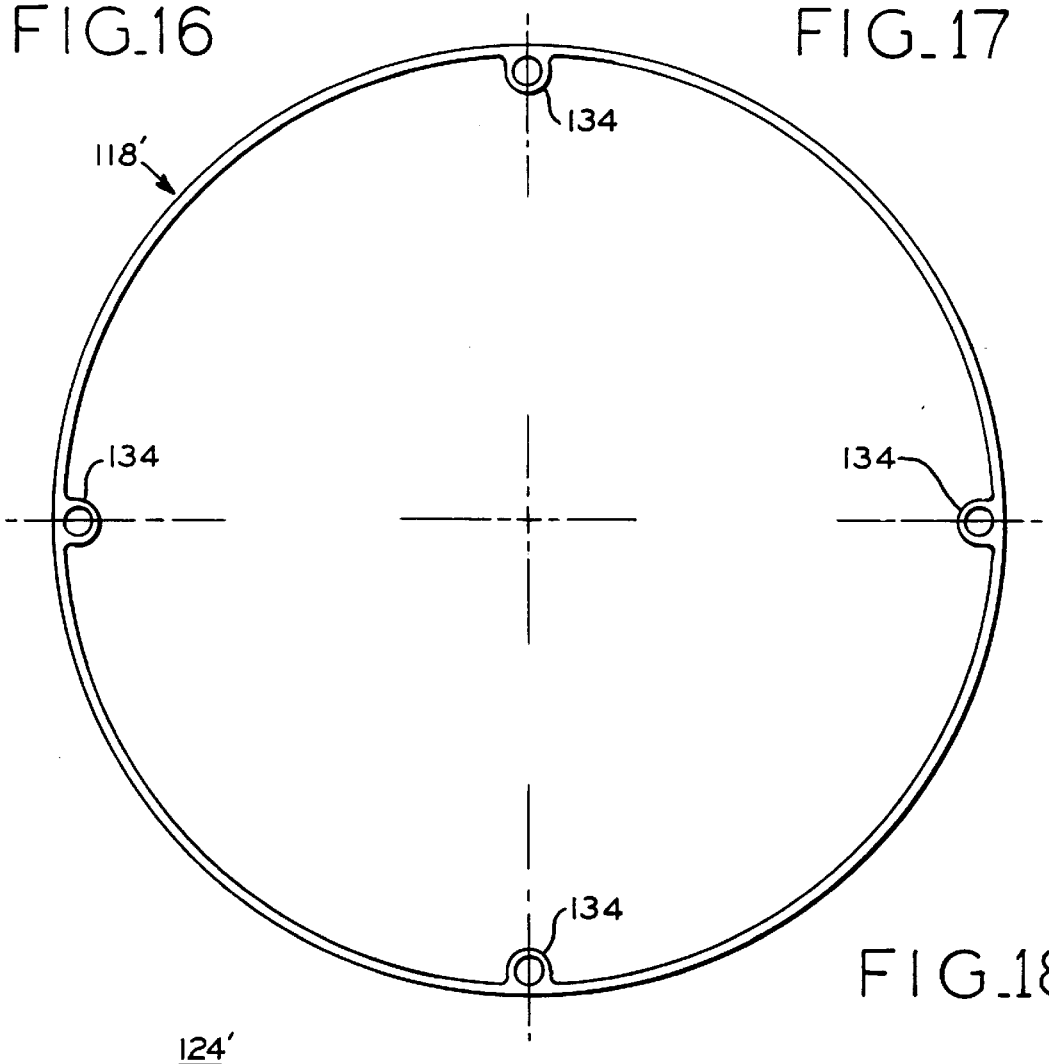
FIG. 18 is a top view of one embodiment of a one piece seal located intermediate the outer peripheries of the fixed scroll member and the main bearing or frame of a scroll compressor.
Figure 19:
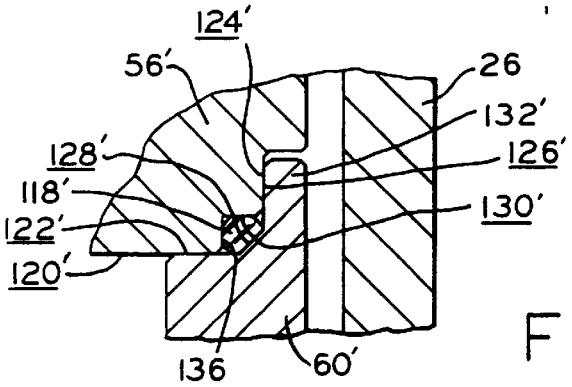
FIG. 19 is an enlarged, fragmentary sectional side view illustrating an alternative to the sealing structure embodiment depicted in FIG. 3.
Figure 20:
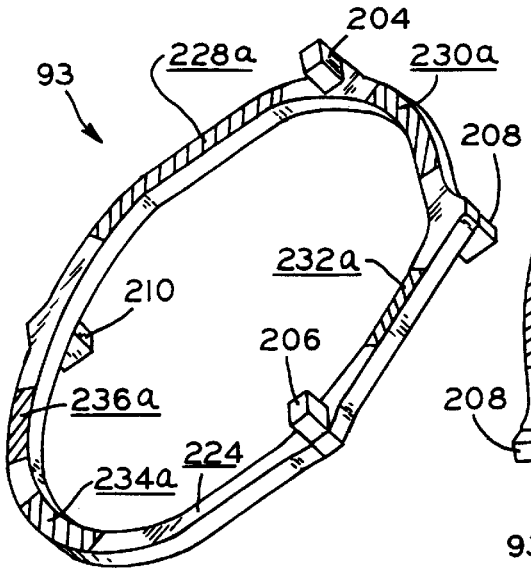
FIG. 20 is a top perspective view of a first embodiment of the Oldham ring of the scroll compressor of FIG. 1.
Figure 21:
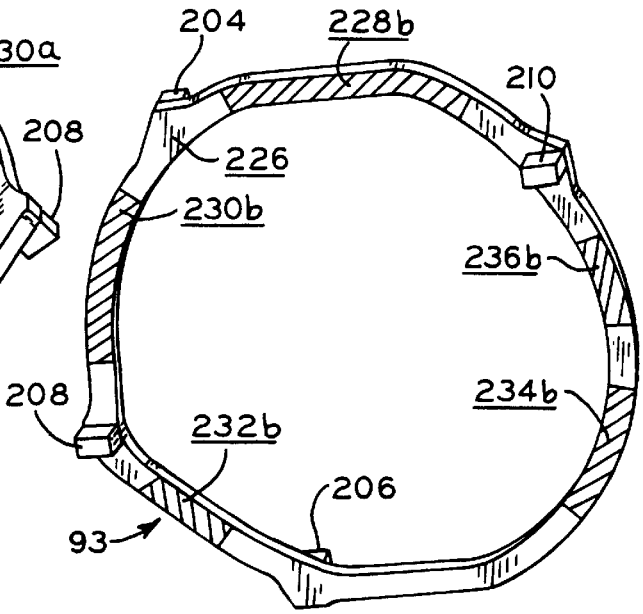
FIG. 21 is a bottom perspective view of the Oldham ring of FIG. 20.

FIG. 18 shows an alternative sealing structure comprising O-ring seal 118', which is provided with a plurality of eyelets 134 on its inside diameter and, as shown in FIG. 19, seals fixed scroll 56' and frame 60' together. The eyelets encircle bolts 62 (FIG. 1), which fasten fixed scroll 56' to frame 60'. In this alternative embodiment, fixed scroll 56' is provided with axial surface 120' which abuts axial surface 122' of frame 60'. Radial surface 124' of frame 60' slidingly engages radial surface 126' of fixed scroll 56'. Fixed scroll 56' is provided with an annular step which defines axial surface 130', and frame 60' is provided with an annular step having frustoconical surface 128'. As fixed scroll 56' is assembled to frame 60', with eyelets 134 disposed appropriately about the bolt holes in through which bolts 62 extend, O-ring 118' is brought into sealing contact with exterior radial surface 136 and annular axial surface 130' of frame 56', and with frustoconical surface 128' of frame 60'. Hence, it is shown that in the alternative sealing arrangement, the O-ring seal is in both axial and radial sealing engagement with the fixed scroll and frame.

Figure 22:
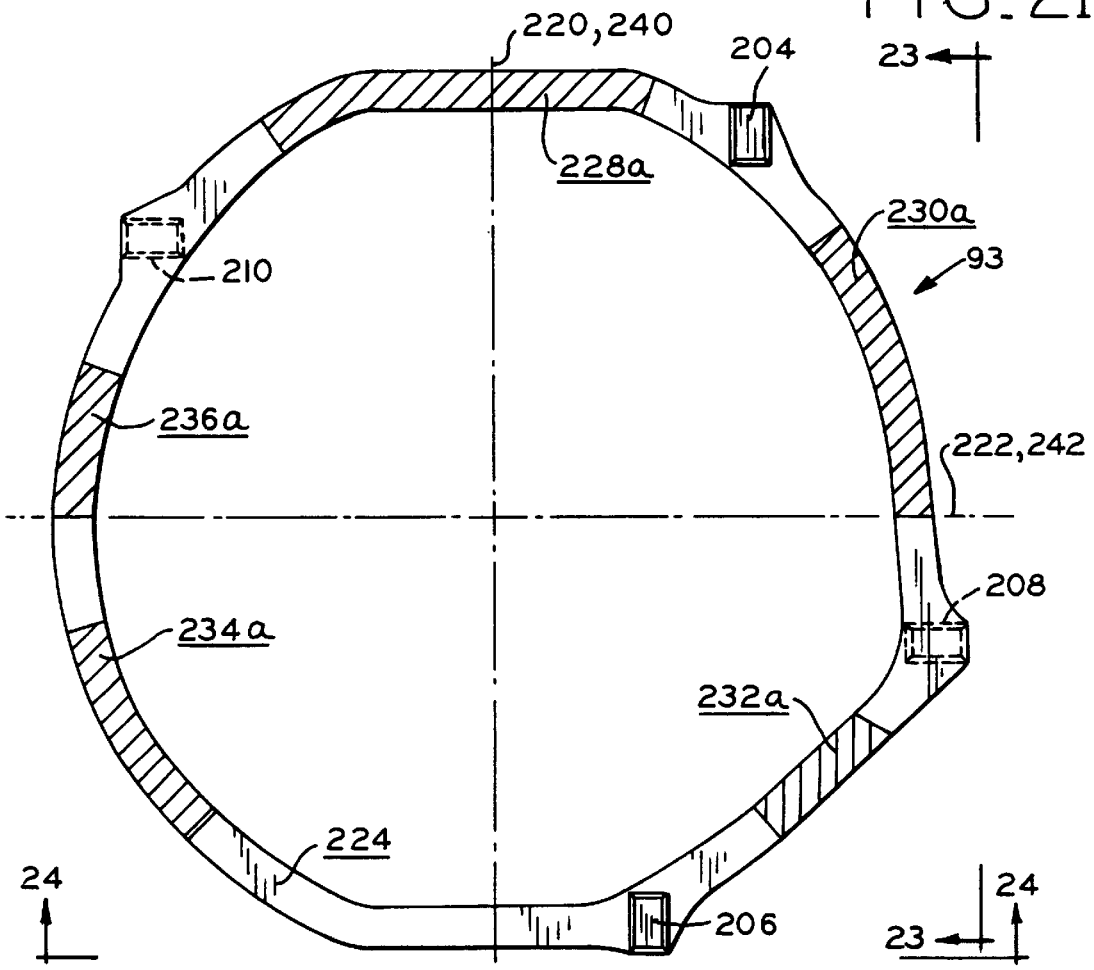
FIG. 22 is a top view of the Oldham ring of FIG. 20.
Figure 23:
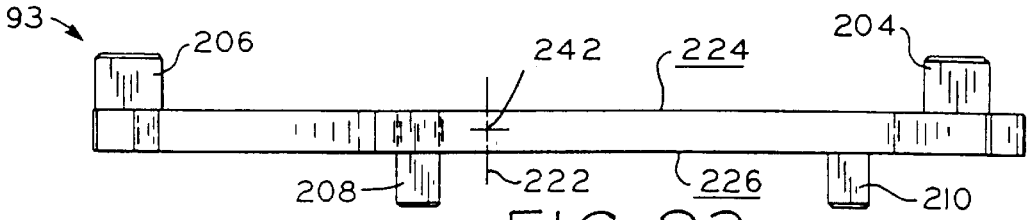
FIG. 23 is a first side view of the Oldham ring of FIG. 20.
Figure 26:
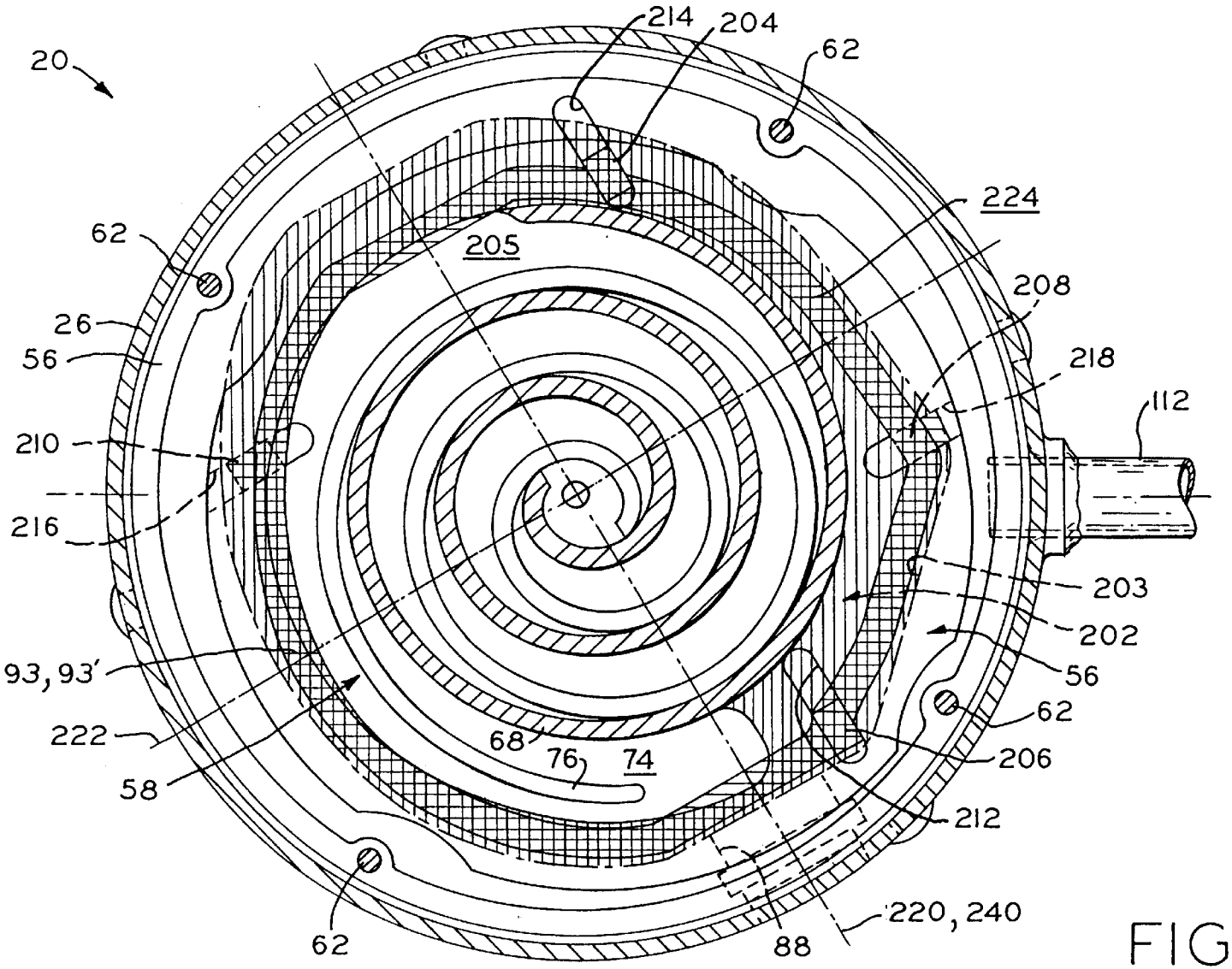
FIG. 26 is a sectional top view of the compressor assembly of FIG. 1 along line 26—26, its Oldham coupling and the fixed scroll member recess in which is disposed shown shaded.
Figure 41:
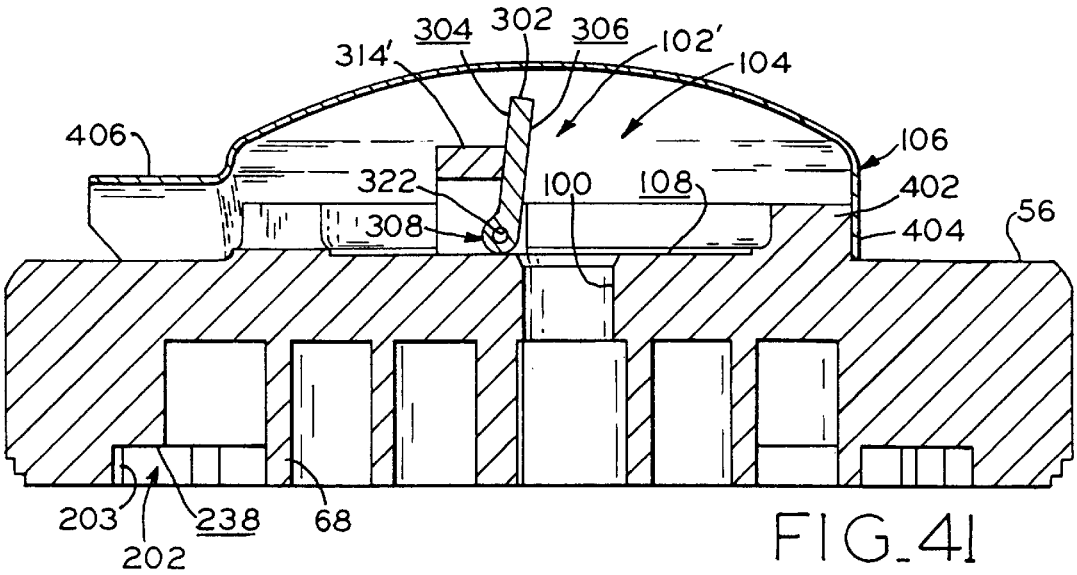
FIG. 41 is a sectional side view of the fixed scroll member of the compressor of FIG. 1 with one embodiment of a discharge check valve assembly.
Figure 42:
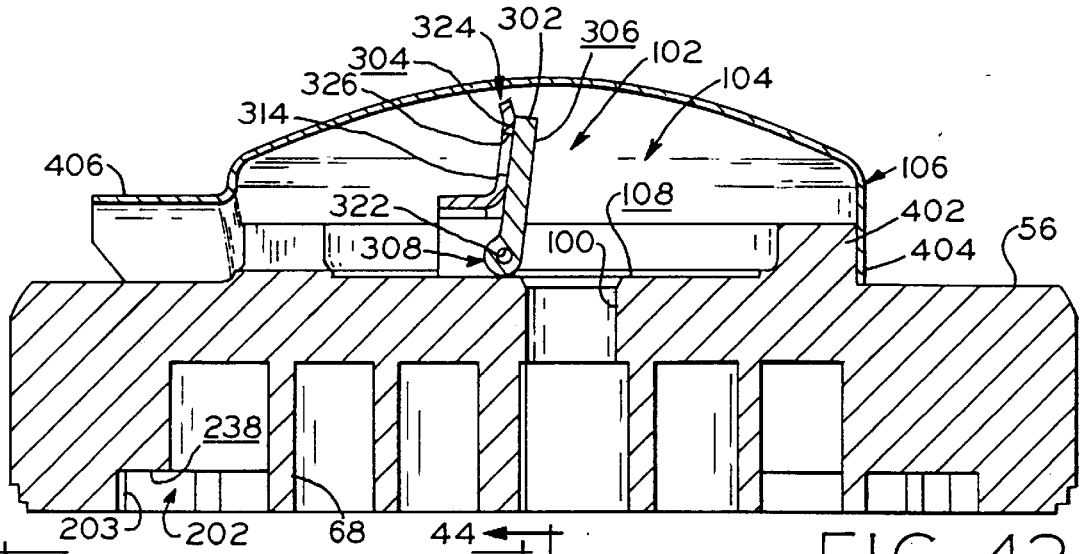
FIG. 42 is a sectional side view of the fixed scroll member of the compressor of FIG. 1 with an alternative embodiment of the discharge check valve assembly.
Figure 43:
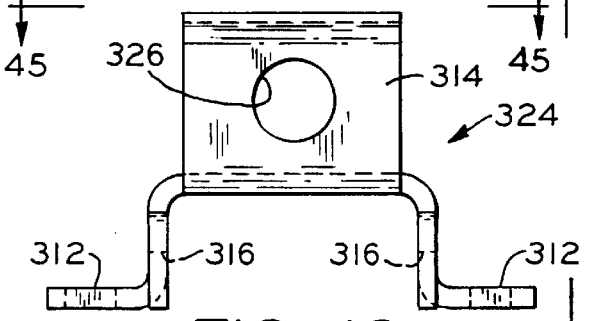
FIG. 43 is a front view of a second embodiment of a discharge valve retaining member for use in the discharge check valve assembly of the compressor of FIG. 1.
Figure 44:
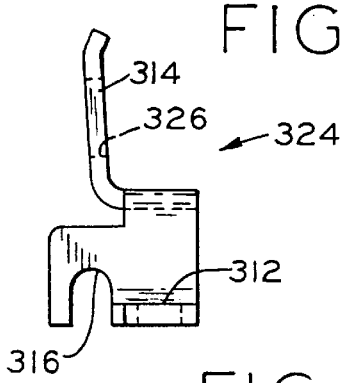
FIG. 44 is a left side view of the discharge valve retaining member of FIG. 43.
Figure 45:
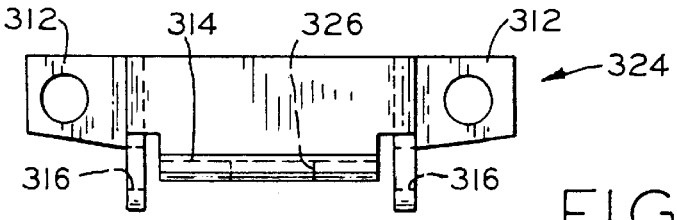
FIG. 45 is a top view of the discharge valve retaining member of FIG. 43.
Figure 91:
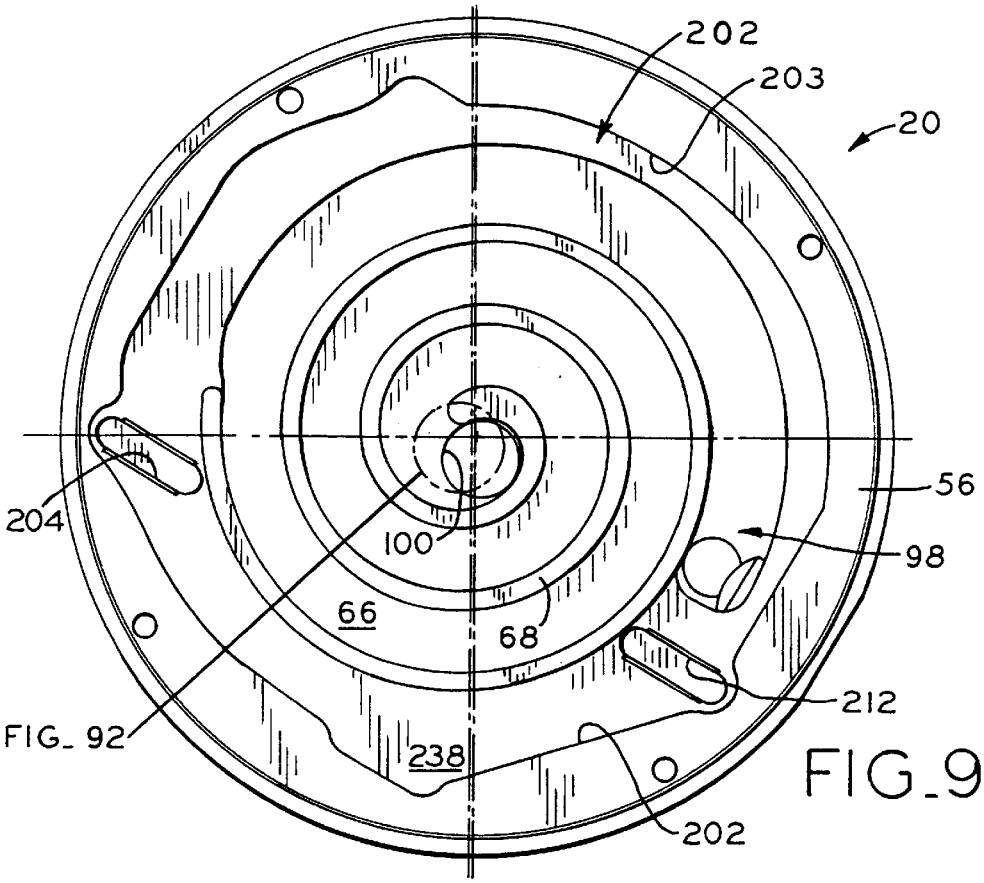
FIG. 91 is a bottom view of the compressor shown in FIG. 1, along line 91—91 thereof, showing the axial centerline of the fixed scroll member.
Figure 92:
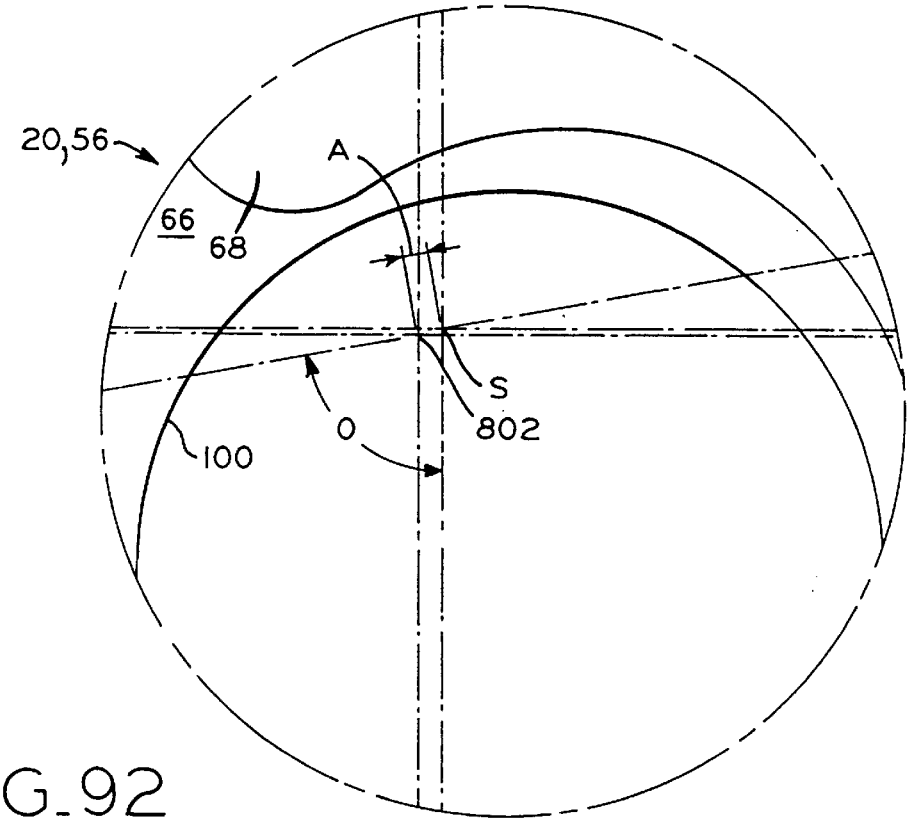
FIG. 92 is a greatly enlarged fragmentary bottom view of the compressor as shown in FIG. 91, showing the crankshaft center axis to fixed scroll centerline offset.

FIGS. 20 through 24 show one embodiment of an Oldham coupling used in compressor 20. Oldham ring 93 is disposed between fixed scroll 56 and orbiting scroll 58 and comprises two pairs of somewhat elongate tabs, 204, 206 and 208, 210, which respectively extend from opposite axial sides 224 and 226 of the Oldham coupling. Each of tabs 204, 206, 208 and 210 have a rectangular cross section and the tabs of each pair are aligned in a common direction. As seen in FIG. 22, tabs 204, 206 of one pair are aligned in a direction that is generally perpendicular to the direction in which tabs 208, 210 of the other pair are aligned. Referring to FIG. 26, Oldham coupling 93 is disposed in recessed portion 202 of fixed scroll 56. In FIG. 26, recessed portion 202 and Oldham coupling 93 are both shown shaded by perpendicularly oriented lines; overlapping portions of recessed portion 202 and Oldham coupling 93 are thus shaded by a checked pattern formed by their respective, superimposed shading lines. FIGS. 41, 42 and 91 also show recess 202 of fixed scroll 56. As also shown in FIG. 26, fixed scroll 56 is provided with, on approximately opposite radial sides, elongated recesses or slots 212 and 214 in which Oldham coupling tabs 204 and 206 are slidably disposed. Also as shown in FIG. 26, elongate slots 212 and 214 extend in a direction parallel to plane 220, along which suction tube counterbore 88 is directed. Plane 220 is generally perpendicular to plane 222, which is the plane in which orbiting scroll 58 tips at its largest tipping moment. As seen in FIG. 26, orbiting scroll 58 is provided with a pair of elongated recesses or slots 216, 218 in which tabs 208 and 210 are slidably received. It can be readily understood that orbiting scroll 58 is keyed to fixed scroll 56 by Oldham coupling 93 such that it does not rotate relative thereto. Rather, orbiting scroll 58 eccentrically orbits relative to fixed scroll 56, its orbiting motion guided by tabs 204, 206, 208 and 210 which slide within recesses 212, 214, 216, and 218. It will be noted in FIG. 26 that as tabs 204 and 206 respectively assume a position at one end of their respective slots 212 and 214 (the shown position), the outer circumferential surface of Oldham coupling 93 on the side of plane 222 on which suction port 88 is located (lower right-hand side of FIG. 26), conforms very closely to the adjacent, radially interior wall 203 of recess 202. Similarly, as tabs 204 and 206 respectively assume a position at the opposite end of their respective slots 212 and 214 (position not shown), the outer circumferential surface of Oldham coupling 93 on the side of plane 222 opposite that on which suction port 88 is located (upper left-hand side of FIG. 26), conforms very closely to the adjacent, radially interior wall 203 of recess 202. Thus, it will be understood by those skilled in the art that recess 202 is closely sized to accommodate the reciprocating movement of Oldham coupling 93 along axis 240, which lies in plane 220. The space necessary to accommodate Oldham coupling 93 is thereby minimized.

Referring again to FIGS. 20 through 24, it can be seen that each of opposite axial sides 224 and 226 of Oldham ring 93 is provided with pad surfaces 228 through 236. Pad surfaces 228*a*, 232*a*, 234*a* and 236*a* are disposed on side 224; on opposite side 226 of Oldham ring 93, directly below and matching the shapes of the pad surfaces on side 224, are corresponding surfaces 228*b*, 230*b*, 232*b*, 234*b* and 236*b*. In each of FIGS. 20 through 25, the pad surfaces are shown shaded or cross hatched to clarify their general shape and position. FIG. 25 shows alternative Oldham ring 93' which is substantially identical to Oldham ring 93 except that it is prepared by a sintered powder metal process rather than a metal machining process. It can be seen the primary distinction of Oldham ring 93' is that the material area surrounding each of the tabs is slightly enlarged.

As shown in FIG. 1, it can be seen that Oldham ring 93, 93' is disposed between fixed scroll member 56 and orbiting scroll member 58. Also, surface 74 of orbiting scroll member 58 has an outlying, peripheral surface portion 205, which lies outside of its scroll wrap 76, and which faces lower side 226 of Oldham ring 93, 93'. Similarly, recessed area 202 of fixed scroll 56 has downwardly facing surface 238 (FIG. 91) which faces upper side 224 of Oldham ring 93, 93'. Pads 228 through 236 on opposite sides of Oldham ring 93, 93' slidingly contact surfaces 205 and 238. Referring to FIGS. 22 and 25, pad surfaces 228*a* and 228*b* have portions which lie on opposite sides of plane 220.

Figure 24:
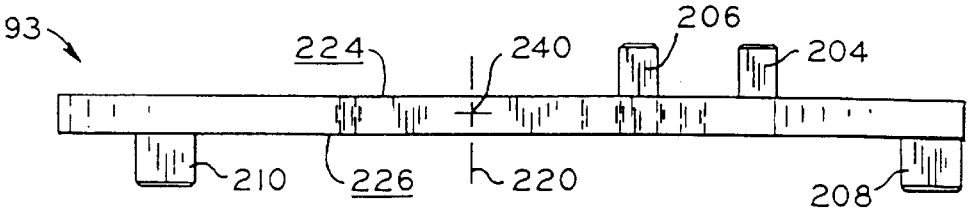
FIG. 24 is a second side view of the Oldham ring of FIG. 20.
Figure 25:
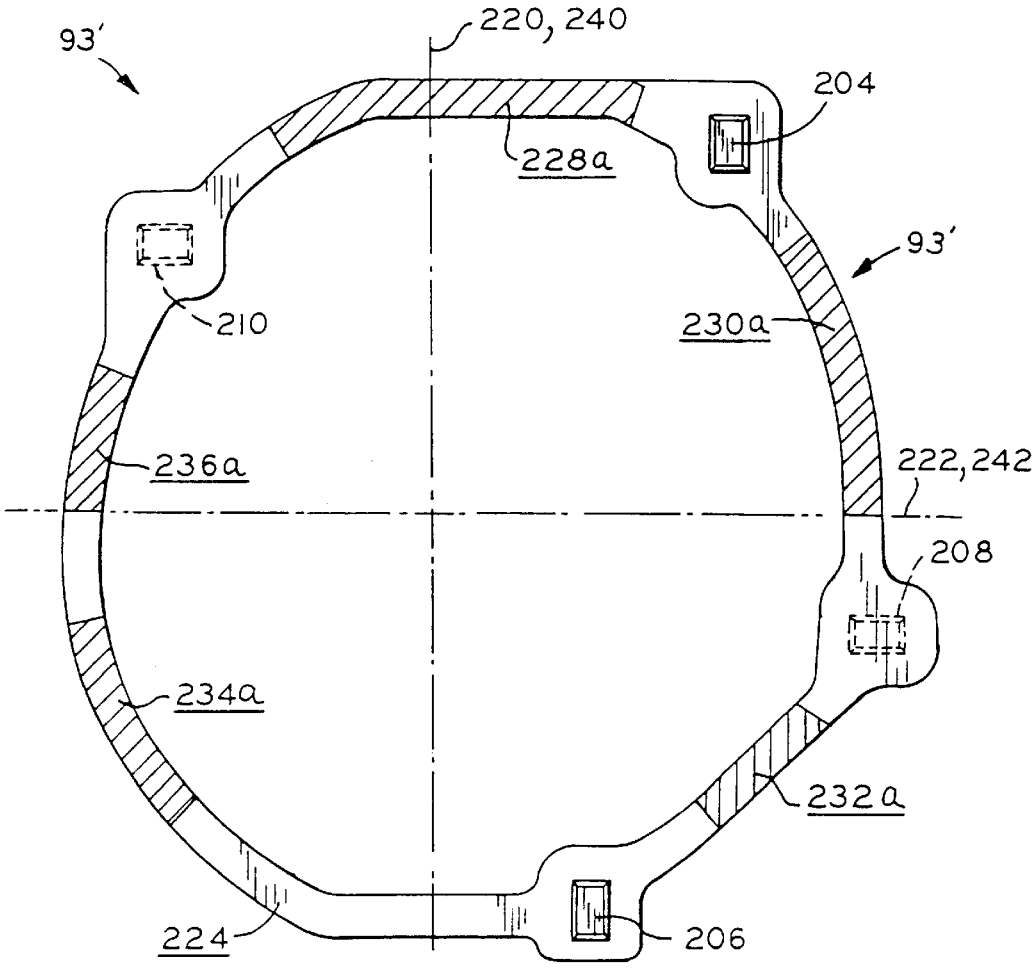
FIG. 25 is a top view of a second embodiment of the Oldham ring of the scroll compressor of FIG. 1.

FIGS. 22, 24 and 25 show axis 240 which extends centrally through the thickness of Oldham coupling 93, 93', and which lies in plane 220. During compressor operation, orbiting scroll member 58 tends to tip in plane 222, about an axis in plane 220 which is parallel with axis 240. As orbiting scroll 58 tips in plane 222, outlying portion 205 of surface 74 will be alternatingly urged into contact with pad surface portions on side 226 of Oldham ring 93, 93' on only opposite sides of plane 220. Referring to FIGS. 1, 22, 24 and 25, as orbiting scroll member 58 tips in plane 222 in a clockwise direction as viewed in FIG. 24 about an axis generally parallel to axis 240 and proximal plane 220, a portion of surface portion 205 is swung upward and into abutting contact with Oldham ring 93, 93' abutting pads 234*b* and 236*b* and a portion of 228*b*. This action urges opposite side pad surfaces 234*a* and 236*a* and a portion of 228*a* (all on the left hand side of plane 220 in FIGS. 22, 25) into abutting contact with the adjacent portion axial surface 238 in fixed scroll recessed area 202. Conversely, as orbiting scroll member 58 tips in plane 222, in a counterclockwise direction as viewed in FIG. 24 about an axis generally parallel to axis 240 and proximal plane 220, the radially opposite portion of surface portion 205 is swung upward and into abutting contact with the Oldham coupling, abutting pads 230*b*, 232*b* and a portion of 228*b*. This action urges opposite side pad surfaces 230*a* and 232*a* and a portion of 228*a* (all on the right hand side of plane 220 in FIGS. 22, 25) into abutting contact with the adjacent portion axial surface 238 in fixed scroll recess 202. The tipping of orbiting scroll 58 in plane 222 oscillates between the above-described clockwise and counterclockwise motions during compressor operation. Thus it can be seen that the travel of Oldham coupling 93, 93' is aligned to support surface 205 of the orbiting scroll member and prevent its tipping. As will be understood with reference to FIG. 26, surface 205 of the orbiting scroll member is supported by the Oldham coupling at locations which oppose the maximum values of the oscillating tipping moments on the orbiting scroll, thereby preventing wobbling of the orbiting scroll member.

Upon compressor shutdown, orbiting scroll member 58 is no longer orbitally driven by motor 32 and crankshaft 34 and is free to move in response to gas pressures acting thereon, including the pressure differential between discharge port 100 and suction port 88. Further, upon compressor shutdown, a pressure differential which exists between the fluid contained in the discharge chamber and the fluid contained in the scroll set, which is at a pressure lower than that contained in the discharge chamber. As the two volumes seek pressure equilibrium, a reverse flow of fluid refrigerant from the discharge chamber back into the scroll set. Unimpeded, this pressure differential acts upon orbiting scroll member 58 so as to cause it to orbit in a reverse manner with respect to fixed scroll member 56. Such reverse orbiting results in refrigerant flowing into discharge port 100 in a reverse direction and exiting through suction port 88 into the refrigerant system. This problem of reverse scroll rotation during compressor shutdown has long been associated with scroll compressors. Valve assembly 102 is provided to alleviate this problem by using the fluid flowing from the discharge chamber into the scroll set to act on the discharge check valve so as to quickly move the check valve to a closed position covering the discharge port. In this manner, reverse orbiting is prevented and more gradual equilibrium may be achieved.

Figure 27:
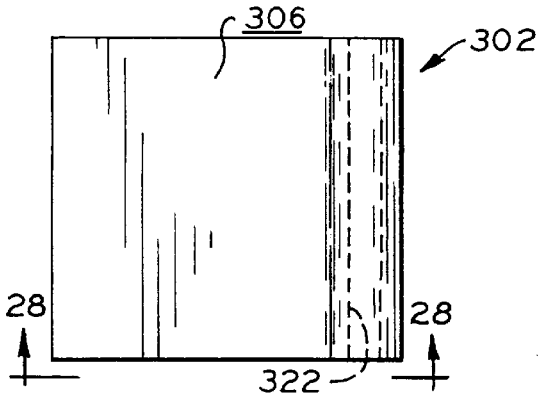
FIG. 27 is a top view of a first embodiment of a discharge valve member for use in the discharge check valve assembly of the scroll compressor of FIG. 1.
Figure 28:
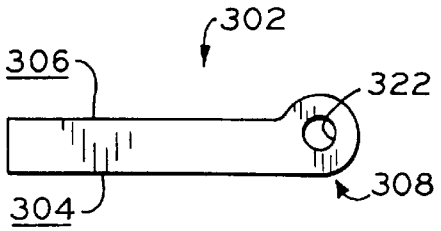
FIG. 28 is a left side view of the discharge valve member of FIG. 27.
Figure 29:
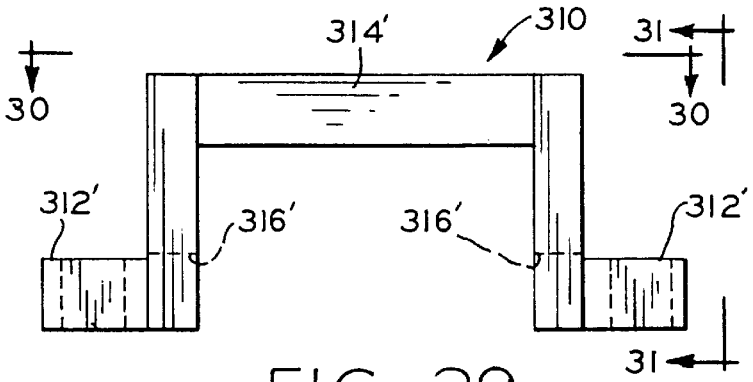
FIG. 29 is a front view of a first embodiment of a discharge valve retaining member for use in the discharge check valve assembly of the compressor of FIG. 1.
Figure 31:
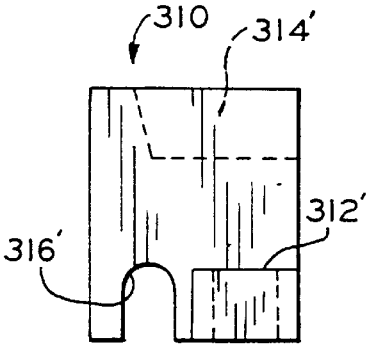
FIG. 31 is a left side view of the discharge valve retaining member of FIG. 29.
Figure 30:
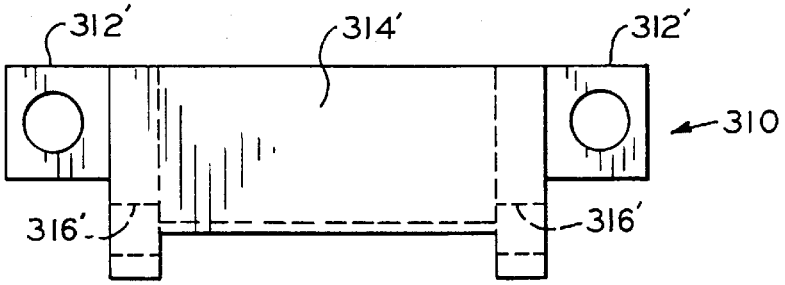
FIG. 30 is a top view of the discharge valve retaining member of FIG. 29.
Figure 32:
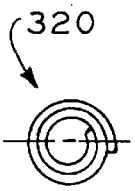
FIG. 32 is an end view of a roll spring pin used in one embodiment of the discharge check valve assembly.
Figure 33:
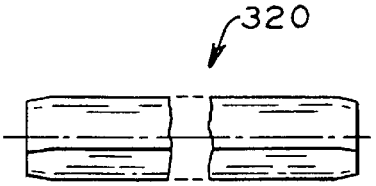
FIG. 33 is a front view of the roll spring pin of FIG. 32.
Figure 34:
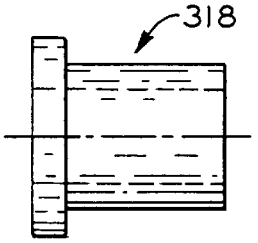
FIG. 34 is a side view of a bushing for use in said one embodiment of the discharge check valve assembly.
Figure 35:
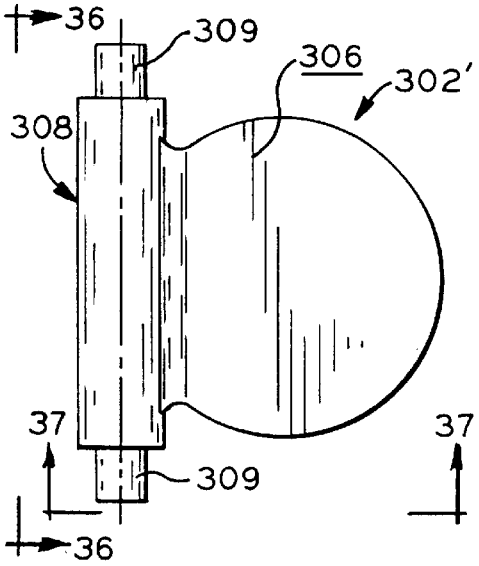
FIG. 35 is a top view of a second embodiment of a discharge valve member for use with the discharge check valve assembly.
Figure 36:
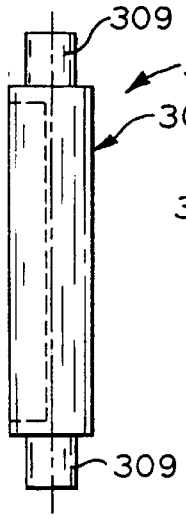
FIG. 36 is a rear view of the discharge valve member of FIG. 35.
Figure 37:
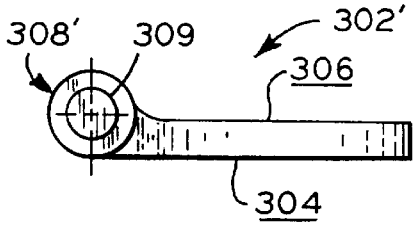
FIG. 37 is a right side view of the discharge valve member of FIG. 35.
Figure 38:
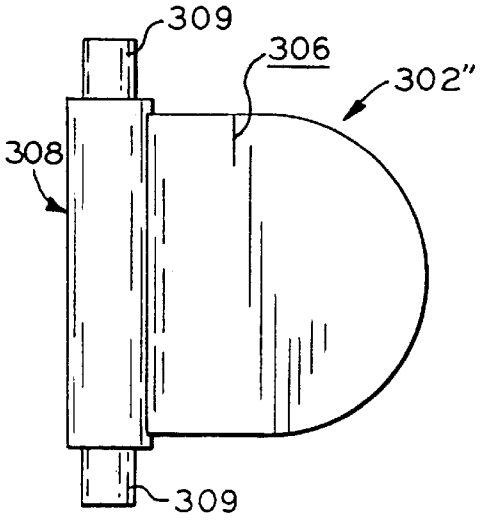
FIG. 38 is a top view of a third embodiment of a discharge valve member for use in the discharge check valve assembly.
Figure 39:
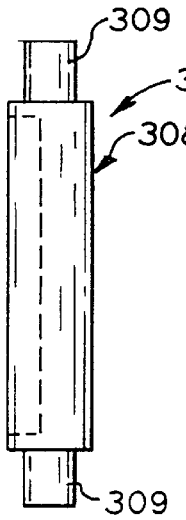
FIG. 39 is a rear view of the discharge valve member of FIG. 38.
Figure 40:
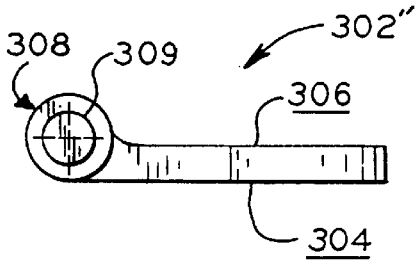
FIG. 40 is a right side view of the discharge valve member of FIG. 38.

Shown in FIGS. 1 and 27–45 are various components and embodiments of discharge check valve assemblies 102, 102' which may be used with compressor 20. Each of these embodiments comprises a lightweight plastic or metallic pivoting valve that is positioned adjacent to and directly over discharge port 100 provided in fixed scroll member 56 and is held in place by valve retaining member 310 or 324. Alternative valve members 302, 302' and 302" are shown in FIGS. 27, 28; 35–37; 38–40, respectively. The valve member may be provided with either of pivot ears 309 or a bore 322 for receiving a roll spring pin 320, on which are provided bushings 318. Ears 309 or bushings 318 are received in bushing recesses 318, 318' in the valve retaining member.

With the compressor in operation, refrigerant fluid at suction pressure is introduced through suction tube 86, which is sealingly received into counterbore 88 provided in fixed scroll member 56 and is communicated into suction pressure chamber 98 which is defined by fixed scroll member 56 and frame member 60. The suction pressure refrigerant is compressed by scroll mechanism 38. As orbiting scroll member 58 is caused to orbit with respect to fixed scroll member 56, refrigerant fluid within suction chamber 98 is compressed between fixed wrap 68 and orbiting wrap 76 and conveyed radially inwards towards discharge port 100 in pockets of progressively decreasing volume, thereby causing an increase in refrigerant pressure.

Refrigerant fluid at discharge pressure is discharged upwardly through discharge port 100 and exerts an opening force against rear face 306 of valve member 302, 302', 302", causing it to move to or remain in an open position. The refrigerant is expelled into discharge plenum or chamber 104 as defined by discharge gas flow diverting mechanism 106 and top surface 108 of fixed scroll member 56. From the discharge gas flow diverting mechanism the compressed refrigerant is introduced into housing chamber 110 where it exits through discharge tube 112 into a refrigeration system in which compressor 20 is incorporated.

Discharge check valve assembly 102, 102' prevents the reverse flow of refrigerant upon compressor shutdown, thereby preventing the reverse orbiting of scroll mechanism 38. Referring to FIGS. 42–45, check valve assembly 102 comprises rectangular valve member 302 having front face 304, rear face 306, and pivot portion 308, valve member retaining member 324, bushings 318, and spring pin 320. Rear face 306 faces and preferably has an area greater than discharge port 100. Pin 320 extends through hole 322 in pivot portion 308 and is fitted with bushings 318 on opposite sides of valve member 302, with the radial flanges of bushings 318 adjacent the valve member. Bushings 318 are rotatably disposed in two opposite-side bushing recesses 316 of member 324. During compressor operation, refrigerant acts upon front and rear faces 304 and 306, thereby causing valve member 302 to pivot relative to member 324, which is fixed relative to fixed scroll member 56. Valve retaining member 324 mounts over and around the valve member and includes two mounting extensions 312, which may be secured to the fixed scroll member such as by bolts. In assembly, spring pin 320 is received in bore 322 of valve member 302 and bushings 318 are attached at the ends of the pin. Valve retaining member is positioned over the valve member with the two bushings being received in the two recesses and the two mounting extensions positioned adjacent mounting bores provided in the upper surface of fixed scroll member 56. The valve assembly is then secured to the fixed scroll by two mounting bolts or the like. Valve members 302' (FIGS. 35–37) and 302" (FIGS. 38–40) have integral bushings or ears 309 and no spring pin; each may be used with retaining member 310 or 324 as described above.

Valve 302 is urged against valve stop 314, 314' by the force of discharge refrigerant acting on rear face 306. Notably, valve 302 is not bistable, and would tend to return, under the influence of gravity, to its closed position if the discharge refrigerant force acting on rear face 306 were removed. During compressor shutdown, refrigerant in the discharge pressure housing chamber 110 of the compressor moves towards the suction pressure chamber 98 through discharge port 100. With relief hole 326 provided in valve stop 314, refrigerant travels through stop 314 and acts against the large surface area of front face 304 of valve member 302, causing it to quickly pivot towards the discharge port and engage the surrounding surface 108 of fixed scroll member 56 such that front face 304 covers and substantially seals the opening of discharge port 100. Relief hole 326 also prevents "stiction", which tends to cause the valve member to stick to the stop, which may occur during compressor operation. In this manner refrigerant is prevented from flowing in a reverse direction from discharge pressure housing chamber 110 to suction chamber 98 and through suction passage 96. A discharge check valve employing valve retainer member 310 functions in a similar manner, which stop 314' providing a large area of valve front face 304 exposed to reversely-flowing discharge gases on compressor shut-down. The fuller interface of face 304 with stop 314 vis-a-vis stop 314' is expected to provide better valve wear.

With housing chamber 110 effectively sealed off from suction chamber 98 the pressure differential is effectively eliminated thereby preventing reverse orbiting of orbit scroll member 58. The pressurized refrigerant contained within scroll compression chambers between the interleaved scroll wraps acts upon scroll mechanism 38 to cause the wraps of orbiting scroll member 58 to radially separate from the wraps of fixed scroll member 56. With scroll members 56 and 58 no longer sealed with one another, the refrigerant contained therein is permitted to leak through scroll member wraps 68 and 76 and the pressure within scroll mechanism 38 reaches equilibrium.

During normal scroll compressor operation, discharge pressure refrigerant is discharged through the discharge port causing the discharge check valve to move to an open position. A biasing spring (not shown) may be provided to prevent cycling of the discharge check valve and resulting chatter due to pressure pulsations which occur during compressor operation.

Figure 5:
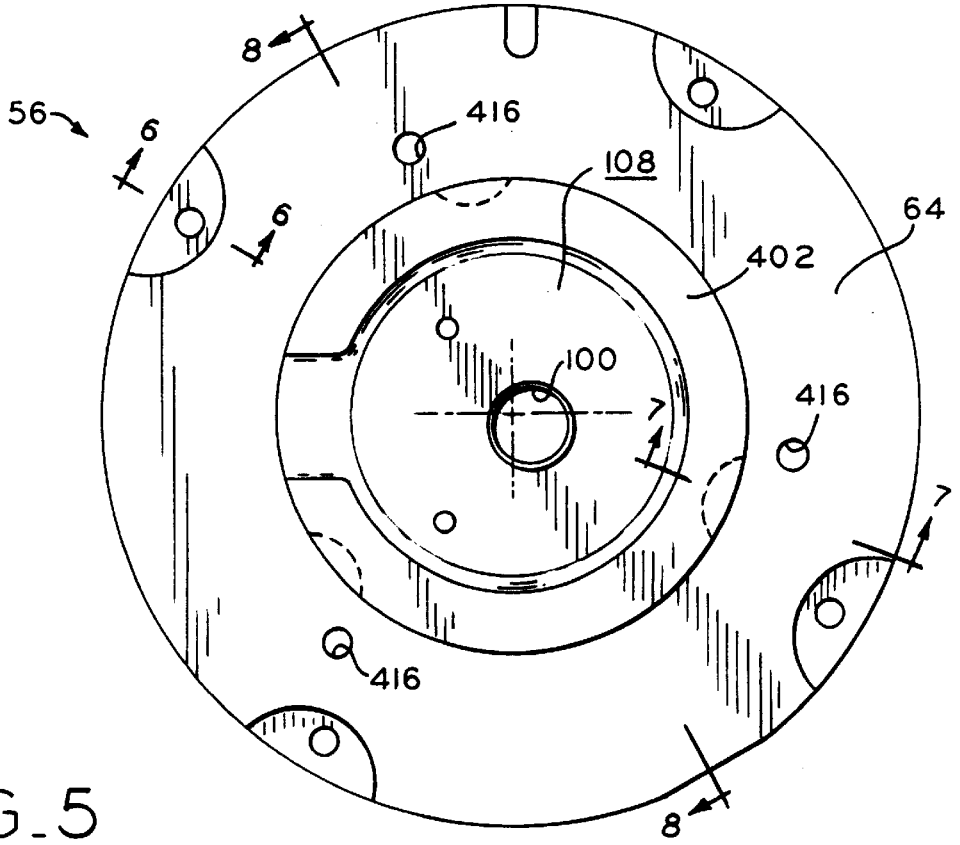
FIG. 5 is a top view of the fixed scroll member of FIG. 4.
Figure 6:
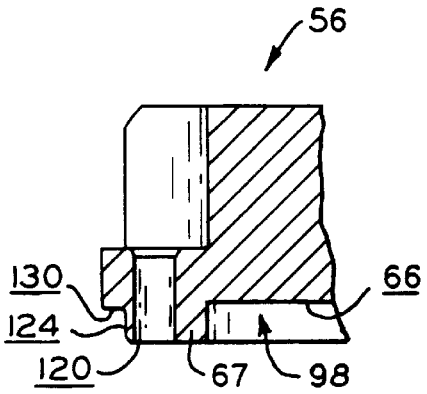
FIG. 6 is a fragmentary sectional view showing the mounting feature of the fixed scroll member of FIG. 4.
Figure 7:
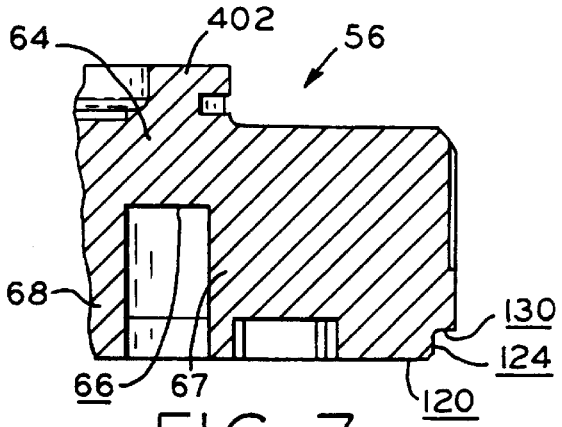
FIG. 7 is a fragmentary sectional view of the fixed scroll member of FIG. 4.
Figure 46:
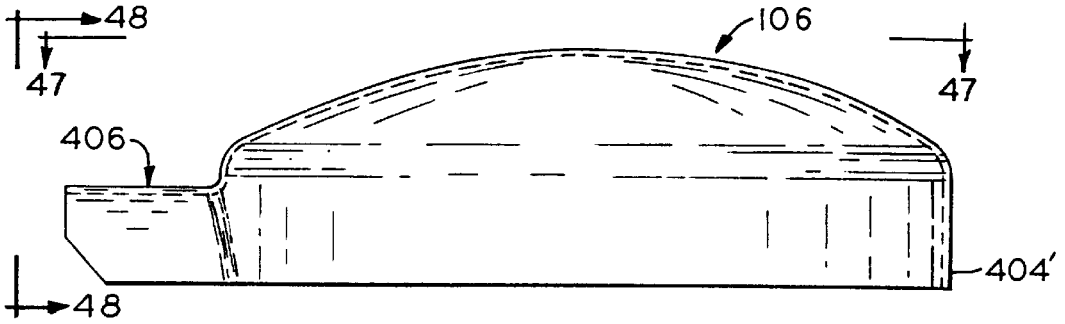
FIG. 46 is a side view of a first embodiment of a discharge gas flow diverting mechanism.
Figure 47:
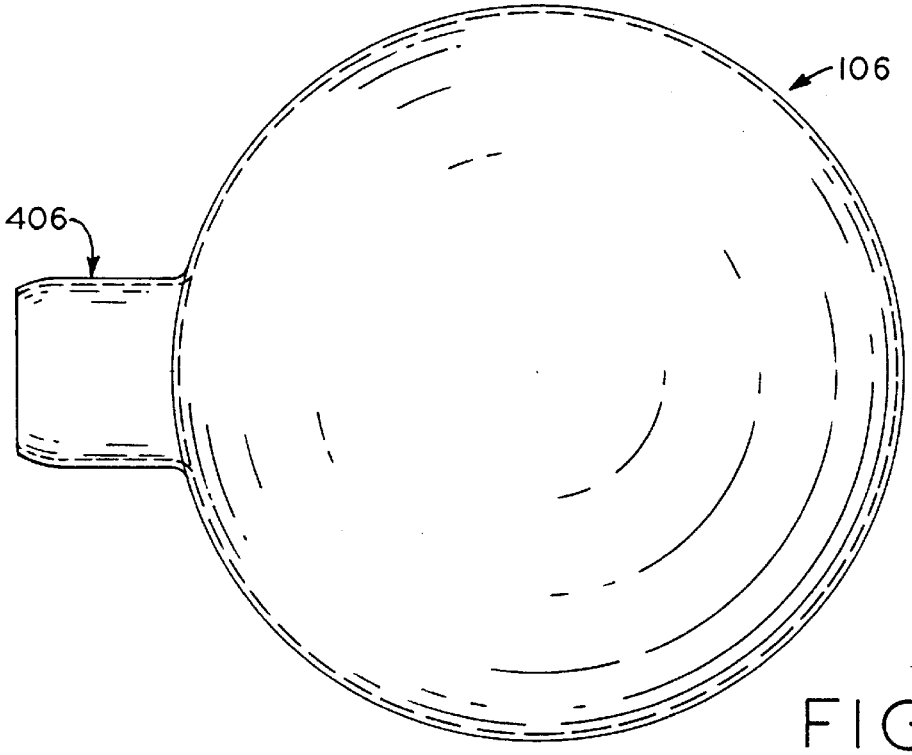
FIG. 47 is a top view of the discharge gas flow diverting mechanism of FIG. 46.
Figure 48:
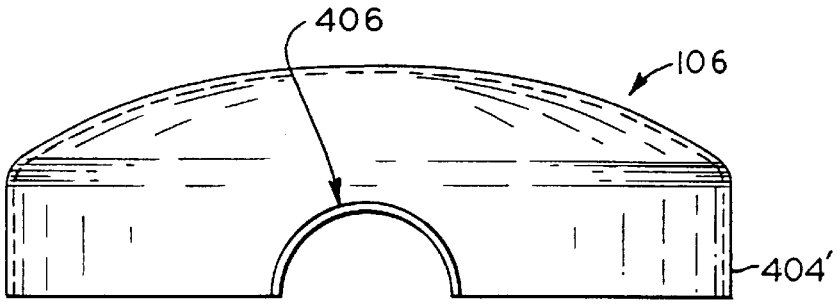
FIG. 48 is a front view of the discharge gas flow diverting mechanism of FIG. 46.
Figure 49:
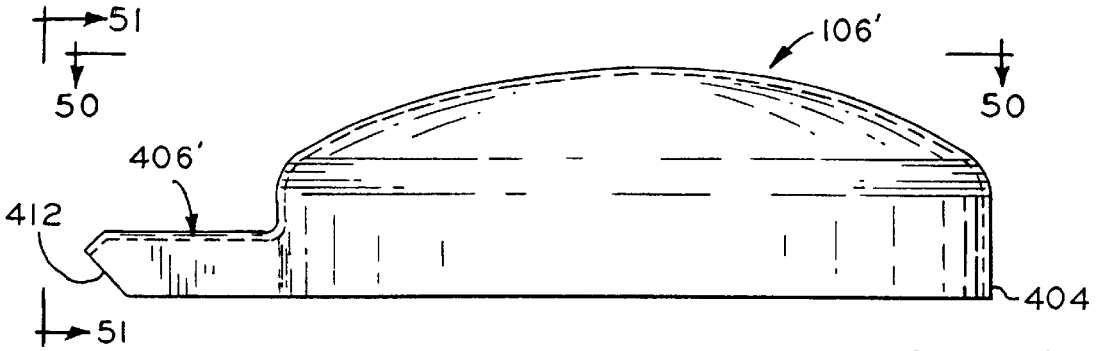
FIG. 49 is a side view of a second embodiment of a discharge gas flow diverting mechanism.
Figure 50:
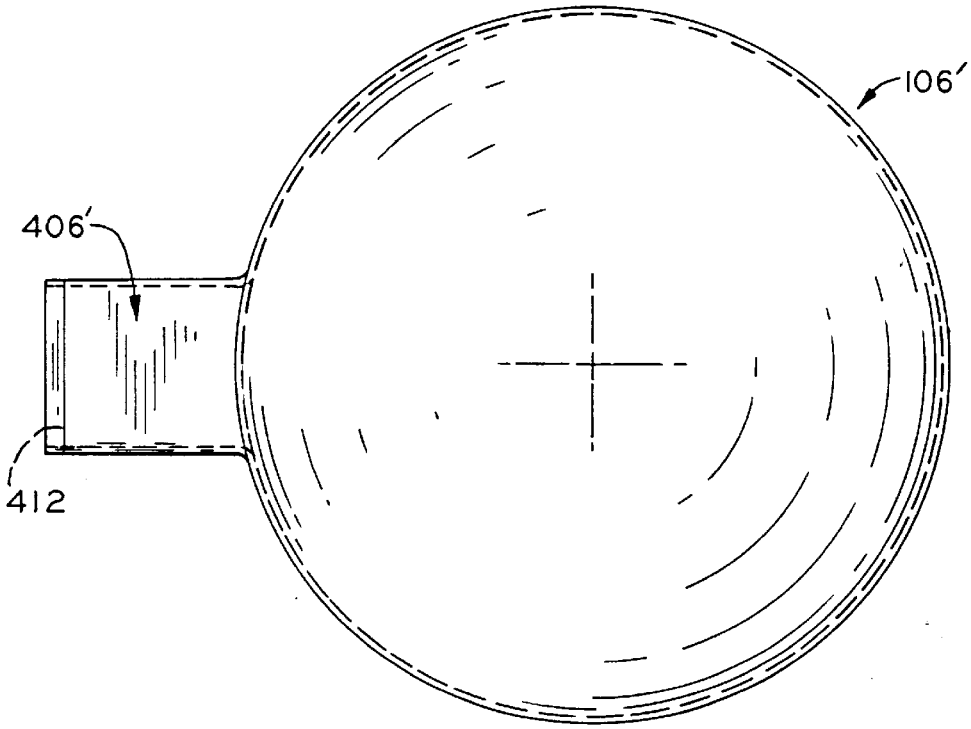
FIG. 50 is a top view of the discharge gas flow diverting mechanism of FIG. 49.
Figure 51:
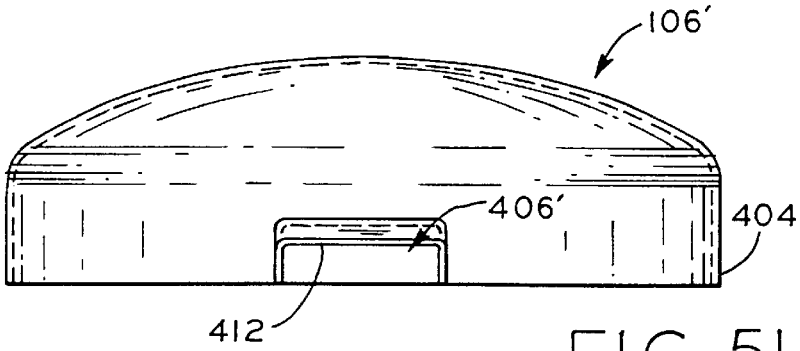
FIG. 51 is a front view of the discharge gas flow diverting mechanism of FIG. 49.
Figure 52:
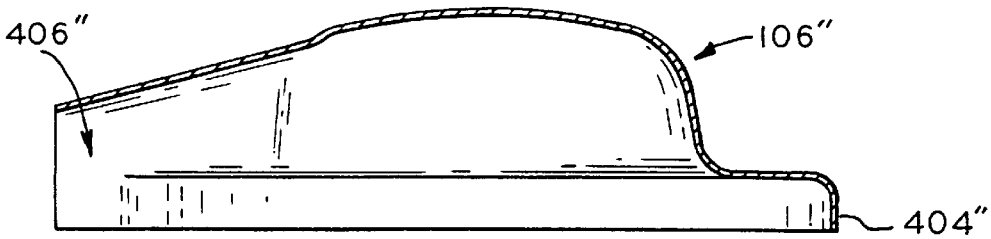
FIG. 52 is a side view of a third embodiment of a discharge gas flow diverting mechanism.
Figure 53:
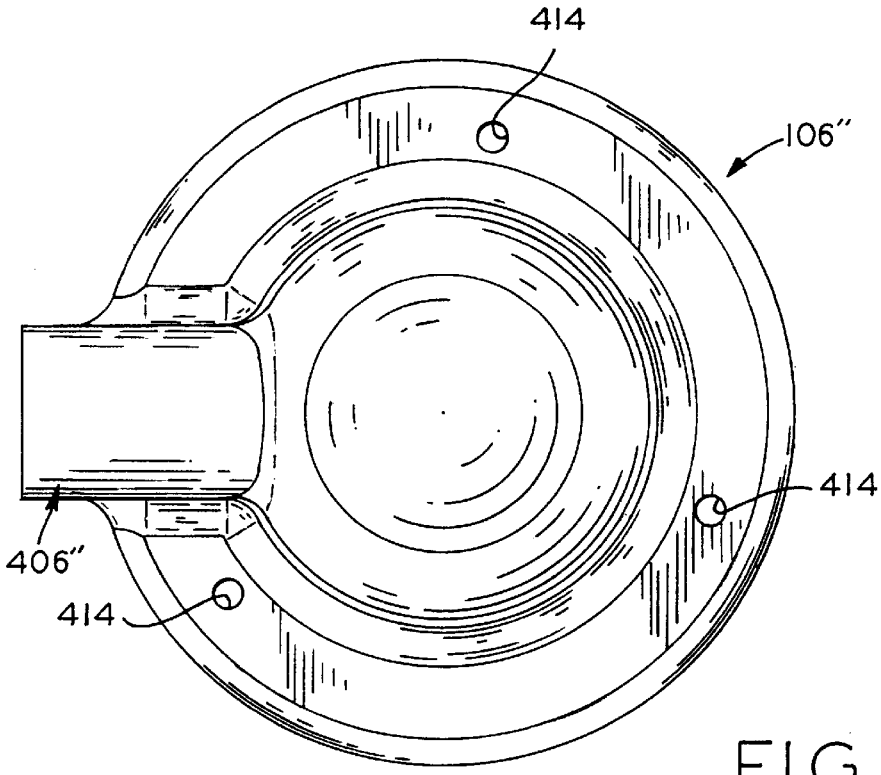
FIG. 53 is a top view of the discharge gas flow diverting mechanism of FIG. 52.
Figure 54:
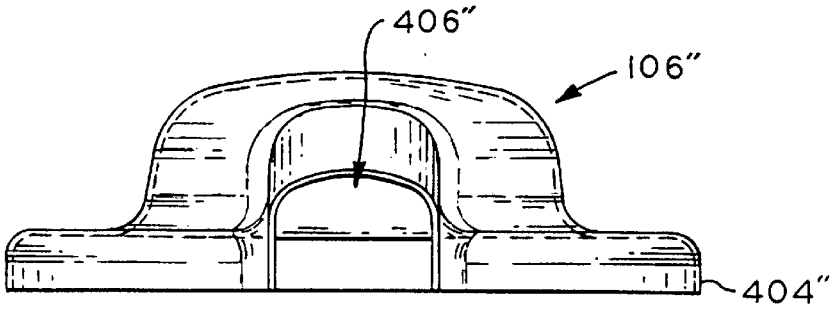
FIG. 54 is a front view of the discharge gas flow diverting mechanism of FIG. 52.

As shown in FIG. 1, discharge gas flow diverting mechanism 106 is attached to fixed scroll member 56 and surrounds annular protuberance 402 of the fixed scroll member. FIGS. 46, 47, and 48 illustrate a first embodiment of the discharge gas flow diverting mechanism. FIGS. 49, 50, and 51 illustrate a second embodiment of the gas flow diverting mechanism. FIGS. 52, 53, and 54 illustrate a third embodiment of the gas flow diverting mechanism. The gas flow diverting mechanism may be attached to the fixed scroll member as by crimping the whole or portions of lower circumference 404 into an annular recess provided in annular protuberance 402. In the alternative, a series of notches may be formed in the annular protuberance to permit a series of crimps along the lower circumference of the gas flow diverting mechanism. Other means, such as interference fit, locking protuberances, etc., may be employed to secure the gas flow diverting mechanism to the fixed scroll member. Also, as shown in third embodiment gas flow diverting mechanism 106" (FIG. 53), the gas diverting mechanisms may be provided with a plurality of holes 414 which are aligned above a plurality of tapped holes 416 provided in fixed scroll member surface 108 (FIG. 5), the gas diverting mechanism attached to the fixed scroll member with threaded fasteners (not shown).

During compressor operation, compressed refrigerant fluid is forced from discharge port 100 through discharge check valve 102 and into discharge chamber 104, which is defined by the inner surface of the gas flow diverting mechanism and upper surface 108 of the fixed scroll member. Gas flow diverting mechanism 106 may be positioned so that discharge gas exiting chamber 104 through outlet 406 is directed downward through gap 408 (FIGS. 1, 2) formed between housing 22, fixed scroll member 56 and frame 60, and is further directed into housing chamber 110 along path 411 to optimally flow over and about the motor overload protector 41 which is attached to stator windings 410. Hence, the gas diverting mechanism provides an additional measure of motor protection by ensuring that hot discharge gases are immediately directed towards the overload protector.

As shown in the embodiment of FIGS. 49 through 51, gas flow diverting mechanism outlet 406' may be provided with a downwardly turned hood 412 to further direct the outwardly flowing discharge gas downward toward gap 408.

Notably, discharge check valve assembly 102 is oriented toward gas diverting mechanism outlet such that, when the valve is open, front face 304 is exposed to the reverse inrush of discharge pressure gas from chamber 110 to chamber 104 through outlet 406 upon compressor shutdown, thereby facilitating quick closing of the valve.

Figure 10:
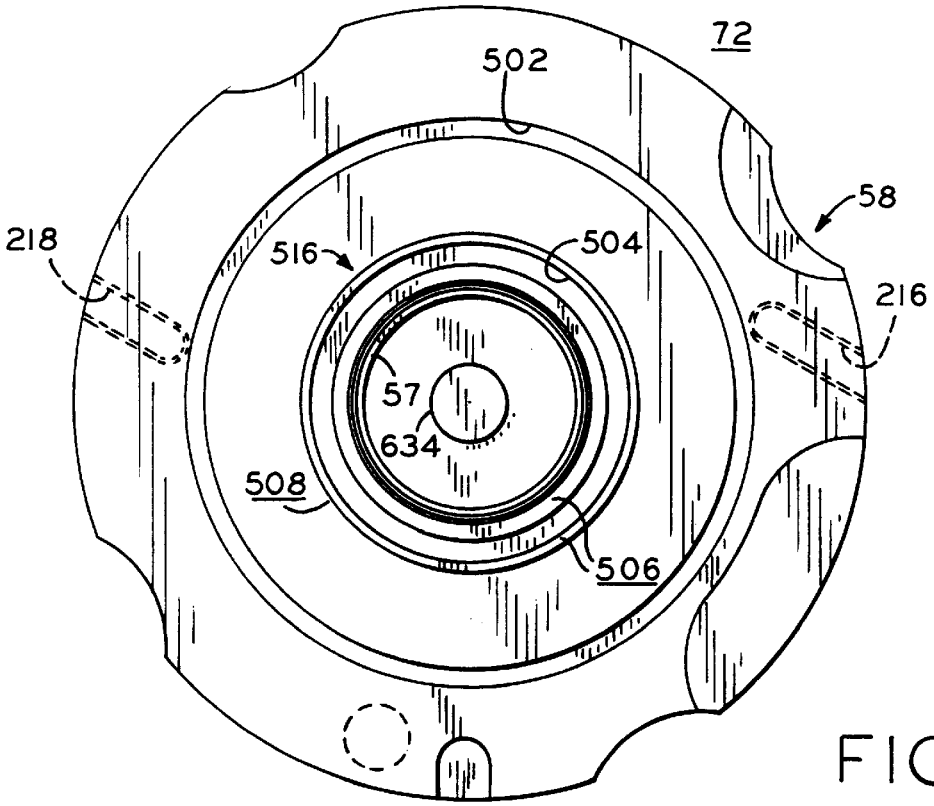
FIG. 10 is a bottom view of the orbiting scroll member of the scroll compressor of FIG. 1.
Figure 14:
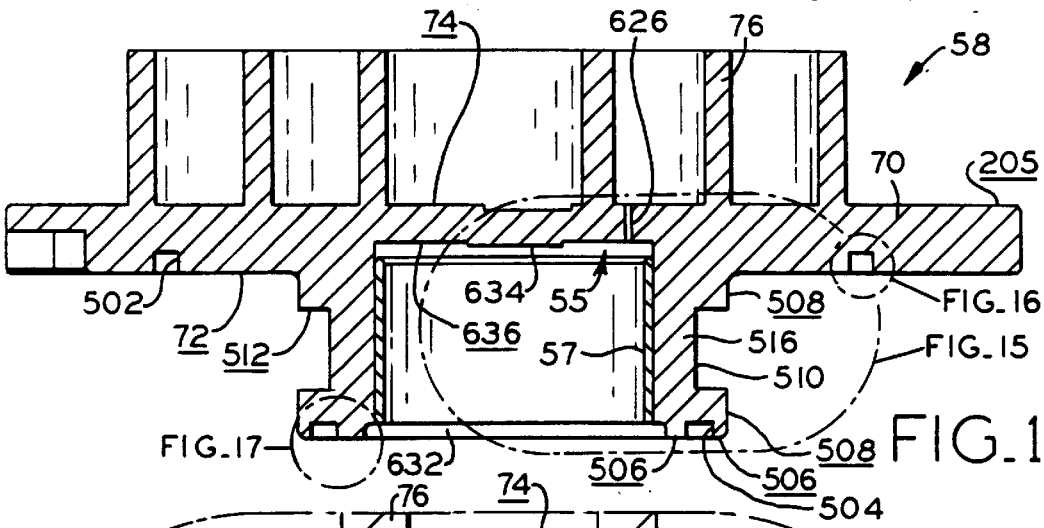
FIG. 14 is a sectional side view of the orbiting scroll member of FIG. 10 taken along line 14—14 of FIG. 11.

The scroll compressor of FIG. 1 is provided with an intermediate pressure chamber 81 into which is introduced refrigerant gas at an intermediate pressure which urges orbiting scroll member 58 into axial compliance with fixed scroll member 56. Intermediate pressure chamber 81 is defined by surfaces of the orbiting scroll member 58 and the main bearing or frame 60 which lie between a pair of annular seals 114, 116 respectively disposed in grooves 502, 504 provided in downwardly-facing axial surfaces 72, 506 of orbiting scroll member 58 and which are in sliding contact with interfacing surfaces of frame 60. Referring to FIGS. 1, 10 and 14, it can be seen that intermediate pressure chamber 81 is generally defined as the annular volume between a step provided in the frame 60 and the downwardly depending hub portion 516 of the orbiting scroll 58. Seals 114 and 116 respectively seal the intermediate pressure from the suction pressure region and the discharge oil pressure region.

Referring to FIG. 12, it can be seen that downwardly depending hub portion 516 of the orbiting scroll member 58 has outer radial surface 508 which adjoins planar surface 72. Surface 508 extends from surface 72 to bottommost axial surface 506 of the hub portion 516. Radial surface 508 is provided with wide annular groove 510 having upper annular surface 512. Aperture 85 extends from surface 512 to surface 74, at which it opens into an intermediate pressure region between the scroll wraps of the orbiting and fixed scroll members. As seen in FIG. 12, aperture 85 may be a single straight passageway which extends at an angle from surface 512 to surface 74. Alternatively, aperture 85 may comprise a first axial bore (not shown) extending from surface 74 in parallel with surface 508 into a portion of hub 516 radially inboard of groove 510, and a radial crossbore (not shown) extending from the first bore to the radial surface of groove 510. For ease of manufacturing, it is preferable to provide a single, angled aperture as shown in FIG. 12.

Figure 17:
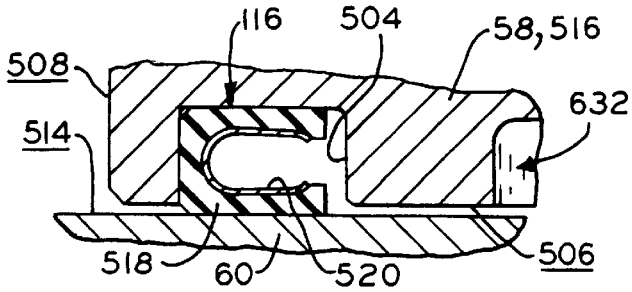
FIG. 17 is an enlarged fragmentary sectional side view of a second embodiment of a seal disposed intermediate the orbiting scroll member and the main bearing or frame of the scroll compressor of FIG. 1.

Referring now to FIG. 17, it can be seen that seal 116 is provided in groove 504 and is in sliding contact with surface 514 of frame 60 which interfaces surface 506 of hub portion 516. The portion of surface 506 radially inboard of groove 504, i.e., to the right as shown in FIG. 17, is at discharge pressure and is ordinarily filled with oil. As seen in FIG. 17, seal 116 is generally C-shaped having outer portion 518 and inner portion 520 disposed within the annular channel provided in outer portion 518, the channel facing radially inboard. Outer seal portion 518 may be a polytetrafluoroethylene (PTFE) material, or other suitable low-friction material, which provides low friction sliding contact with surface 514. The interior of inner seal portion 520 is exposed to discharge pressure oil, which causes seal 116 to expand axially and radially outward in groove 504, thereby ensuring sealing contact between the sealing surfaces of seal 116 and the uppermost and outermost surfaces of groove 504 and surface 514 of the frame.

Figure 16:
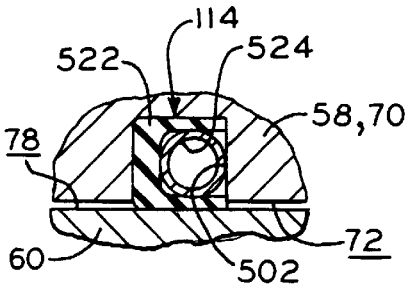
FIG. 16 is an enlarged fragmentary sectional side view of a first embodiment of a seal disposed intermediate the orbiting scroll member and the main bearing or frame of the scroll compressor of FIG. 1.

Referring now to FIGS. 14 and 16, it can be seen that planar surface 72 of orbiting scroll member 58 is provided with annular groove 502 in which is disposed seal 114. Seal 114 includes outer portion 522 having a c-shaped channel which is open radially inwardly, and an inner portion 524 disposed within the c-channel. The C-channel of portion 522 opens radially inwardly so as to be exposed to intermediate pressure fluid within intermediate pressure chamber 81, which urges seal 114 radially outward in groove 502 and axially outward against the opposing axial surfaces of groove 502 and surface 78 of frame 60 on which seal 114 slidingly engages. Outer seal portion 522 may be made of PTFE material, or other suitable low-friction material, thereby allowing low friction sliding engagement with surface 78. Inner seal portion 114 may be Parker Part No. FS16029, having a tubular cross section. Grooves 504 and 502 may be provided with seals 114 and 116 of a common cross-sectional design, which may be as illustrated in either FIG. 16 or FIG. 17. That is, the cross-sectional design of seal 114 may be adapted for use in groove 504. Conversely, cross-sectional design of seal 116 may be adapted for use in groove 502. The pressure within intermediate pressure chamber 81 may be regulated by means of a valve as disclosed in pending U.S. application Ser. No. 09/042,092, filed Mar. 13, 1998, which is expressly incorporated herein by reference.

Referring to FIG. 1, main bearing or frame 60 is provided with downwardly depending main bearing portion 602 which is provided with bearing 59 in which journal 606 of crankshaft 34 is radially supported. Crankshaft journal portion 606 is provided with radial crossbore 608 (FIGS. 55, 56) which extends from the outer surface of crankshaft journal portion 606 to upper oil passageway 54 within the crankshaft. A portion of the oil conveyed through passageway 54 is provided through crossbore 608 to lubricate bearing 59. Oil flowing from crossbore 608 through bearing 59 may flow downward along the outside of crankshaft journal portion 606 where it may be radially distributed by a rotating counterweight 614, after which it is returned to sump 46. From crossbore 608, oil may also flow upwards along bearing 59 and along the outside of journal portion 606 and into annular oil gallery 610, which is in communication with housing chamber 110 and sump 46 through passageway 612 in frame 60. Passageway 612 is oriented in frame 60 such that the rotating counterweight 614 will pick up and sling the oil coming through passageway 612 to disperse the oil in the radial side of the compressor opposite the inlet of discharge tube 112. The terminal end opening 732 of oil passageway 54 is sealed with plug 616 which is flush with or somewhat below the terminal end surface of crankpin 61.

Radial oil passage 622 in roller 82 and radial oil passage 624 in crankpin 61 are maintained in mutual communication (FIG. 61C), although roller 82 may pivot slightly about crankpin 61, its pivoting motion is limited by the sides of bore 618 engaging the sides of limiting pin 83. The remaining oil which flows through oil passageway 54 in the crankshaft, which flows beyond crossbore 608, flows through communicating oil passages 622 and 624 to lubricate bearing 57. Because oil passage 54 is oriented at an angle relative to the axis of rotation of shaft 34, oil passage 54 forms a type of centrifugal oil pump which may be used in conjunction with pump assembly 48 disposed in oil sump 46 and described further hereinbelow. The pressure of the oil which reaches radial oil passages 608 and 624 is thus greater than the pressure of the oil in sump 46, which is substantially discharge pressure. Oil flowing through bearing 57 may flow upwards into oil receiving space or gallery 55 (FIGS. 15, 63B) which is in fluid communication with an intermediate pressure region between the scroll wraps through oil passage 626. The oil in oil gallery 55 is at discharge pressure, and flows through passageway 626 by means of the pressure differential between gallery 55 and the intermediate pressure region between the scrolls. The oil received between the scrolls through passageway 626 serves to cool, seal and lubricate the scroll wraps. The remaining oil which flows along bearing 57 flows downward into annular oil gallery 632, which is in communication with annular oil gallery 610 (FIG. 1).

Figure 63A:
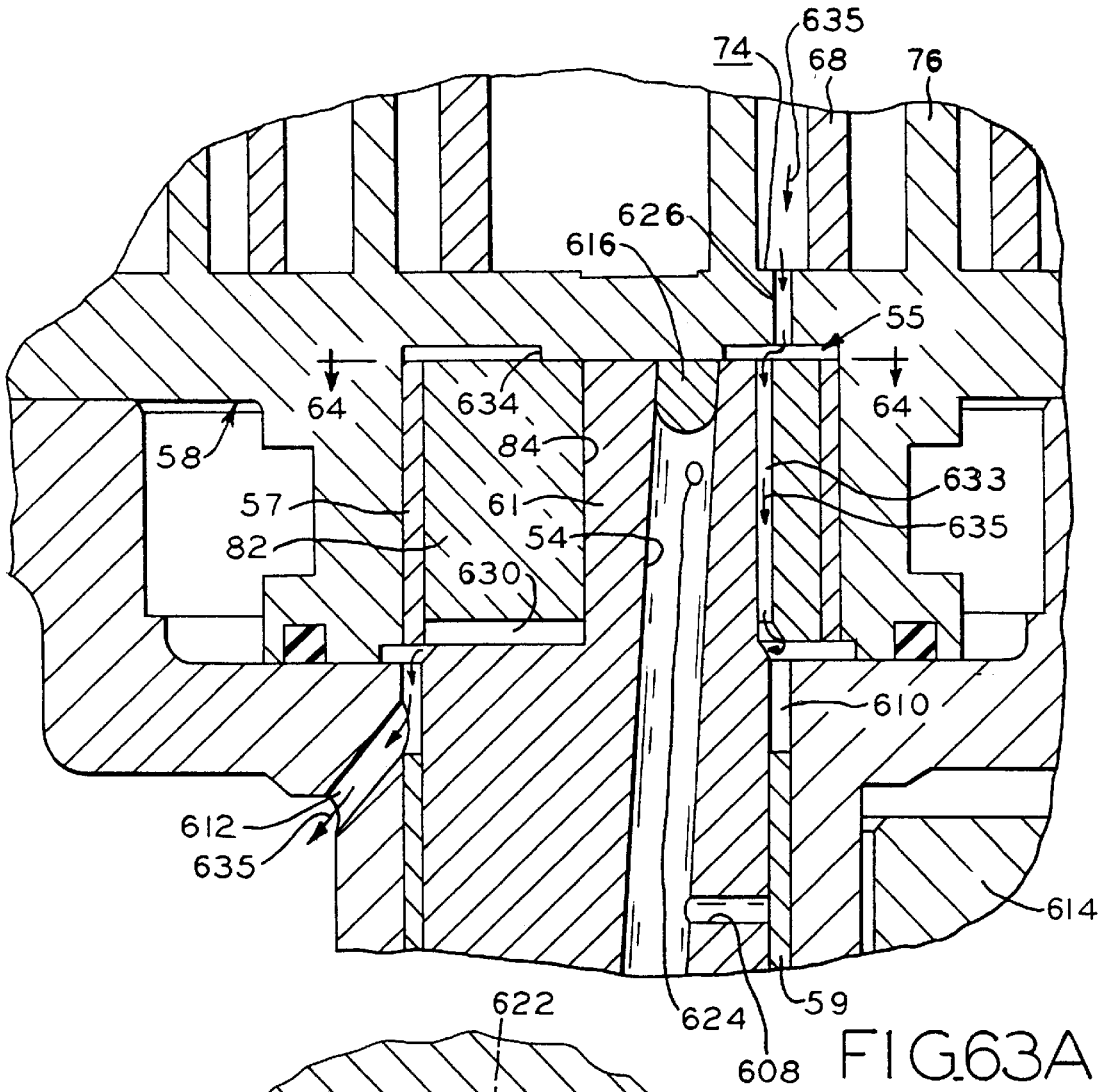
FIG. 63A is a first enlarged, fragmentary sectional side view of the compressor assembly of FIG. 1.
Figure 64:
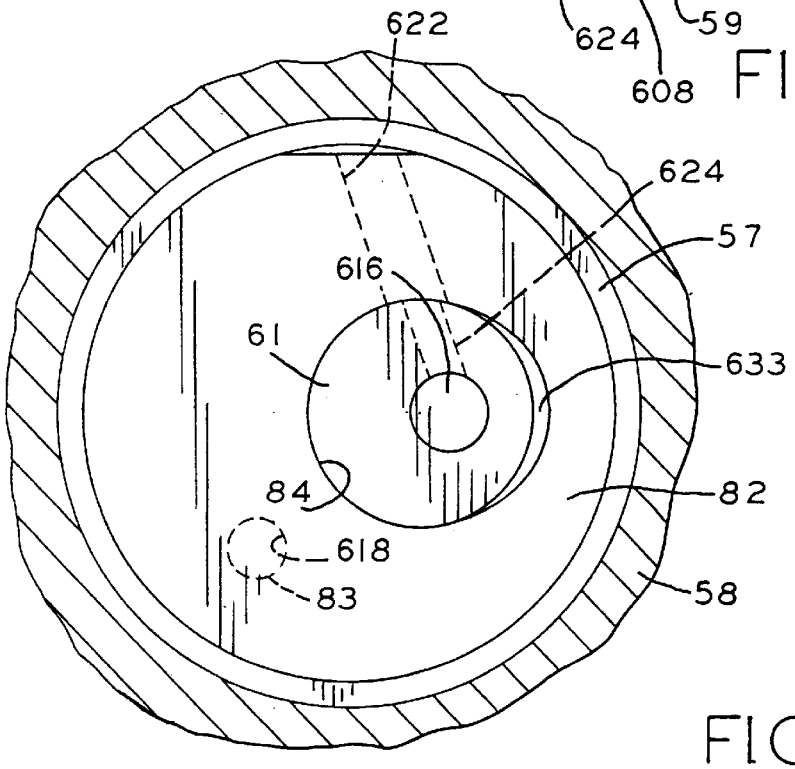
FIG. 64 is a fragmentary sectional end view of the compressor assembly of FIG. 63A along line 64—64.

As best shown in FIG. 64, axial bore 84 of roller 82 is not quite cylindrical, and forms, along one radial side thereof, clearance 633 between that side of the bore and the adjacent cylindrical side of the crankpin 61, which extends therethrough. Clearance 633 provides part of a vent passageway which, during conditions when intermediate pressure between the scroll wraps is greater than discharge pressure, would prevent a backflow gas flow condition through roller bearing 57. With reference now to the flowpath represented by arrows 635 of FIG. 63A, if intermediate pressure is greater than discharge, such as during startup operation of a compressor, refrigerant may be vented through passageway 626, into oil gallery 55, and through clearance 633 between bore 84 and the outer surface of crankpin 61 into a region defined by countersink 628 provided in the lower axial surface of the roller 82 about bore 84 and crankpin 61. This region is in communication with a radial slot 630 provided in the lower axial surface of roller 82. This vented refrigerant may flow into annular oil gallery 632 and back to housing chamber 110 of the compressor through passageway 612 in frame 60. In this manner, venting of refrigerant during startup operation assures that oil gallery 55 does not pressurize to the point of restricting oil flow to bearing 57 or, as indicated above, flush the oil from bearing 57 with the venting refrigerant during compressor startup.

Figure 15:
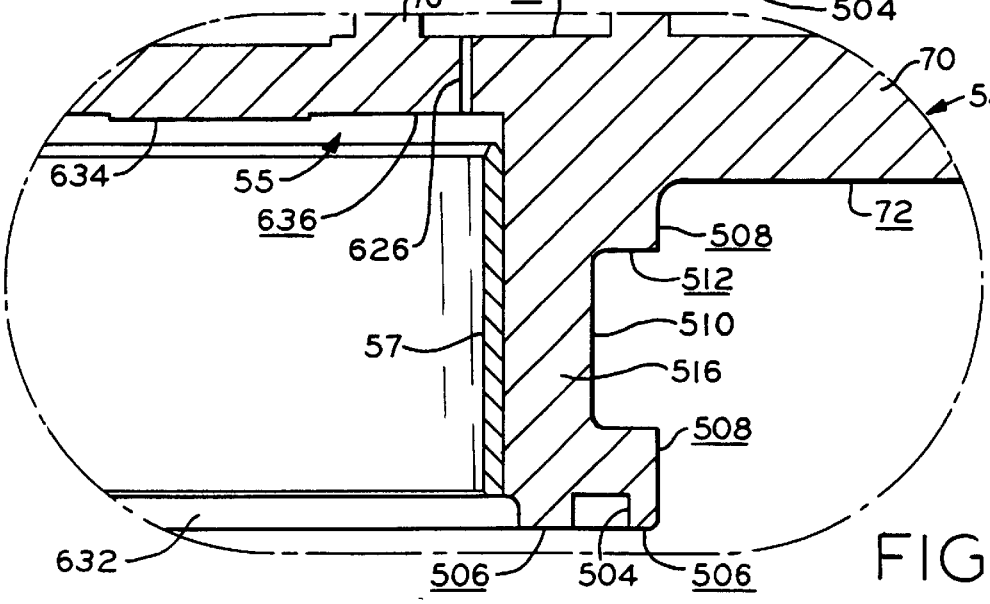
FIG. 15 is an enlarged fragmentary sectional side view of the orbiting scroll member of FIG. 10 showing an axial oil passage.

As seen in FIGS. 14, 15 and 63, downwardly-facing surface 636 of the orbiting scroll member inside the central cavity of hub portion 516 is provided with a short cylindrical protuberance or "button" 634 which projects downwardly approximately 2–3 mm from surface 636. Button 634 is, in one embodiment, approximately 10–15 mm in diameter and its axial surface abuts portions of the interfacing uppermost axial surfaces of crankpin 61 and/or roller 82, which are generally flush with one another. Button 634 provides the function of locally loading crankpin 61 and/or roller 82 so as to minimize frictional contact over the entire upper axial roller and crankpin surfaces and thus serves as a type of thrust bearing. The interface of button 634 and crankpin 61 and/or roller 82 is near the centerlines of hub portion 516 and roller 82, where the relative velocity between the button and the crankpin and roller assembly is lowest, thereby mitigating wear therebetween.

Positive displacement type oil pump 48 is provided at the lower end of crankshaft 34 and extends into oil sump 46 defined by compressor housing 22. A first embodiment of the oil pump is disclosed in FIGS. 65 through 79 and an alternative second embodiment is disclosed in FIGS. 80 and 81. In the first embodiment, as shown in the fragmentary sectional side views of FIGS. 65 and 66, positive displacement pump 48 is disposed about lower end 702 of crankshaft 34 and is supported by outboard bearing 36.

Figure 55:
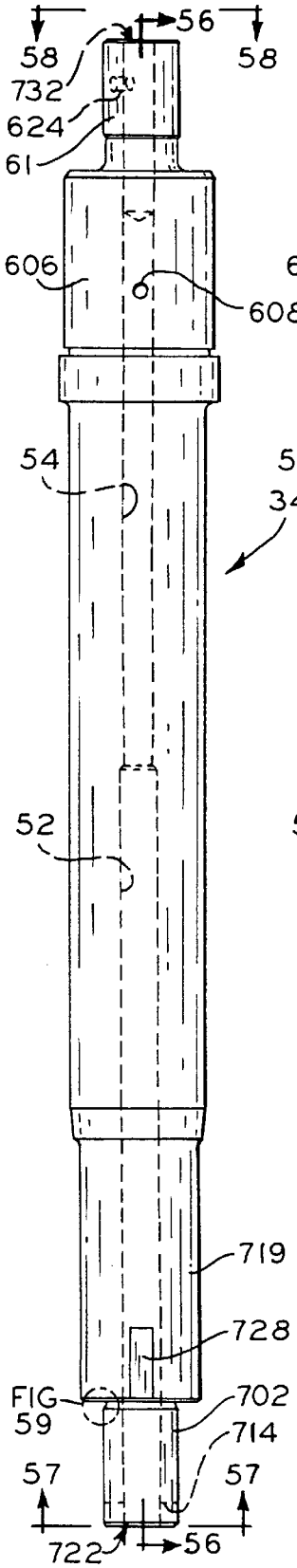
FIG. 55 is a side view of the crankshaft of the scroll compressor of FIG. 1.
Figure 57:
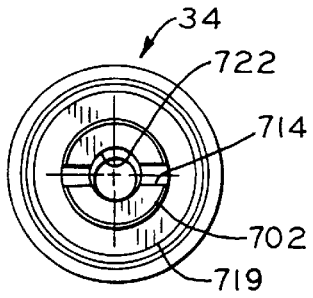
FIG. 57 is a bottom view of the crankshaft of FIG. 55.
Figure 58:
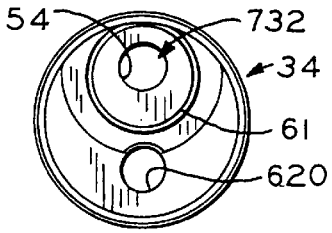
FIG. 58 is a top view of the crankshaft of FIG. 55.
Figure 59:
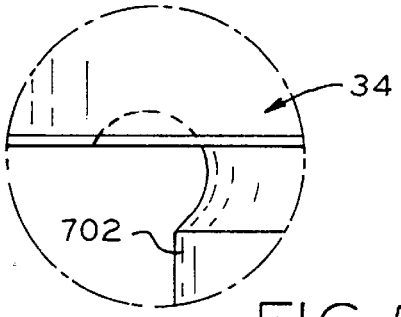
FIG. 59 is an enlarged fragmentary side view of the crankshaft of FIG. 55 showing the toroidal shaped oil channel or gallery associated with the bearing lubrication system of the compressor of FIG. 1.
Figure 60:
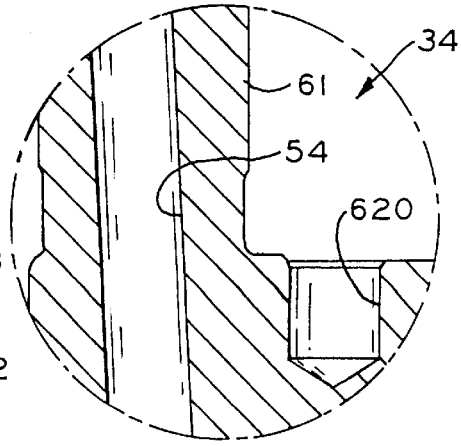
FIG. 60 is an enlarged fragmentary sectional side view of the upper portion of the crankshaft of FIG. 55.
Figure 65:
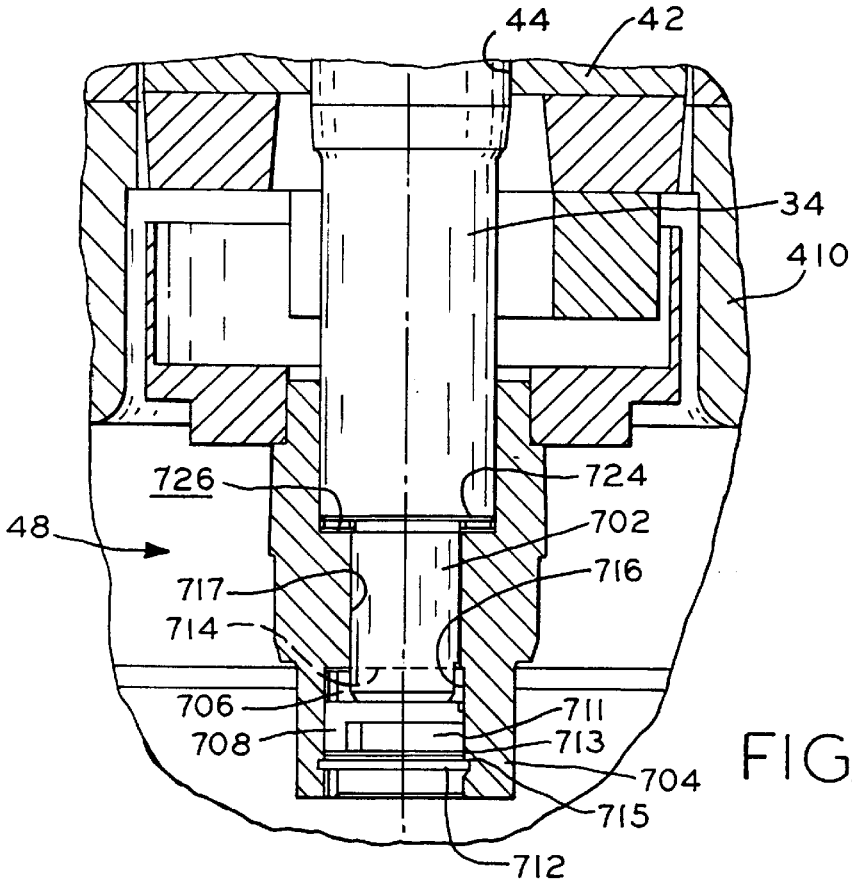
FIG. 65 is a first fragmentary sectional side view of the lower portion of the scroll compressor of FIG. 1 showing a first embodiment of a positive displacement oil pump.
Figure 73:
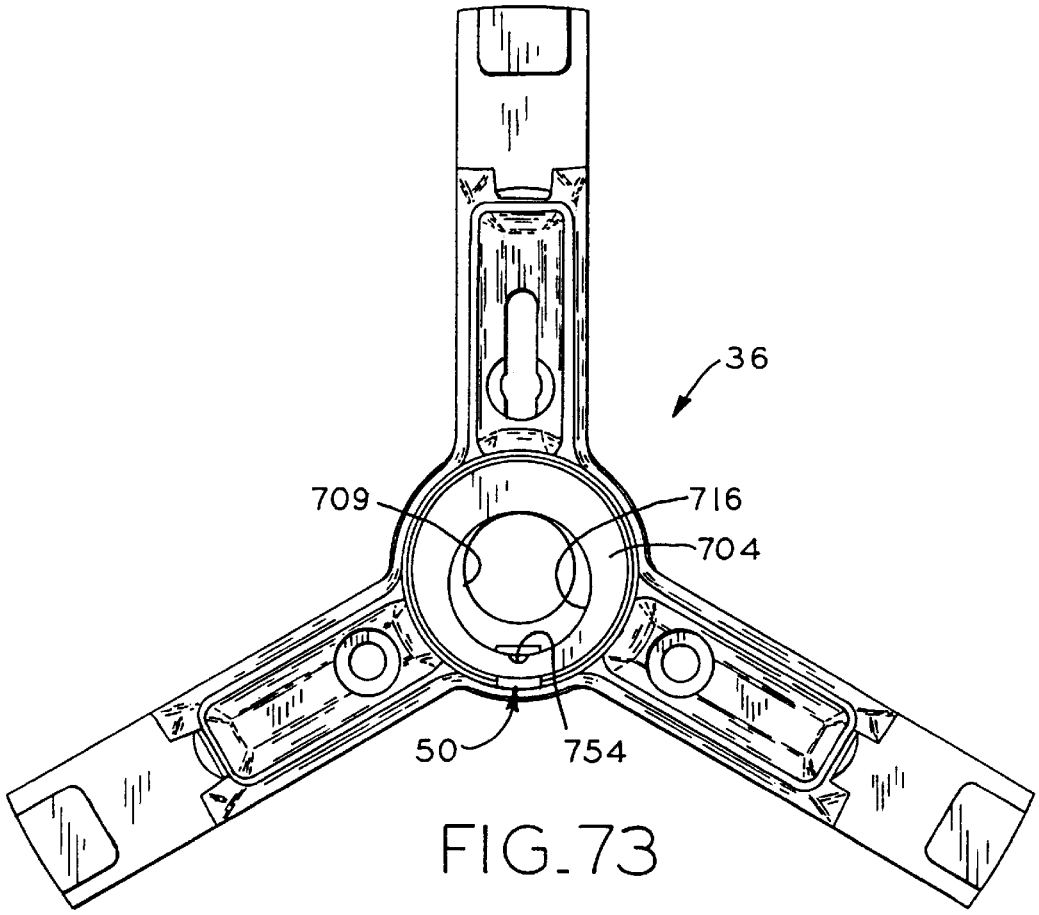
FIG. 73 is a bottom view of the lower bearing and oil pump housing of FIG. 69.
Figure 74:
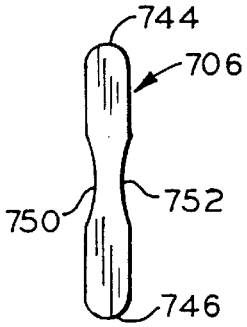
FIG. 74 is a top view of the pump vane or wiper of the oil pump of FIG. 68.
Figure 75:
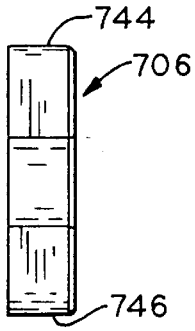
FIG. 75 is a side view of the pump vane of FIG. 74.
Figure 76:
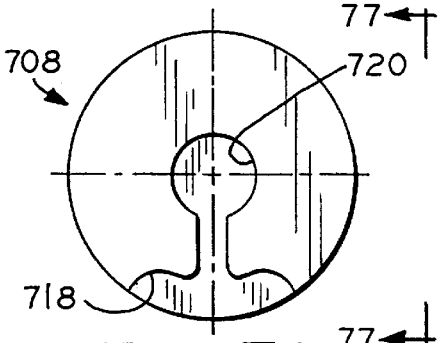
FIG. 76 is a top view of the reversing port plate of the oil pump of FIG. 68.
Figure 77:
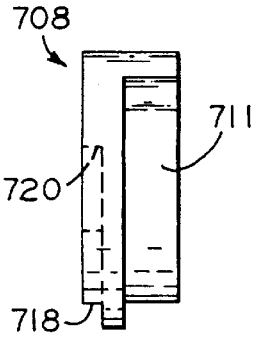
FIG. 77 is a right side view of the reversing port plate of FIG. 76.
Figure 78:
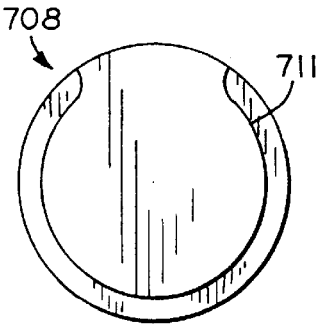
FIG. 78 is a bottom view of the reversing port plate of FIG. 76.
Figure 79:
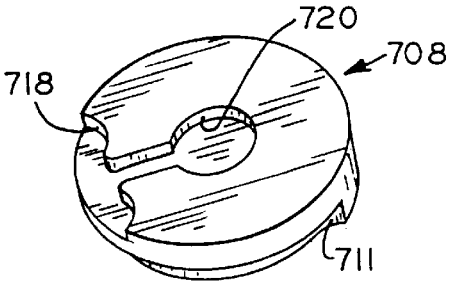
FIG. 79 is a top perspective view of the reversing port plate of FIG. 76.

The pump is comprised of oil pump body 704, vane or wiper 706, which may be made injection molded of a material such as Nylatron™ GS, for example, circular reversing port plate or disc 708, the planar upper, axial surface of which is in sliding contact with the lower surface of vane 706, retention pin 710, wave washer 713, circular retainer plate 715 and snap ring 712. The pump components are arranged with in pump body 704 in the order shown in FIG. 68, and wave washer 713 urges the pump components into compressive engagement with each other. An annular groove is provided in the lower end of the pump body to receive snap ring 712. Slot 714, as shown in FIGS. 55–57, is provided in lower end 702 of shaft 34 and receives rotary vane 706, which is longer than the diameter of lower shaft end 702, and which is caused to rotate by the rotation of the crankshaft. The vane slides from side to side within the slot and contacts the surface of pump cylinder 716 formed in pump body 704. As best shown in FIGS. 65 and 73, pump cylinder 716 is larger in diameter than, and is eccentric relative to, portion 709 of bearing 36. Further, the centerline of pump cylinder 716 is offset with respect to the center line of crankshaft 34 and lower axial oil passage 52.

The diameter of portion 709 of bearing 36 is somewhat larger in diameter than lower shaft end 702, thereby providing a small clearance therebetween, through which oil may leak from pump 48, as will be described further hereinbelow, to lubricated the lower journal portion 719 of shaft 34, which is radially supported by journal portion 717, and axially supported by surface 726, of bearing 36.

As shaft 34 rotates, vane 706 reciprocates in shaft slot 714, its opposite ends 744, 746 (FIGS. 74, 75) sliding on the cylindrical wall of pump cylinder 716. Having opposite ends 744, 746 facilitates multi-direction operation of vane 706. The vane may alternatively be formed with a spring (not shown) in the middle or may be of a two-piece design with two vane end portions connected by a separate, intermediate spring (not shown). The intermediate spring urges the vane ends outward toward the inner surface of the pump body for a tighter more efficient pumping operation. Such alternative configurations would better seal vane ends 744, 746 to the cylindrical wall of pump cylinder 716, thereby reducing pump leakage. The pump relies on some amount of leakage, however, to provide lubrication of lower bearing 36. Oil leakage past vane 706 as it is rotated in pump cylinder 716 travels upward through the small clearance between lower shaft portion 702 and portion 709 of bearing 36, providing a source of lubricant to the journal and thrust bearings above. Hence, lower bearing 36 of compressor 20 is lubricated by leakage from pump 48 rather than by oil pumped thereby through lower shaft passageway 52.

Figure 66:
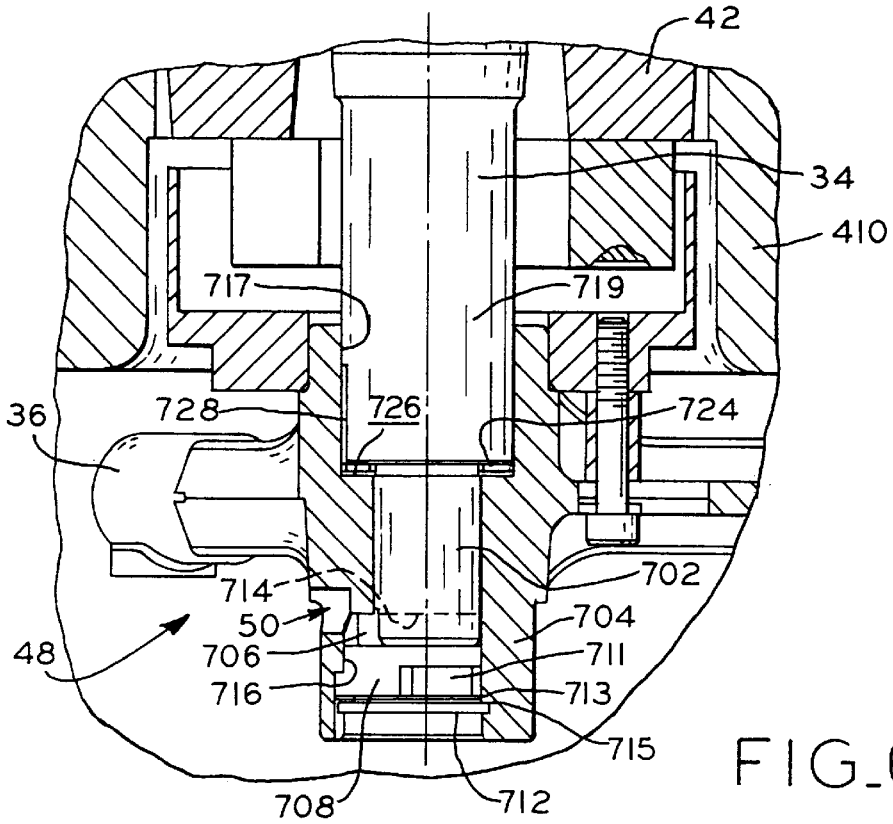
FIG. 66 is a second fragmentary sectional side view of the positive displacement oil pump of FIG. 65.
Figure 67:
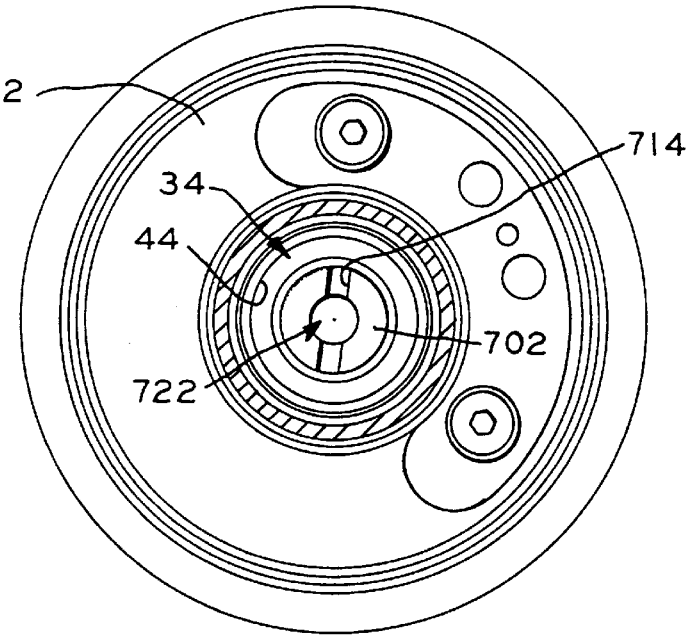
FIG. 67 is a bottom view of the scroll compressor of FIG. 1 illustrated with the lower bearing and oil pump removed.
Figure 68:
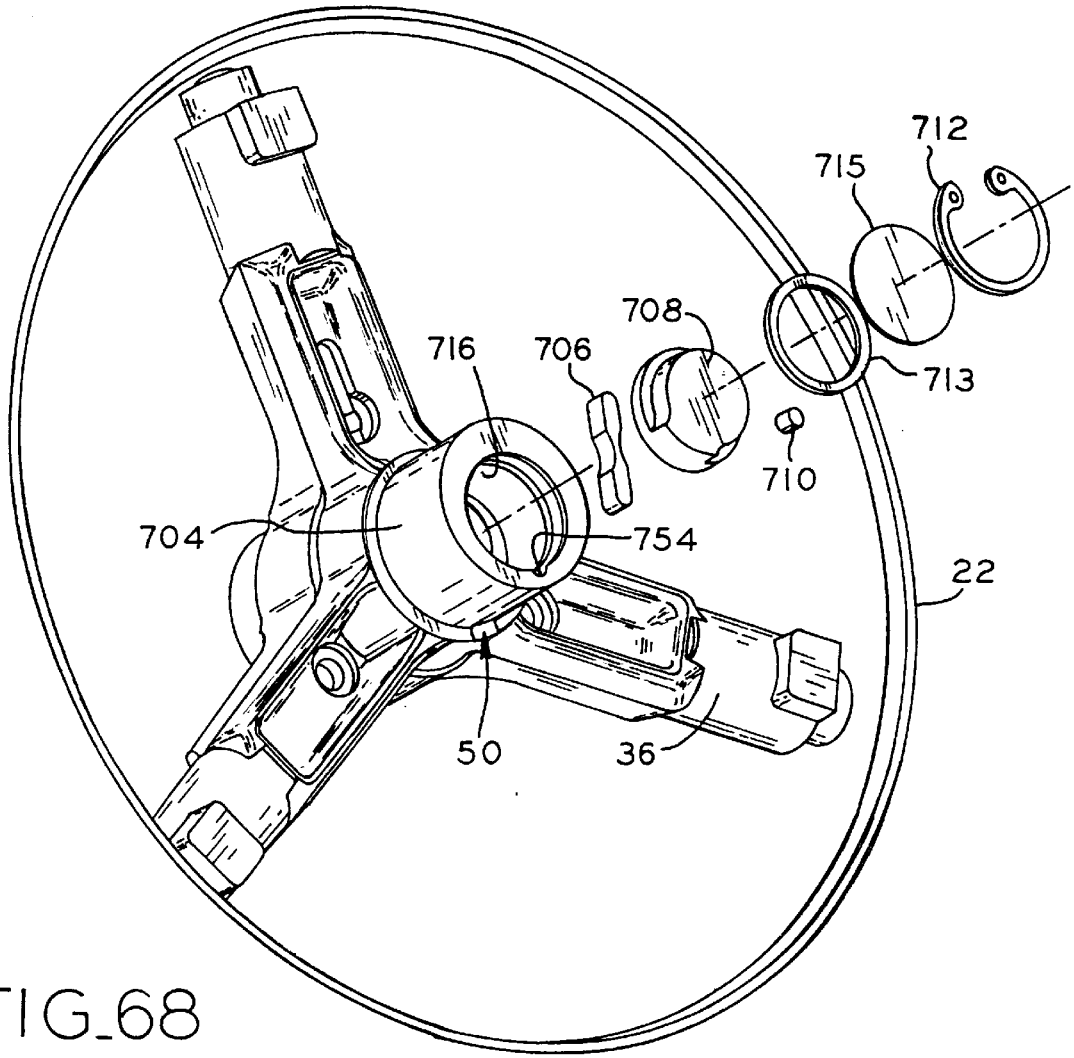
FIG. 68 is an exploded lower view of the lower bearing and positive displacement oil pump assembly of FIG. 65.
Figure 69:
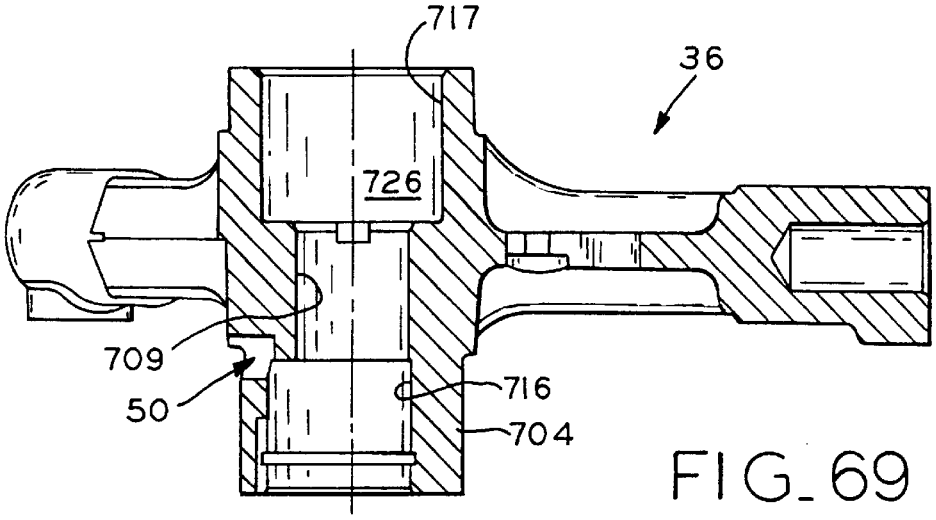
FIG. 69 is a sectional side view of the lower bearing and pump housing of the positive displacement oil pump assembly of FIG. 65.
Figure 70:
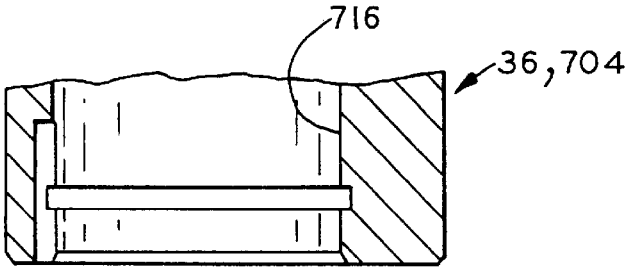
FIG. 70 is an enlarged fragmentary sectional side view of the lower portion of the pump housing of FIG. 69.
Figure 71:
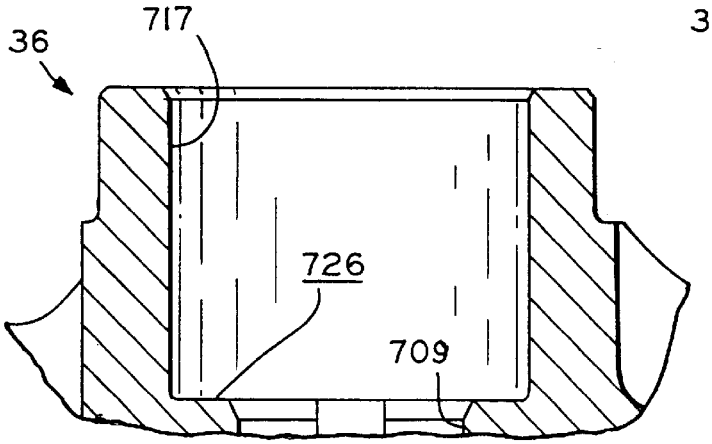
FIG. 71 is an enlarged fragmentary sectional side view of the upper portion of the lower bearing of FIG. 69.
Figure 72:
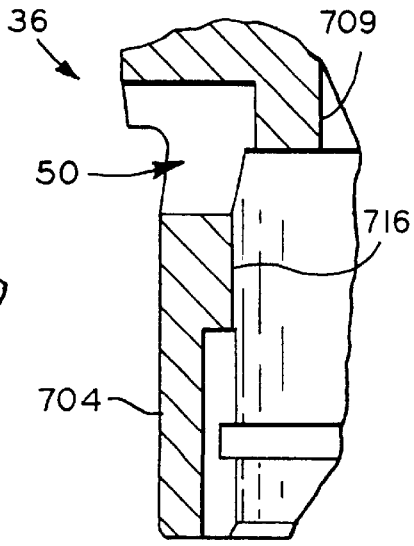
FIG. 72 is an enlarged fragmentary sectional side view of the oil pump housing of FIG. 69 showing the oil pump inlet.

As shown in FIG. 66, oil from sump 46 enters the pump via inlet 50 and is acted upon by a side surface of rotating vane or wiper 706. The vane forces oil into anchor-shaped inlet 718 provided in the planar, upper axial surface of reversing port plate 708, where, due to the decreasing volume, the oil is forced to travel into the central reversing port outlet 720 and upwards into axial oil passage inlet 722, past scallops 750, 752 in the sides of vane 706. In effect, due to the eccentric nature of the pump and the action of the rotating vane, central port outlet 720 is at a pressure lower than that at the anchor-shaped inlet. The anchor shape of the reversing port plate permits effective pumping operation regardless of the direction of rotation of the crankshaft, for oil will be allowed to enter inlet 718 at or near either of its two anchor "points". Hence, oil will be provided to the compressor's lubrication points even during reverse rotation of the compressor upon shutdown, should that occur. Circumferential retention pin channel 711 is provided in the planar, lower axial surface of reversing port plate 708 to slidably receive retention pin 710. Pin 710 is fixed relative to the pump body, retained within notch 754 provided in the cylindrical wall of pump cylinder 716 (FIGS. 68, 73) below pump inlet 50. This permits rotational repositioning of the reversing port plate to properly accommodate multi-direction operation, opposite end surfaces of channel 711 brought into abutment with pin 710 as shaft 34 changes rotational direction. Port plate 708 thus having rotatably opposite first and second positions.

Lower bearing thrust washer 724 rests on lower bearing thrust surface or shoulder 726 to provide a thrust bearing surface for crankshaft 34. Oil leakage from pump mechanism 48 travels upward through the interface between lower shaft end 702 and lower bearing portion 709, as described above, to provide lubricating oil to the interface between crankshaft thrust surface 726 and thrust washer 724, and crankshaft journal portion 719 and bearing journal portion 717. Grooves (not shown) are formed in thrust washer 724 to assist in the delivery of lubricating oil to thrust surface 726. In addition, slots (not shown) may be provided in the pump body to assist oil leakage from the pump mechanism to the thrust surface. Also, slot, flat or other relief 728 (FIGS. 55, 56) may be provided in the crankshaft journal portion 719 to provide further rotational lubrication to the interfacing surfaces of the lower journal bearing. In this manner, leakage from the pump, rather than the primary pump flow traveling along the crankshaft axial oil passageway, provides both rotational and thrust lubrication to the lower bearing surfaces. This concentrates the delivery of primary pump oil flow to destinations further up the crankshaft. The pump thus provides a means of lubricating the lower bearing of the compressor which allows relatively loose tolerances of the interfacing surfaces of the pump body and shaft and simple machining of the crankshaft.

Figure 63B:
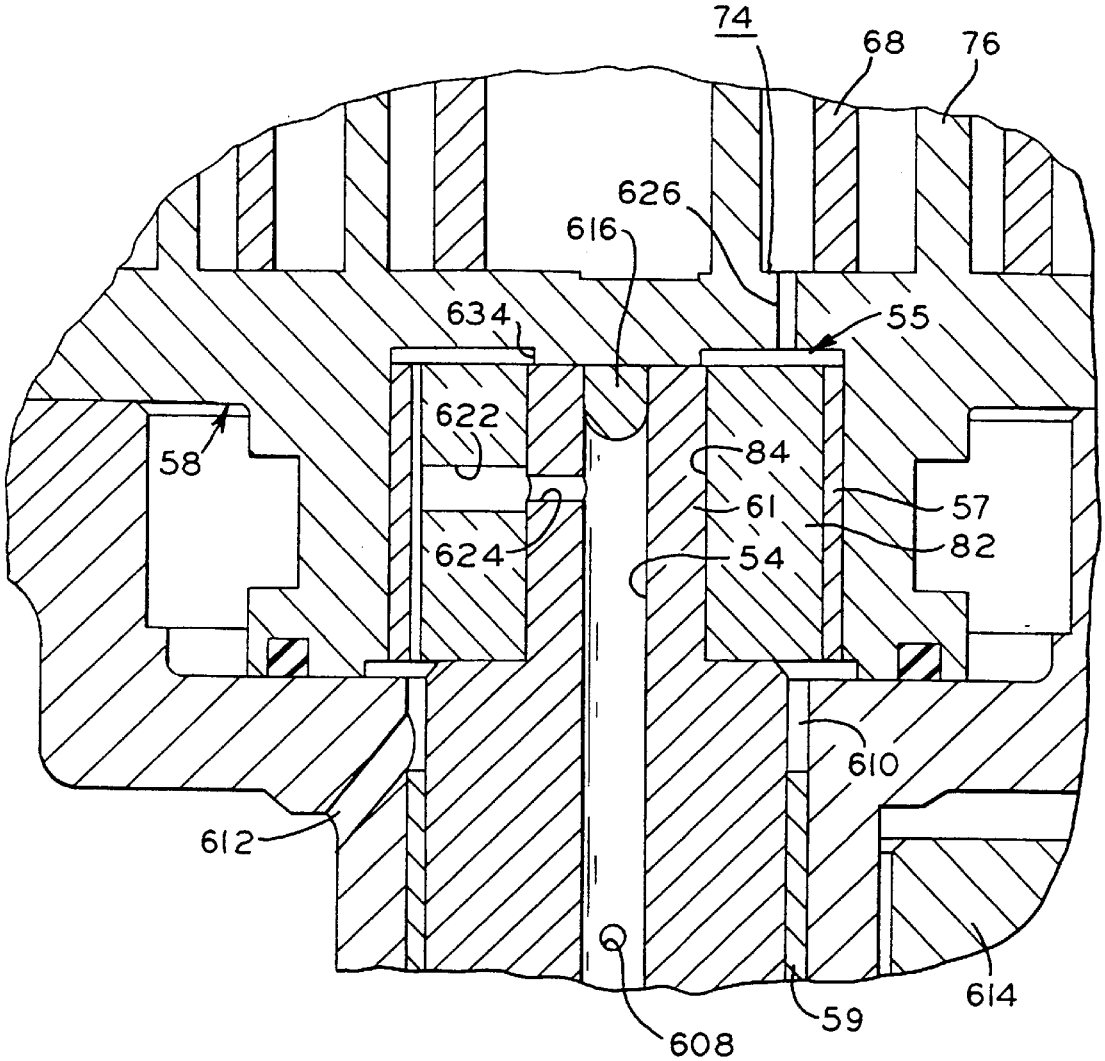
FIG. 63B is a second enlarged, fragmentary sectional side view of the compressor assembly of FIG. 1.

As shown in FIG. 1, oil from pump 48 travels upwards along lower axial oil passageway 52 and offset upper oil passageway 54. The offset configuration of the upper oil passageway 54 provides an added centrifugal pumping effect on the primary oil flow of the pump. The upper opening 732 of passageway 54 is provided with plug 616. Part of the oil flow through passageway 54 is discharged through radial passageway 608 in shaft journal portion 606 (FIGS. 55, 56) and is delivered to bearing 59. The remainder of the oil flow through passageway 54 is discharged through radial passageway 624 in crankpin 61 and communicating radial passageway 622 in roller 82, and is delivered to bearing 57 (FIG. 63B). Oil flows upwards along bearing 57 and into oil gallery 55, which is defined by the upper surfaces of crankpin 61 and eccentric roller 82, and the surface 636 of orbiting scroll member 58. Oil is delivered to the scroll set via axial passage 626 provided in the orbiting scroll member.

Figure 80:
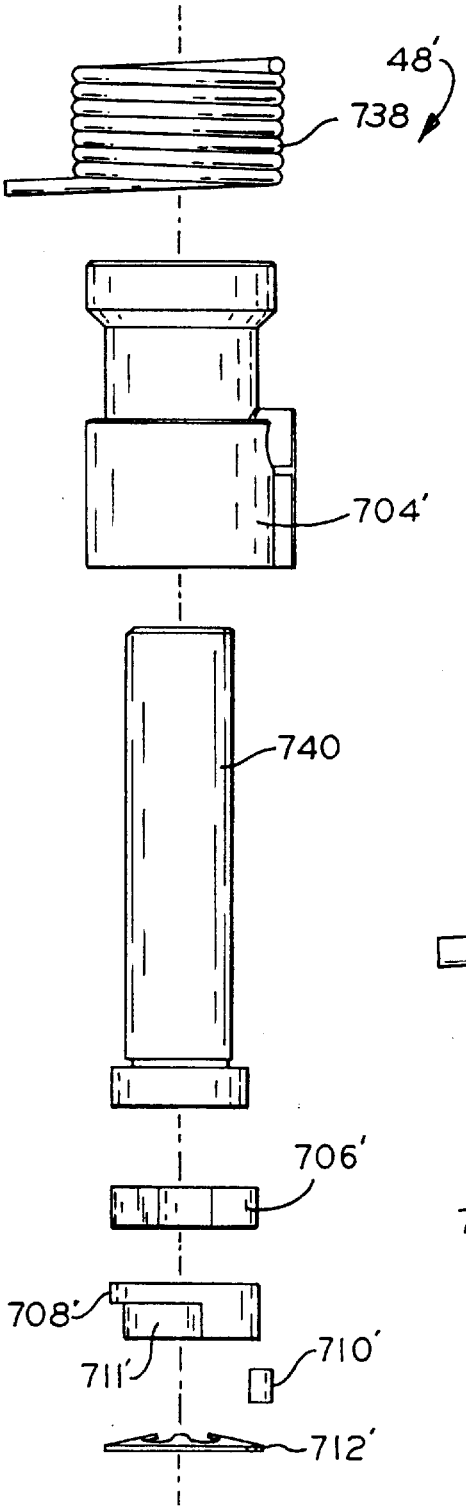
FIG. 80 is an exploded side view of a second embodiment of a positive displacement oil pump.
Figure 81:
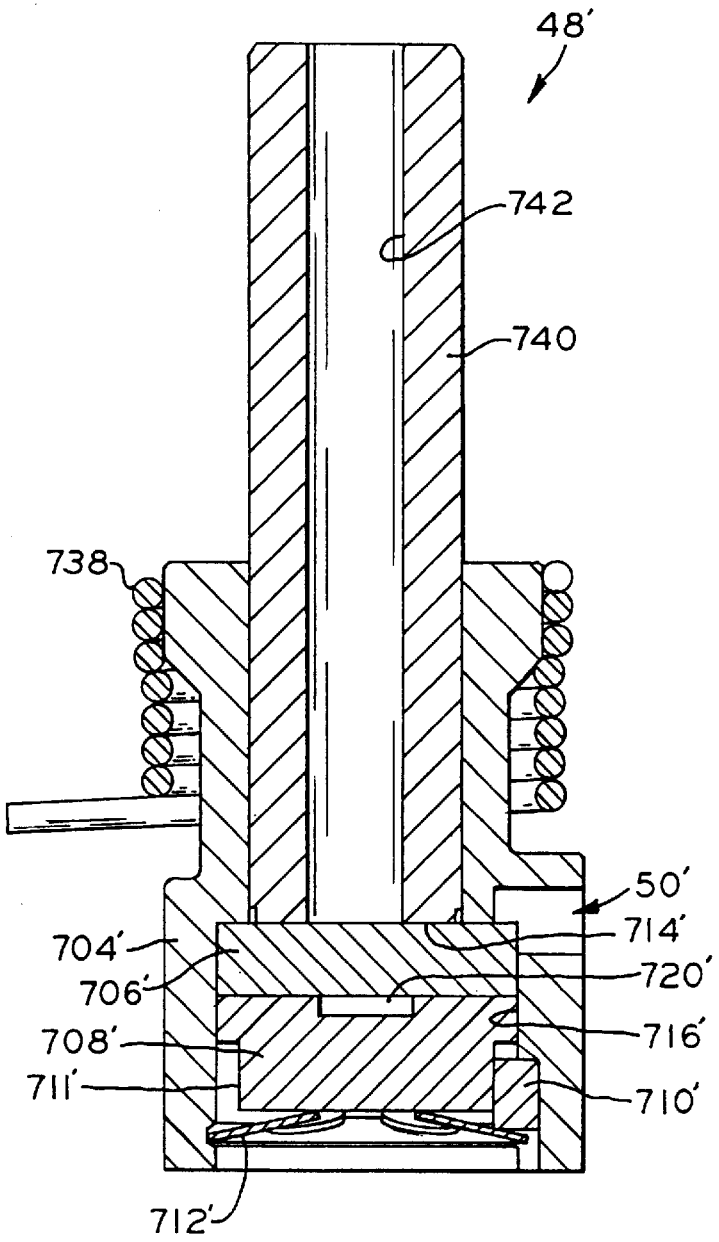
FIG. 81 is a sectional side view of the oil pump of FIG. 80, assembled.

Oil pump 48' of the second embodiment, as shown in the exploded view of FIG. 80 and the sectional view of FIG. 81, functions essentially as described above but is different structurally as it is designed for use in compressors having no lower bearing. Oil pump 48' includes anti-rotational spring 738, which is attached to compressor housing 22 or some other fixed support. Spring 738 supports oil pump body 704' axially within housing 22, and against rotation with shaft extension 740, which includes axial inner oil passage 742 and is attached to the lower end of a crankshaft (not shown). Slot 714', similar to slot 714 of shaft 34, is provided in shaft extension 740; vane 706' is slidably disposed in the slot for reciprocation therein, the vane rotatably driven by the slot as described above. Instead of wave washer 713, retainer plate 715 and snap ring 712, pump assembly 48' may alternatively comprise split spring washer 712' to urge the pump components into compressive engagement with each other. Pump assembly 48 may be similarly modified. Vane 706', reversing port plate 708' and retention pin 710' are substantially identical to their counterparts of the first embodiment pump assembly, and pump assembly 48' functions as described above.

Those skilled in the art will appreciate that pump assemblies 48, 48', although described above as being adapted to a scroll compressor, may also be adapted to other types of applications, such as, for example, rotary or reciprocating piston compressors.

Compressor assembly 20 may be provided with an offset between fixed scroll centerline 802 and crankshaft centerline S. This offset affects the crank arm and radial compliance angle so as to flatten cyclic variations in crankshaft torque and flank sealing force between the scroll wraps. The compressor may incorporate either a slider block radial compliance mechanism or, as shown in the above-described embodiments, a swing link radial compliance mechanism. The following nomenclature is used in the following discussion:

e orbiting radius (eccentricity);

b distance from crankpin 61 centerline P to orbiting scroll center of mass O;

d distance from crankpin 61 centerline P to eccentric swing link center of mass R;

r distance from crankpin 61 centerline P to crankshaft 34 centerline S;

D offset distance from fixed scroll wrap centerline to crankshaft centerline

F force;

M mass;

O orbiting scroll center line and center of mass;

P crankpin 61 center line;

R swing link center of mass;

S crankshaft 34 centerline and rotation axis;

RPM revolutions per minute;

| Subscripts | Greek symbols |
|---|---|
| b swing link | θ radial compliance (phase) angle |
| § flank sealing | α swing link center of mass angular offset |
| ib swing link inertia | ξ Crankshaft angle |
| P drive pin | |
| s orbiting scroll | |
| tg tangential, gas | |
| rg radial, gas | |
| tp tangential, eccentric pin | |
| rp radial, eccentric pin | |

There are three characteristics which distinguish the scroll compressors from other gas compression machines, respectively the quiet operation, the ability to pump liquid, and high energy efficiency. The scroll compressor has an advantage over reciprocating or rotary compressors in that it does not suffer mechanical damage during liquid ingestion. This is because the scrolls are provided with a radial compliance mechanism that allows the scrolls to disengage in the event of liquid compression. In such a case, the compressor turns merely into a pump. Typical radial compliance mechanisms also split the driving force into a tangential force meant to balance the friction and compression forces and a radial component to ensure the flank contact between wraps and thus the sealing between compression pockets.

Another advantage is the smoother variation of the crankshaft torque as the compressing gas is distributed in multiple pockets with only two openings each crankshaft cycle. The crankshaft torque is directly proportional to the compression force and the torque arm, respectively the distance between the compression force vector and crankshaft rotation axis. A means of further leveling the crankshaft torque variation is to provide varying distance to the vector, with a minimum value of this distance coinciding with the maximum compression force. However, a corresponding increasing variation in flank sealing force may result. The swing link radial compliance mechanism can level this variation as well.

A radial compliance mechanism often used in scroll compressors is a slider block. The ability of the slider block version to reduce the torque variation in scroll compressors is presented in Equation 1, below. The slider block allows the orbiting scroll to move the center of mass during crankshaft rotation. A side effect of the center of this movement is that the centrifugal force and thus the radial flank sealing force varies with crankshaft angle.

The radial compliance mechanism considered in the present study is a swinglink as described above as with respect to the illustrated embodiments. The force diagram for this swing link is presented in FIG. 82.

The force balance in X and Y directions as well as the moments about orbiting scroll centerline O (FIG. 82) are presented in Equations 1–3:

$$\Sigma F_x=0=F_{is}-F_{fs}-F_{fg}-F_{rp}+F_{ib}*\mathrm{Cos}(\alpha) \quad (1)$$

$$\Sigma F_y=0=F_{tg}-F_{tp}-F_{rg}+F_{ib}*\mathrm{Sin}(\alpha) \quad (2)$$

where:

$$F_{is}=M*(2*\pi*RPM/60)^2*e$$

and $$F_{ib}=M_b*(2*\pi*RPM/60)^2*\sqrt{e^{2+((d-b)*\mathrm{Cos}(\pi-\delta))^2}}$$

$$\Sigma M_o=0=F_{rp}*b*\mathrm{Cos}(\theta)-F_{tp}-F_{rg}*b*\mathrm{Sin}(\theta)+F_{ib}*e*\mathrm{Sin}(\alpha) \quad (3)$$

Figure 82:
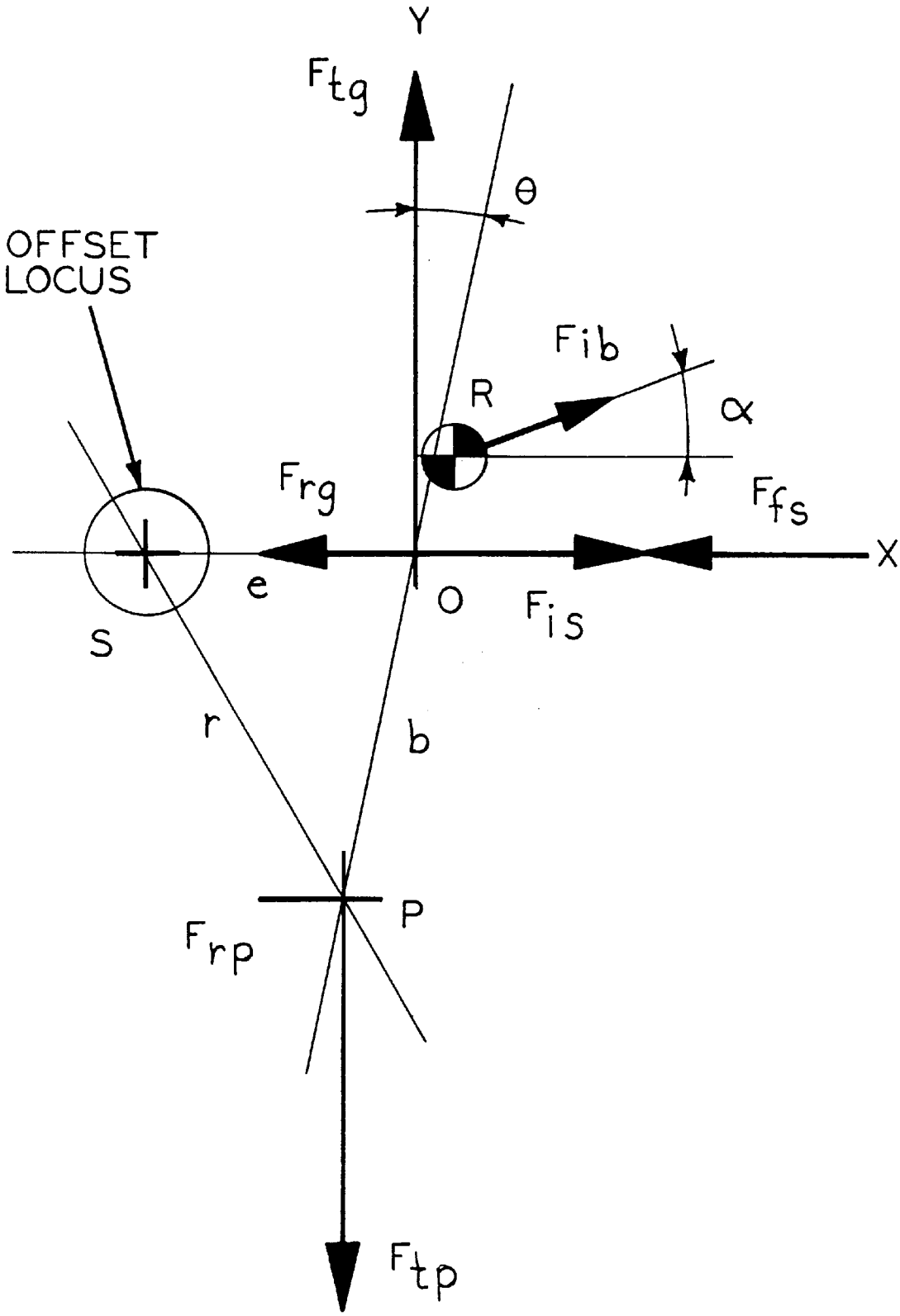
FIG. 82 is a force diagram for a swing link radial compliance mechanism.

The fixed scroll may be physically translated by an offset defining a locus shown in FIG. 82. Consequently the orbiting radius (eccentricity) will vary with the crankshaft angle.

Figure 89:
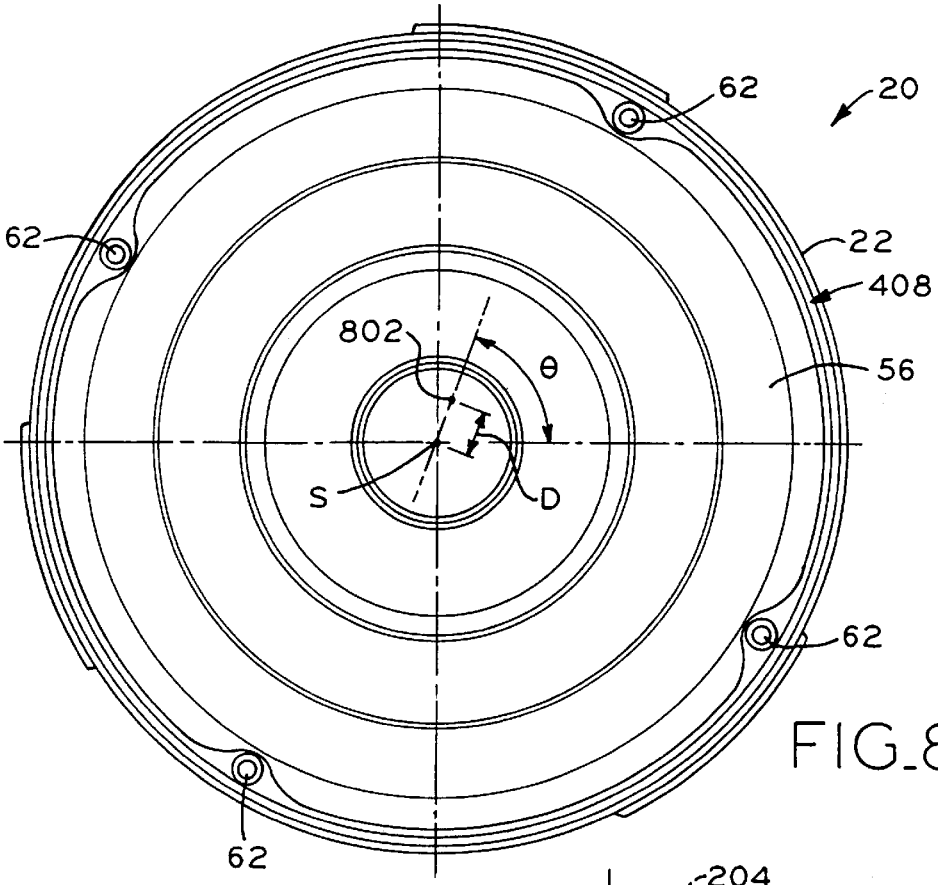
FIG. 89 is a top view of the compressor shown in FIG. 1, along line 89—89 thereof, showing crankshaft center axis to fixed scroll centerline offset.
Figure 90:
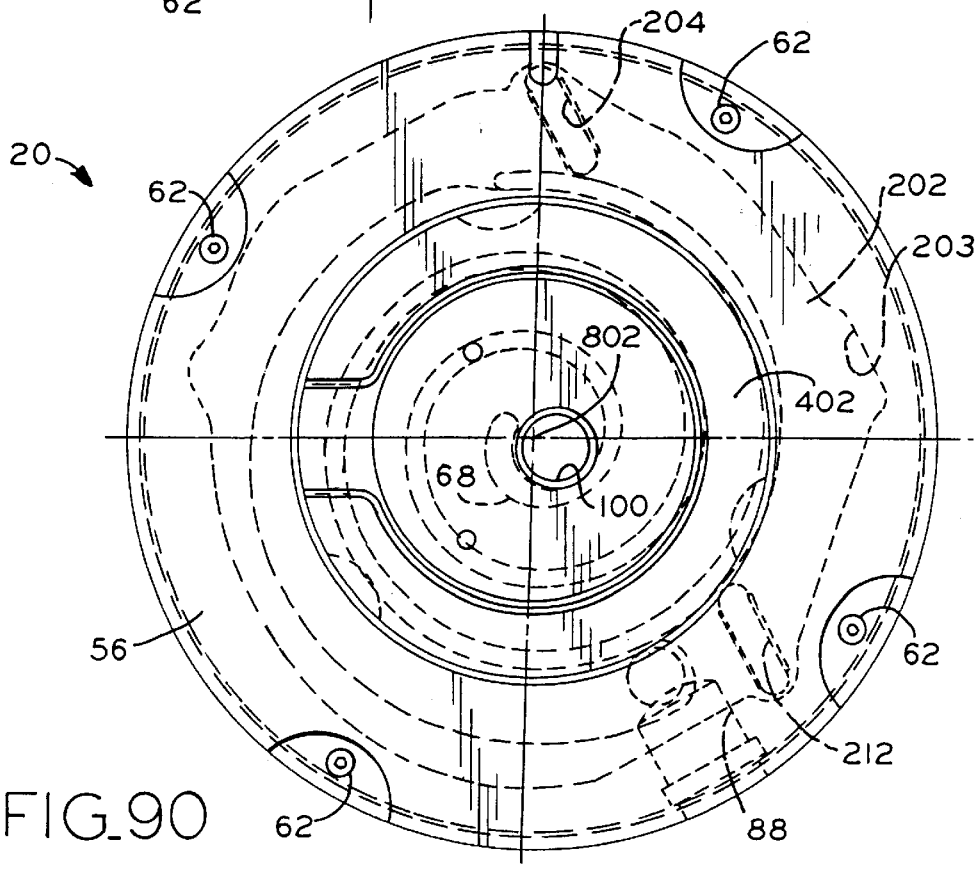
FIG. 90 is a top view of the compressor shown in FIG. 1, along line 90—90 thereof, showing the axial centerline of the fixed scroll member.

With reference to FIGS. 89, 90, as proven in Equation 1, fixed scroll centerline 802 to crankshaft center S offset D causes flank contact force variation only because of the variation in centrifligal force. The swing link brings an additional effect. The centrifurgal force changes in same manner the flank sealing force, respectively a positive offset increases the distance between the orbiting scroll center of mass O and crankshaft rotation axis S, thus the flank contact force is increased. However, the positive fixed scroll to crankshaft center offset D causes an increase of the radial compliance angle θ. The increased radial compliance angle decreases the flank contact force due to the radial component of the drive force. Thus, the swing link mechanism has an inherent compensating effect.

The fixed scroll to crankshaft center offset (assumed along line e of FIG. 82) causes a change of the radial compliance angle. Table I shows the relation between offset values and the radial compliance angle.

TABLE I

| Offset, inches | −0.10 | −0.08 | −0.06 | −0.04 | −0.02 | 0.00 | 0.02 | 0.04 | 0.06 | 0.08 | 0.10 |
|---|---|---|---|---|---|---|---|---|---|---|---|
| Compliance angle, degree | −14.1 | −10.2 | −6.8 | −3.8 | −1.1 | 1.4 | 3.7 | 5.9 | 8.0 | 10.0 | 12.0 |

Figure 83:
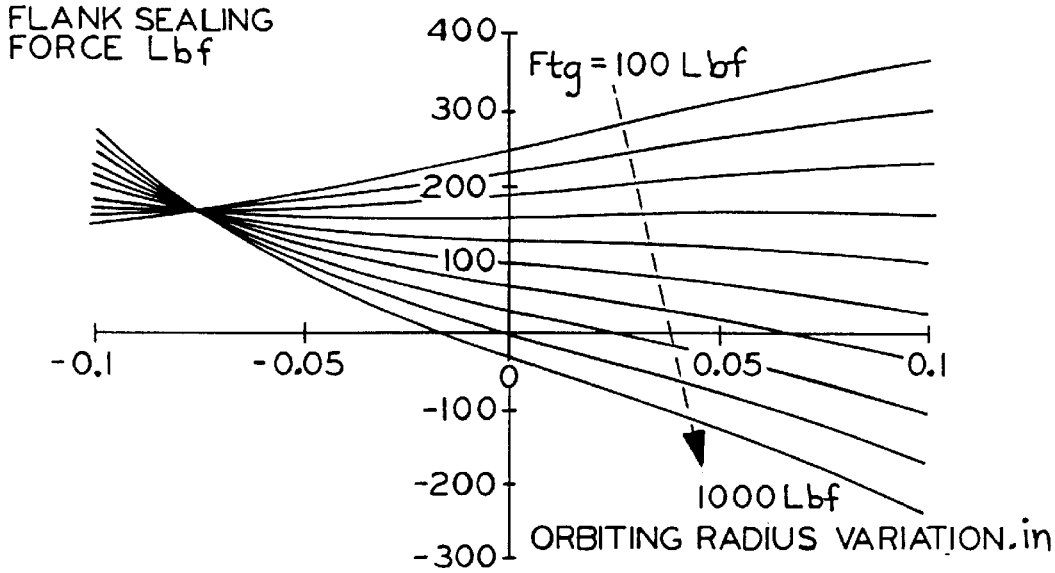
FIG. 83 is a graph showing the values of flank contact force versus orbiting radius variation due to fixed scroll to crankshaft center offset for tangential gas forces varying from 100 to 1000 lbf.

FIG. 83 is a graph in which the values of the flank contact force versus orbiting radius variation due to the offset for different instantaneous values of the tangential gas force obtained by solving the system of Equations 1–3 are plotted.

FIG. 83 shows the flank contact force for a gas tangential force varying from 100 to 1000 lbf. The gas radial force is assumed to be 10% the gas tangential force value. Other numerical values substituted in Equations 1–3 are for a typical four ton scroll compressor. The variable on the X axis represents the fixed scroll offset. A positive offset corresponds to the orbiting scroll center line moving further from the crankshaft centerline. Equations 1–3 show the following changes have opposite effects: (1) in general, an increase of the gas tangential force increases the flank sealing force; and (2) an increase of the orbiting scroll and swing link centrifuigal forces increases the flank sealing force.

The curves in FIG. 83 show also that the fixed scroll to crankshaft center offset effect on flank sealing force depends on the amplitude of the tangential gas force. For gas tangential force less than 400 lbf, the flank contact force increases by increasing the orbiting radius. For gas tangential force greater than 400 lbf, the flank contact force decreases by increasing the orbiting radius. There is negligible change in the value of flank sealing force for a gas tangential force of 400 lbf. For a fixed scroll to crankshaft center offset of −0.075 inch, the flank contact force is constant.

The value of the orbiting radius, e, varies with crankshaft angle in a sinusoidal manner. The flank sealing force presented in FIG. 83 is plotted vs. the crankshaft angle, ξ, in FIG. 84 for a 0.010 inch fixed scroll to crankshaft center offset D. The orbiting scroll eccentricity is a function of crankshaft angle and it is calculated as follows:

$$e(\xi)=D*\sin(\xi)$$

where ξ is the crankshaft angle.

Figure 84:
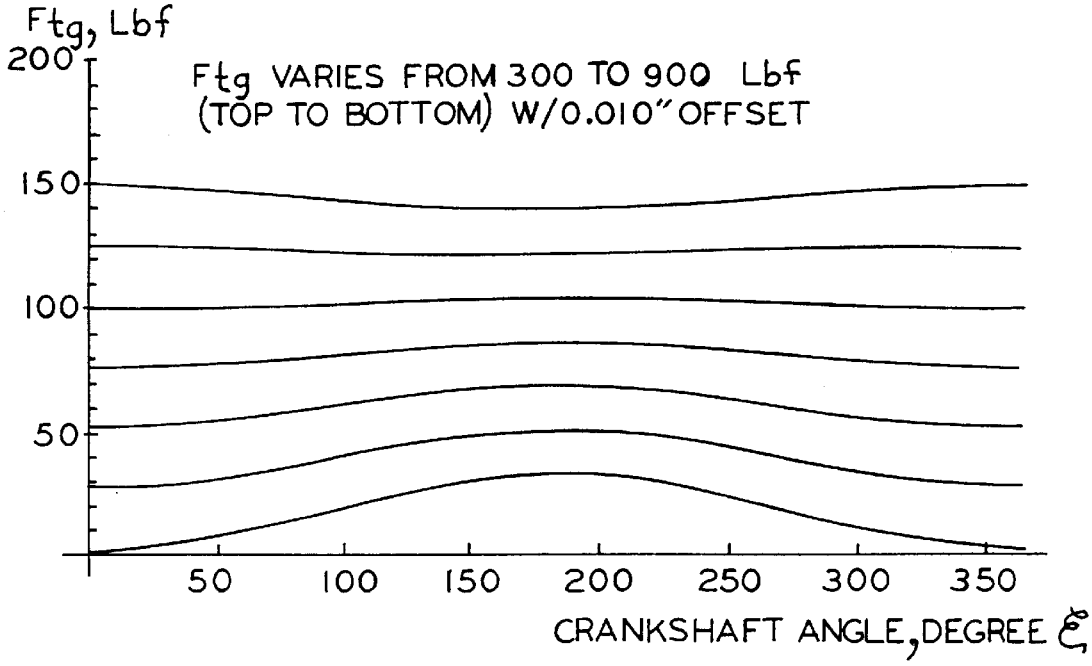
FIG. 84 is a graph showing the values of flank sealing force versus crankshaft angle for several values of tangential gas force for a fixed scroll to crankshaft center offset of 0.010 inch.

FIG. 84 shows the variation of flank sealing force with crankshaft angle for several values of tangential gas force for a radial compliance angle θ of the 0.010 inch offset. The flank sealing force is inversely proportional to the tangential gas force. However, the offset effect changes qualitatively when increasing the tangential gas force. For an optimal choice of the phase angle, the fixed scroll to crankshaft center offset reduces the maximum sealing force and increases the minimum sealing force. This selective effect can be seen for the phase angle case depicted in FIG. 84 at a crankshaft angle value of about 180 degrees.

Figure 85:
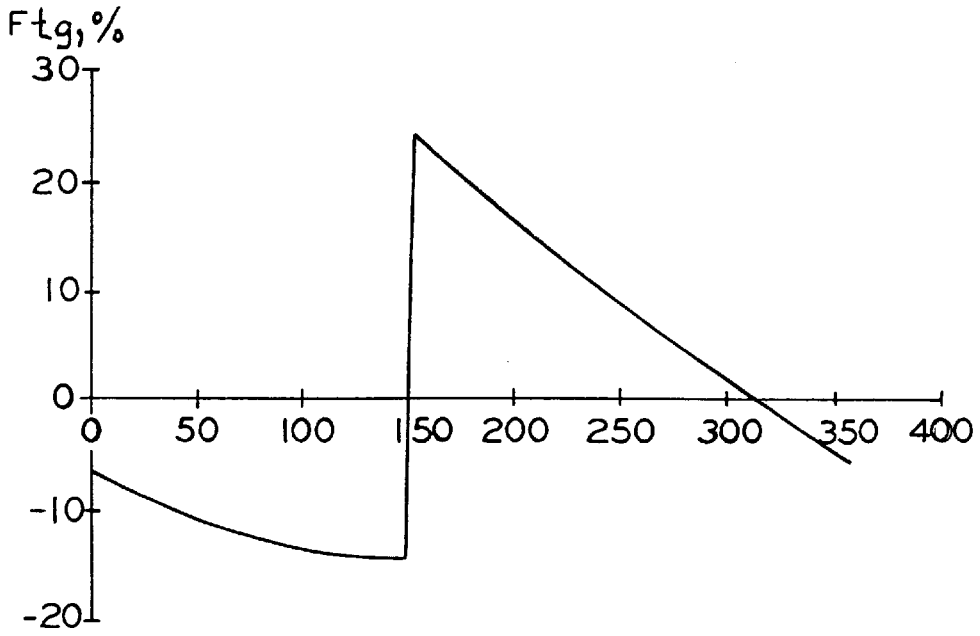
FIG. 85 is a graph showing the values of tangential gas force variation versus crankshaft angle for a highly loaded compressor.

For example, the tangential gas force variation versus crankshaft angle as determined for a scroll compressor operating at a highly loaded condition is plotted in FIG. 85. The radial gas force, $F_{rg}$, for this condition is about 10% the average tangential gas force, $F_{tg}$.

Figure 86:
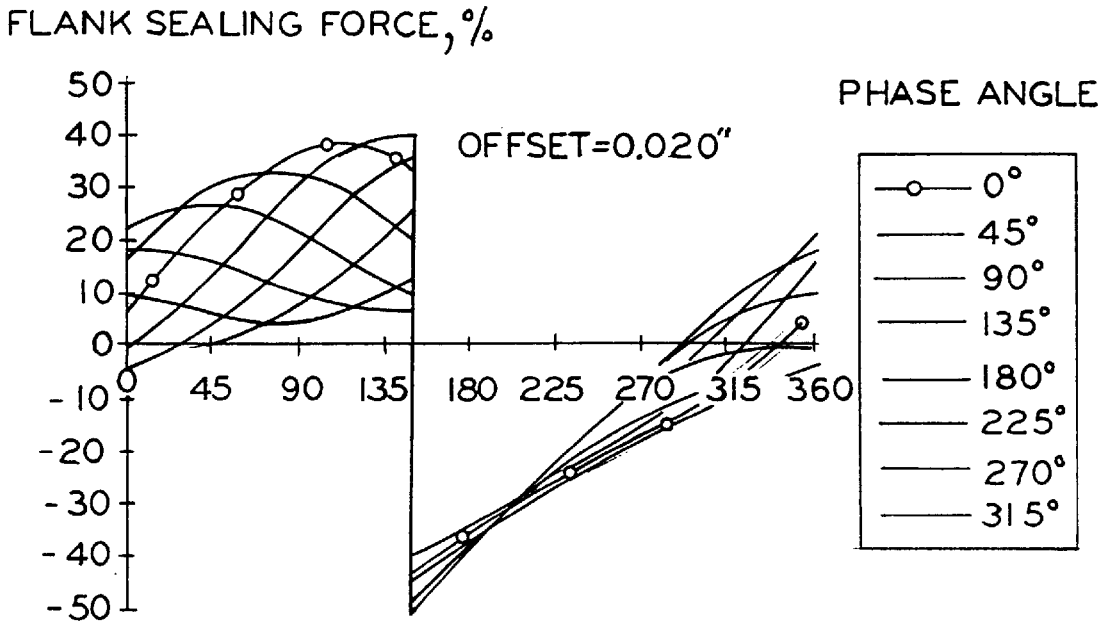
FIG. 86 is a graph showing the flank sealing force versus the crankshaft angle for a fixed scroll to crankshaft center offset of 0.020 inch and a tangential gas force variation as shown in FIG. 85.
Figure 87:
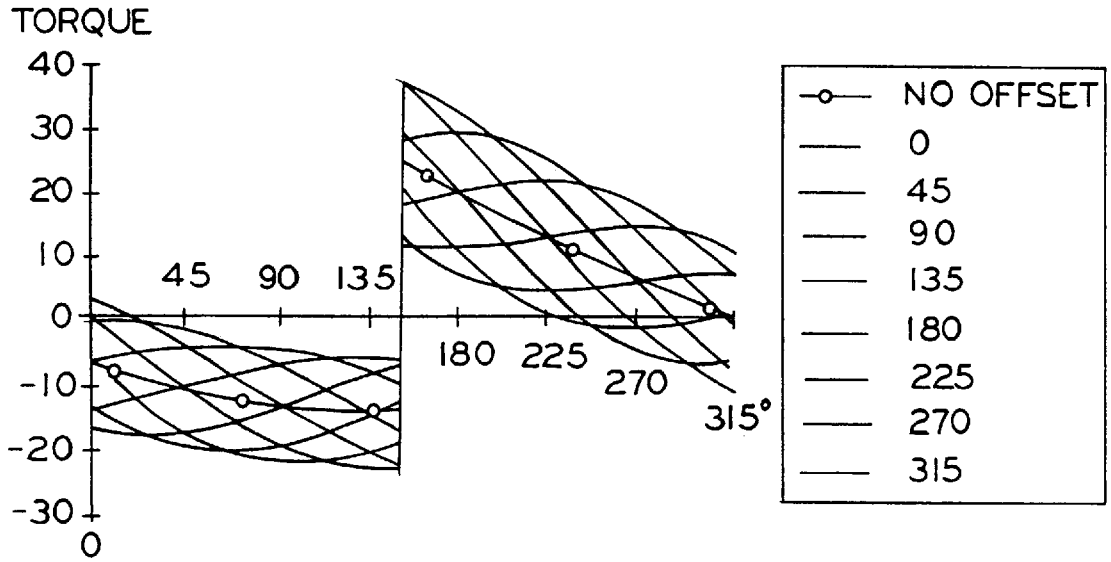
FIG. 87 is a graph showing the calculated values of peak to peak crankshaft torque load variation versus crankshaft angle for various fixed scroll to crankshaft center offset values.

FIG. 86 shows the flank sealing force versus the crankshaft angle for a fixed scroll to crankshaft center offset D of 0.020 inch and a tangential gas force variation as shown in FIG. 85. Eight different values for the phase between offset and pressure variation are considered. This figure shows the offset effect emphasized in FIG. 84 for the tangential gas variation illustrated in FIG. 85. The flank sealing force is inversely proportional to the variation of the gas tangential force. Flank sealing force variation can be reduced for a phase angle about 90 degrees. FIG. 87 shows the values calculated for torque versus crankshaft angle.

Figure 88:
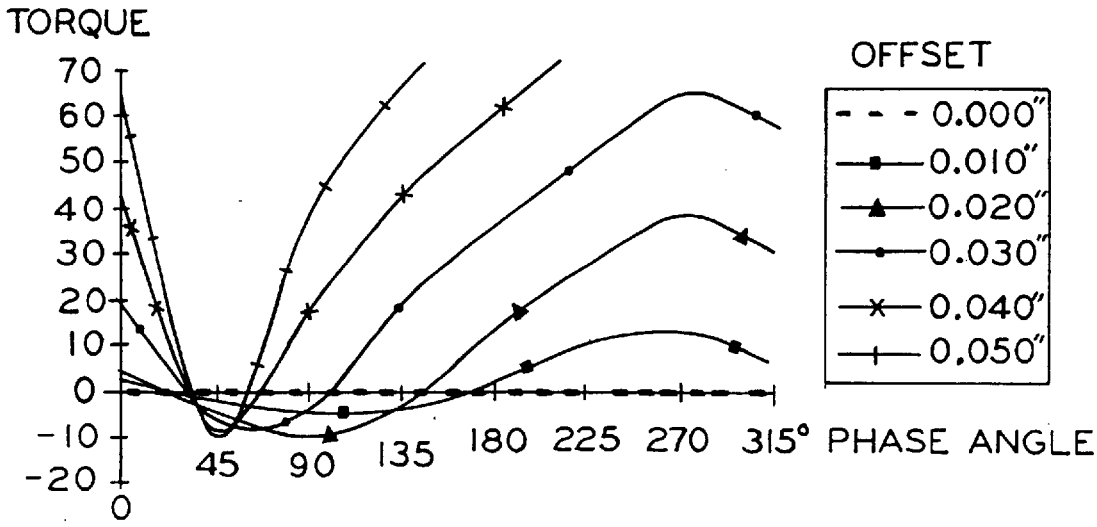
FIG. 88 is a graph showing the calculated values of peak to peak crankshaft torque load variation versus radial compliance angle for various fixed scroll to crankshaft center offset values.

For a better understanding of the fixed scroll to crankshaft center offset effect on torque variation, the peak-to-peak variations are plotted in FIG. 88 for several offset values versus the phase angle. In FIG. 88 one can determine for a given offset the phase angle range where a flattening of the crankshaft torque variation can be obtained. Next, from FIG. 86 the specific phase angle to minimize flank sealing force variation can be obtained.

From the foregoing it has been concluded that the effect of the fixed scroll to crankshaft center offset is more complex in the case of a swing link than in the case of a slider block. It is shown that the centrifugal force has an opposite effect than the radial compliance angle upon the flank sealing force. An appropriate choice of the fixed scroll offset will reduce the torque variation and at the same time reduce the variation of the flank contact force. This implies a reduced value of the maximum flank contact force while the minimum flank contact force still suffices for sealing. The lower value of the maximum sealing force means less friction loading, thus an opportunity for a more efficient compressor as well as a quieter scroll compressor.

While this invention has been described as having certain embodiments, the present invention can be further modified within the spirit and scope of this disclosure. This application is therefore intended to cover any variations, uses, or adaptations of the invention using its general principles.

What is claimed is:

1. A scroll compressor having a suction chamber into which fluid is received substantially at suction pressure and a discharge chamber from which the fluid is discharged substantially at discharge pressure, comprising:

a fixed scroll member having a fixed involute wrap element projecting from a substantially planar surface thereof;

an orbiting scroll member having an orbiting involute wrap element projecting from a substantially planar surface thereof, said fixed and orbiting scroll members mutually engaged with said fixed involute wrap element projecting towards said substantially planar surface of said orbiting scroll member, and said orbiting involute wrap element projecting towards said substantially planar surface of said fixed scroll member, said substantially planar surfaces positioned substantially parallel with one another, whereby relative orbiting of said scroll members compresses the fluid between said involute wrap elements, said engaged scroll members in fluid communication with said suction and discharge chambers;

an intermediate pressure chamber defined in part by one of said fixed and orbiting scroll members, said intermediate pressure chamber in fluid communication with a source of pressure intermediate suction and discharge pressures, whereby said fixed and orbiting scroll members are at least partially urged into axial sealing engagement by forces induced by fluid pressure in said intermediate pressure chamber;

an oil reservoir;

an electric motor;

a shaft operably coupling said motor and said orbiting scroll member, said shaft provided with a longitudinal passageway extending longitudinally therethrough, said longitudinal passageway in fluid communication with said oil reservoir, said longitudinal passageway provided with oil from said oil reservoir, said shaft having a first passage in fluid communication with said longitudinal passageway, said first passage extending substantially laterally outward from said longitudinal passageway to a radially outer surface of said shaft;

a roller disposed about said shaft radially outer surface, said orbiting scroll member linked to said shaft through said roller, said roller provided with inner and outer circumferential surfaces and a second passage extending therebetween, said first and second passages in fluid communication, whereby oil from said oil reservoir is provided to said roller outer circumferential surface through said longitudinal passageway and said first and second passages; and a bearing disposed between said roller outer circumferential surface and said orbiting scroll member, an oil receiving space provided adjacent said bearing, said oil receiving space defined in part by a surface provided on said orbiting scroll member which is opposite its said substantially planar surface, an axially facing surface of said roller, and an end surface of said shaft, oil provided from said second passage to said oil receiving space through said bearing;

wherein a third passage extends between said oil receiving space and an intermediate pressure space between said fixed and orbiting involute wrap elements, oil is provided to said intermediate pressure space from said oil receiving space through said third passage, and said intermediate pressure chamber and said oil receiving space are substantially out of fluid communication.

2. The scroll compressor of claim 1, wherein said bearing is a first bearing and said shaft radially outer surface is a first shaft radially outer surface, and wherein a fourth passage in fluid communication with said longitudinal passageway is provided in said shaft, said fourth passage extending substantially laterally outward from said longitudinal passageway to a second radially outer surface of said shaft, said shaft radially supported by a second bearing disposed about said second shaft radially outer surface, oil provided to said second bearing from said longitudinal passageway through said fourth passage.

3. The scroll compressor of claim 2, wherein along said longitudinal passageway said fourth passage is upstream of said first passage.

4. The scroll compressor of claim 2, wherein an annular oil gallery is provided adjacent said second bearing, oil received in said annular oil gallery from said fourth passage through said second bearing, said annular oil gallery substantially out of fluid communication with said intermediate pressure chamber.

5. The scroll compressor of claim 4, wherein said annular oil gallery is in fluid communication with said discharge pressure chamber.

6. The scroll compressor of claim 5, wherein said oil reservoir is located in said discharge pressure chamber.

7. The scroll compressor of claim 4, wherein said annular oil gallery is in fluid communication with said second passage through said first bearing.

8. The scroll compressor of claim 1, wherein said first and second passages are maintained in constant fluid communication.

9. The scroll compressor of claim 8, wherein said roller is rotationally constrained relative to said shaft.

10. The scroll compressor of claim 1, wherein said longitudinal passageway extends completely through the length of said shaft, said longitudinal passageway provided with a plug, said oil receiving space in part defined by said plug.

11. The scroll compressor of claim 1, wherein an annular oil gallery is provided adjacent said bearing, said annular oil gallery in fluid communication with said discharge pressure chamber.

12. A scroll compressor having a suction chamber into which fluid is received substantially at suction pressure and a discharge chamber from which the fluid is discharged substantially at discharge pressure, comprising:

a fixed scroll member having a fixed involute wrap element projecting from a substantially planar surface thereof;

an orbiting scroll member having an orbiting involute wrap element projecting from a substantially planar surface thereof, said fixed and orbiting scroll members mutually engaged with said fixed involute wrap element projecting towards said substantially planar surface of said orbiting scroll member, and said orbiting involute wrap element projecting towards said substantially planar surface of said fixed scroll member, said substantially planar surfaces positioned substantially parallel with one another, whereby relative orbiting of said scroll members compresses the fluid between said involute wrap elements, said engaged scroll members in fluid communication with said suction and discharge chambers;

an electric motor;

a shaft having a radially outer surface and operably coupling said motor and said orbiting scroll member;

a roller disposed about said shaft radially outer surface, said orbiting scroll member linked to said shaft through said roller, said roller provided with inner and outer circumferential surfaces; and a bearing disposed between said outer circumferential roller surface and said orbiting scroll member, a space provided adjacent said bearing, said space defined in part by a surface provided on said orbiting scroll member which is opposite its said substantially planar surface, a first axially facing surface of said roller, and an end surface of said shaft;

wherein a passage extends between said space and an intermediate pressure space between said fixed and orbiting involute wrap elements, and a longitudinal clearance is provided between said roller inner circumferential surface and said shaft radially outer surface, a vent formed between said intermediate pressure space and said discharge pressure chamber through said passage, said space and said clearance, whereby fluid at a pressure greater than discharge pressure in said intermediate pressure space is provided a flowpath which does not flow through said bearing.

13. The scroll compressor of claim 12, wherein a second axially facing surface of said roller is provided with a channel which extends between said inner and outer circumferential surfaces of said roller, said vent extending along said channel.

14. The scroll compressor of claim 13, wherein said roller second axially facing surface is provided with a countersink surrounding said shaft radially outer surface and located between said clearance and said channel, said clearance and said channel in fluid communication through said countersink.

15. The scroll compressor of claim 13, wherein said orbiting scroll member is provided with an annular oil gallery adjacent said bearing, said annular oil gallery in fluid communication with said discharge chamber, said channel opening into said annular oil gallery.

16. The scroll compressor of claim 13, wherein the juncture of said roller second axially facing surface and said roller inner circumferential surface is provided with a countersink, said channel opening into said countersink.

17. The scroll compressor of claim 12, wherein said bearing is provided with oil at a pressure which is at least discharge pressure, a portion of the oil provided to said bearing received in said space, at least some of that oil portion conveyed from said space to said intermediate pressure space via said passage, whereby said fixed and orbiting involute wrap elements are lubricated.

18. The scroll compressor of claim 17, wherein an annular oil gallery is provided adjacent said bearing, a portion of the oil provided to said bearing received in said annular oil gallery, said annular oil gallery in fluid communication with said discharge chamber.

* * * * *